US011814091B2

(12) United States Patent
Rush et al.

(10) Patent No.: US 11,814,091 B2
(45) Date of Patent: Nov. 14, 2023

(54) VEHICLE COMMUNICATION AND CONTROL SYSTEM

(71) Applicant: Transportation IP Holdings, LLC, Norwalk, CT (US)

(72) Inventors: Daniel Joseph Rush, St. Charles, IL (US); Robert Carmen Palanti, West Melbourne, FL (US); Adam Charles Hausmann, Melbourne, FL (US)

(73) Assignee: transportation ip holdings, llc, Norwalk, CT (US)

( * ) Notice: Subject to any disclaimer, the term of this patent is extended or adjusted under 35 U.S.C. 154(b) by 511 days.

(21) Appl. No.: 17/032,907

(22) Filed: Sep. 25, 2020

(65) Prior Publication Data

US 2021/0094597 A1 Apr. 1, 2021

Related U.S. Application Data

(60) Provisional application No. 63/058,109, filed on Jul. 29, 2020, provisional application No. 62/907,281, filed on Sep. 27, 2019.

(51) Int. Cl.

| | |
|---|---|
| ***B61L 27/00*** | (2022.01) |
| ***B61L 27/04*** | (2006.01) |
| ***B61L 25/04*** | (2006.01) |
| ***B61L 27/57*** | (2022.01) |
| ***B61G 7/14*** | (2006.01) |
| ***B61L 27/30*** | (2022.01) |
| ***B61L 27/40*** | (2022.01) |

(52) U.S. Cl.

CPC ..... *B61L 27/57* (2022.01); *B61G 7/14* (2013.01); *B61L 25/04* (2013.01); *B61L 27/04* (2013.01); *B61L 27/30* (2022.01); *B61L 27/40* (2022.01)

(58) Field of Classification Search

CPC ..... B61L 27/57; B61L 27/40; B61L 27/30; B61L 25/04; B61L 27/04; B61G 7/14

See application file for complete search history.

(56) References Cited

U.S. PATENT DOCUMENTS

| | | | |
|---|---|---|---|
| 6,759,951 | B2 | 7/2004 | Kellner et al. |
| 7,983,805 | B2 | 7/2011 | Bryant |
| 8,073,582 | B2 | 12/2011 | Kellner et al. |
| 8,224,591 | B2 | 7/2012 | Smith et al. |
| 8,280,566 | B2 | 10/2012 | Foy, III et al. |

(Continued)

*Primary Examiner* — Peter D Nolan

*Assistant Examiner* — Demetra R Smith-Stewart

(74) *Attorney, Agent, or Firm* — The Small Patent Law Group LLC; Jason P. Gross

(57) ABSTRACT

A system includes one or more processors and a communication device onboard a first remote vehicle of a vehicle system that includes a controlling vehicle. The one or more processors are configured to establish a communication link with the controlling vehicle, and, in a first mode of operation, to automatically control movement of the designated remote vehicle responsive to movement-control messages received from the controlling vehicle over the communication link. The one or more processors are also configured, responsive to receipt of a designated suspend message from the controlling vehicle, to switch the designated remote vehicle from the first mode of operation to a second mode of operation where movement of the designated remote vehicle is controlled independently of the controlling vehicle while maintaining the communication link.

20 Claims, 23 Drawing Sheets

(56) References Cited

U.S. PATENT DOCUMENTS

| | | | | |
|---|---|---|---|---|
| 8,364,338 | B2 | 1/2013 | Peltonen et al. | |
| 8,521,447 | B2 | 8/2013 | Smith et al. | |
| 8,725,323 | B2 | 5/2014 | Cooper et al. | |
| 9,180,892 | B2 | 11/2015 | Cooper et al. | |
| 9,227,639 | B1 | 1/2016 | Bryant et al. | |
| 10,279,825 | B2 * | 5/2019 | Kim | B61L 15/0027 |
| 10,464,579 | B2 | 11/2019 | Cooper et al. | |
| 10,543,860 | B2 * | 1/2020 | Hutchins | B61C 17/12 |
| 2010/0074160 | A1 | 3/2010 | Mason et al. | |
| 2010/0130124 | A1 | 5/2010 | Teeter et al. | |
| 2014/0249699 | A1 | 9/2014 | Cooper et al. | |
| 2015/0360700 | A1 | 12/2015 | Cooper et al. | |
| 2016/0009302 | A1 | 1/2016 | Bryant et al. | |
| 2016/0107661 | A1 * | 4/2016 | Cooper | B61L 15/0072 246/167 R |
| 2016/0359741 | A1 * | 12/2016 | Cooper | H04W 4/44 |
| 2019/0176862 | A1 * | 6/2019 | Kumar | B61L 15/0081 |
| 2019/0263430 | A1 | 8/2019 | Smith et al. | |
| 2019/0276055 | A1 | 9/2019 | Cooper et al. | |

* cited by examiner

VEHICLE COMMUNICATION AND CONTROL SYSTEM

CROSS-REFERENCE TO RELATED APPLICATIONS

The present application claims priority to U.S. Provisional Application No. 62/907,281, filed on Sep. 27, 2019, and U.S. Provisional Application No. 63/058,109, filed on Jul. 29, 2020, each of which is hereby incorporated by reference in its entirety.

The present application includes subject matter from U.S. Patent Application Publication No. 2019/0263430 A1 and U.S. Patent Application Publication No. 2019/0276055 A1, which are also incorporated herein by reference.

FIELD

Embodiments of the inventive subject matter described herein relate to vehicle control. Other embodiments relate to coordinated control of plural vehicles.

BACKGROUND

Some vehicle systems include several propulsion-generating vehicles that generate tractive efforts for propelling the vehicle system along a route. One such vehicle system includes a train, which may have multiple locomotives coupled with one another. The combined tractive efforts and braking efforts of the multiple locomotives can move the train along the track in a controlled manner. The locomotives may be directly coupled to each other or indirectly coupled to one another such that one or more rail cars are positioned between the locomotives. The locomotives may communicate with each other to coordinate the tractive efforts and/or braking efforts provided by the locomotives. As one example, locomotives may be provided in a distributed power (DP) arrangement with one locomotive designated as a controlling locomotive and other locomotives designated as remote locomotives. The controlling locomotive may direct the tractive and braking efforts provided by the remote locomotives during a trip of the consist. Various DP arrangements exist, such as a push-pull arrangement, a banker arrangement, or a long train arrangement in which the locomotives are distributed throughout a length of the train.

A group of propulsion-generating vehicles that work with one another to move the vehicle system may be referred to as a vehicle consist. Some known vehicle consists use wireless communication between the propulsion-generating vehicles for coordinating the tractive and/or braking efforts. For example, a controlling locomotive of a vehicle consist in a train can issue commands to the remote locomotives of the vehicle consist. The remote locomotives receive the commands and implement the tractive efforts and/or braking efforts directed by the commands.

Before the remote locomotives will operate per command messages received from a controlling locomotive, however, communication links between the controlling locomotive and the remote locomotives need to be established. This may involve a relatively complex and lengthy set of linking procedures, including operators having to go onboard the remote locomotives for setup purposes, and/or an exchange of specially-formatted "handshake" and similar electronic signals/messages.

Uncoupling propulsion-generating vehicles of a vehicle consist can also be complex and time-consuming. For example, uncoupling locomotives from a distributed power-linked consist (e.g., to temporarily break a train apart for adding or re-sorting rail cars), may require unlinking the entire train. In some cases, the decoupled locomotive is automatically controlled to remain stationary as a safety measure. Subsequently, re-coupling or otherwise returning the train to normal distributed power operations requires carrying out at least part of the original, lengthy linking process.

It may be desirable to provide systems and methods for vehicle communications and coordinated control that differ from existing systems and methods.

BRIEF DESCRIPTION

In an embodiment, a system (e.g., for vehicle communications and control) includes one or more processors configured to be operably disposed onboard a designated remote vehicle of a vehicle system that includes a controlling vehicle. The system also includes a communication device configured to be operably disposed onboard the designated remote vehicle. The one or more processors are configured to establish one or more communication links (e.g., using the communication device). The one or more processors are configured to control movement of the designated remote vehicle in a first mode of operation and to be responsive to movement-control messages received from the controlling vehicle over the one or more communication links. The one or more processors are further configured, responsive to receipt of a suspend message from the controlling vehicle, to change the designated remote vehicle from the first mode of operation to a second mode of operation where movement of the designated remote vehicle is separately controlled from the controlling vehicle while maintaining the one or more communication links.

In an embodiment, a system (e.g., for vehicle communications and control) includes one or more processors configured to be operably disposed onboard a controlling vehicle of a vehicle system that includes one or more remote vehicles. The system also includes a communication device configured to be operably disposed onboard the controlling vehicle and coupled to the one or more processors. The one or more processors are configured to establish one or more communication links (e.g., using the communication device) with the one or more remote vehicles and communicate, through the one or more communication links, movement-control messages to control movement of the one or more remote vehicles that are operating in a first mode of operation. The one or more processors are configured to communicate a suspend message to a designated remote vehicle of the one or more remote vehicles that commands the designated remote vehicle to change from the first mode of operation to a second mode of operation. Subsequent to communicating the suspend message, the one or more processors are further configured to at least one of:

- change a stored current status of the designated remote vehicle from a currently remote status to a currently-suspended status, wherein the currently remote status is indicative of the designated remote vehicle being in the first mode of operation and the currently-suspended status is indicative of the designated remote vehicle being in the second mode of operation;
- exchange linking messages between the designated remote vehicle and the controlling vehicle through the one or more communication links to confirm the one or more communication links exists;
- communicate new movement-control messages to at least one other remote vehicle in the first mode of operation but not communicate the new movement-control messages to the designated remote vehicle; or confirm the designated remote vehicle is mechanically decoupled from the controlling vehicle or a consist that includes the controlling vehicle.

In an embodiment, a method includes, for a vehicle system that includes a controlling vehicle and plural remote vehicles, establishing one or more communication links between the controlling vehicle and a designated remote vehicle of the plural remote vehicles of a vehicle system. The method also includes controlling movement of the designated remote vehicle in a first mode of operation, wherein controlling movement of the designated remote vehicle in the first mode of operation includes controlling movement of the designated remote vehicle based on movement-control messages received from the controlling vehicle at the designated remote vehicle. The method also includes responsive to receiving, at the designated remote vehicle, a suspend message, changing the designated remote vehicle from the first mode of operation to a second mode of operation. The method also includes controlling movement of the designated remote vehicle in the second mode of operation, wherein controlling movement of the designated remote in the second mode of operation includes separately controlling movement from the controlling vehicle while maintaining the one or more communication links.

Optionally, the designated remote vehicle may be one remote vehicle among plural remote vehicles. One or more of the other remote vehicles may also operate in the first mode of operation. One or more of the other remote vehicles may be a trailing remote vehicle with respect to the designated remote vehicle.

BRIEF DESCRIPTION OF THE DRAWINGS

Reference is now made briefly to the accompanying drawings, in which.

DETAILED DESCRIPTION

Figure 1:
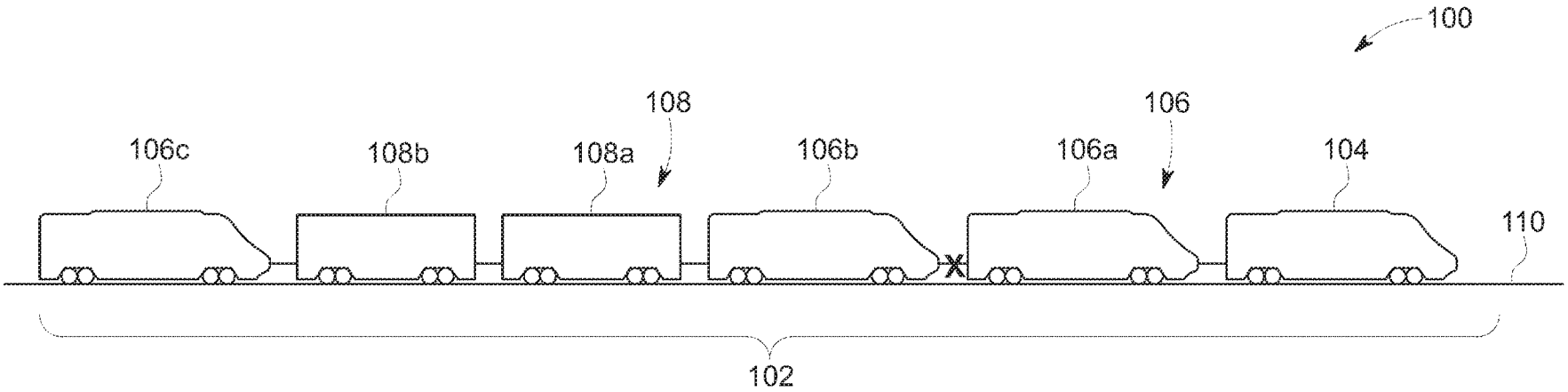
FIG. 1 illustrates one embodiment of a communication system of a vehicle consist or vehicle system.

One or more embodiments of the inventive subject matter described herein provides for methods and systems for communicating between propulsion-generating vehicles in a vehicle consist or vehicle system. This subject matter may be used in connection with rail vehicles and rail vehicle consists, or alternatively may be used with other types of vehicles. For example, the subject matter described herein may be used in connection with automobiles, trucks, mining vehicles, other off-highway vehicles (e.g., vehicles that are not designed or are not legally permitted for travel on public roadways), aerial vehicles (e.g., fixed wing aircraft, drones or other unmanned aircraft, etc.), or marine vessels.

The vehicle consist or vehicle system can include two or more vehicles mechanically coupled with each other to travel along a route together. Optionally, the vehicle consist can include two or more vehicles that are not mechanically coupled with each other, but that travel along a route together. For example, two or more automobiles may wirelessly communicate with each other as the vehicles travel along the route together as a vehicle system to coordinate movements with each other.

The two or more vehicles of the vehicle consist may include a controlling vehicle and one or more remote vehicles. In operation, the controlling vehicle can command (e.g., through wired or wireless messages) the remote vehicle(s) to change throttle settings, brake settings, speeds, power outputs, or the like of the remote vehicles during movement of the vehicle consist. As such, the controlling and remote vehicle may coordinate tractive and braking efforts to move the vehicle consist along the route.

One or more embodiments of the inventive subject matter described herein provide for methods and systems for changing a mode of operation of one or more of the remote vehicles of the vehicle consist. Particular embodiments enable a decoupled remote vehicle of the vehicle consist to operate independently of the controlling vehicle and other remote vehicles, if any. For example, the decoupled remote vehicle may be independently driven by an operator without the controlling vehicle controlling or otherwise influencing tractive and/or braking efforts of the remote vehicle. According to one or more embodiments, the remote vehicle may be subsequently re-coupled to the vehicle system and revert to its previous dependent relationship with the controlling vehicle in which the controlling vehicle can command the remote vehicle in coordinating the tractive and breaking efforts of the vehicle consist.

The controlling vehicle can communicate wireless linking messages to the remote vehicles. These linking messages may be addressed to the remote vehicles using the vehicle identifiers. For example, the linking messages may include the vehicle identifiers. Vehicles that receive the linking messages other than the remote vehicles in the consist may not be linked with the controlling vehicle due to the vehicle identifiers not matching or being associated with these other vehicles. At the remote vehicles that are included in the vehicle consist, the remote vehicles may be communicatively linked with the controlling vehicle. For example, the remote vehicles may communicate linking confirmation messages responsive to receiving the linking messages.

In some embodiments, the confirmation messages may only be sent through user inputs made at the remote vehicles. For example, an operator that is physically present within a cab of the remote vehicle can confirm receipt of the linking message by interacting with an onboard user interface. The user interface is configured to generate control signals responsive to operator manipulation of the user interface onboard the designated remote vehicle. For instance, the operator may press a button, touch a screen, and/or speak into a microphone, thereby confirming the linking message was received by the remote vehicle and causing the remote vehicle to transmit the confirmation message to the controlling vehicle. Optionally, the remote vehicles can communicate these confirmation messages without an operator having to enter onboard the remote vehicles. For example, while an operator may be onboard the controlling vehicle, the operator may not enter onboard any other vehicles in the vehicle consists to establish communication links between the controlling and remote vehicles in the vehicle consists.

Upon receiving the confirmation messages at the controlling vehicle, communication links between the controlling and remote vehicles are established. Establishing these communication links allows for the controlling vehicle to remotely control operations of the remote vehicles during movement of the vehicle consists along the route. For example, the controlling vehicle can communicate wireless command messages to change throttle settings, brake settings, speeds, power outputs, or the like of the remote vehicles during movement of the vehicle consists. Other vehicles that do not have communication links established with the controlling vehicle cannot be remotely controlled by the controlling vehicle.

FIG. 1 illustrates one embodiment of a communication system 100 of a vehicle consist or vehicle system 102. The illustrated vehicle consist 102 includes propulsion-generating vehicles 104, 106 (e.g., vehicles 104, 106A, 106B, 106C) and non-propulsion-generating vehicles 108 (e.g., vehicles 108A, 108B) that travel together along a route 110. Although the vehicles 104, 106, 108 are shown as being mechanically coupled with each other, optionally, the vehicles 104, 106, 108 may not be mechanically coupled with each other.

The propulsion-generating vehicles 104, 106 are shown as locomotives, the non-propulsion-generating vehicles 108 are shown as rail cars, and the vehicle consist 102 is shown as a train in the illustrated embodiment. Alternatively, the vehicles 104, 106 may represent other vehicles, such as automobiles, marine vessels, or the like, and the vehicle consist 102 can represent a grouping or coupling of these other vehicles. The number and arrangement of the vehicles 104, 106, 108 in the vehicle consist 102 are provided as one example and are not intended as limitations on all embodiments of the subject matter described herein.

In one embodiment, the group of vehicles 104, 106, 108 may be referred to as a vehicle system, with groups of one or more adjacent or neighboring propulsion-generating vehicles 104 and/or 106 being referred to as a vehicle consist. For example, the vehicles 104, 106A, 106B, 108A, 108B, and 106C may be referred to as a vehicle system with vehicles 104, 106A, 106B be referred to as a first vehicle consist of the vehicle system and the vehicle 106C referred to as a second vehicle consist in the vehicle system. Alternatively, the vehicle consists may be defined as the vehicles that are adjacent or neighboring to each other, such as a vehicle consist defined by the vehicles 104, 106A, 106B, 108A, 108B, 106C.

The propulsion-generating vehicles 104, 106 can be arranged in a distributed power (DP) arrangement. For example, the propulsion-generating vehicles 104, 106 can include a controlling vehicle 104 that issues command messages to the other propulsion-generating vehicles 106A, 106B, 106C which are referred to herein as remote vehicles. The designations "controlling" and "remote" are not intended to denote spatial locations of the propulsion-generating vehicles 104, 106 in the vehicle consist 102, but instead are used to indicate which propulsion-generating vehicle 104, 106 is communicating (e.g., transmitting, broadcasting, or a combination of transmitting and broadcasting) command messages and which propulsion-generating vehicles 104, 106 are being remotely controlled using the command messages. For example, the controlling vehicle 104 may or may not be disposed at the front end of the vehicle consist 102 (e.g., along a direction of travel of the vehicle consist 102). Additionally, the remote vehicles 106A-C need not be separated from the controlling vehicle 104. For example, a remote vehicle 106A-C may be directly coupled with the controlling vehicle 104 or may be separated from the controlling vehicle 104 by one or more other remote vehicles 106A-C and/or non-propulsion-generating vehicles 108. To more readily distinguish the different vehicles, a controlling vehicle may be labelled as a "lead vehicle" or a "command vehicle."

The command messages may include directives that direct operations of the remote vehicles. These directives can include propulsion commands that direct propulsion subsystems of the remote vehicles to move at a designated speed and/or power level, brake commands that direct the remote vehicles to apply brakes at a designated level, and/or other commands. The controlling vehicle 104 issues the command messages to coordinate the tractive efforts and/or braking efforts provided by the propulsion-generating vehicles 104, 106 in order to propel the vehicle consist 102 along a route 110, such as a track, road, waterway, or the like.

The command messages can be communicated using the communication system 100. In one embodiment, the command messages are wirelessly communicated using the communication system 100. The communication system 100 may include wireless transceiving hardware and circuitry disposed onboard two or more of the vehicles 104, 106. Prior to the remote vehicles being remotely controlled by a controlling vehicle in the vehicle consists, communication links may be established between the controlling and remote vehicles.

To establish a communication link between a controlling vehicle and a remote vehicle, the controlling vehicle may communicate (wired or wirelessly) a linking message to the remote vehicle. This linking message may include a unique code, such as a unique vehicle identifier, that is associated with the remote vehicle. This code may not be associated with or otherwise identify other remote vehicles in one embodiment. Alternatively, the vehicle identifier may identify or be associated with two or more remote vehicles, such as two or more remote vehicles that are the same type of vehicle, there included in the vehicle consists, or the like. At the remote vehicle that receives linking message, if the vehicle identifier in the linking message matches, is associated with, or otherwise identifies the remote vehicle, then the remote vehicle may communicate a confirmation message back to the controlling vehicle. This confirmation message may be wirelessly communicated to the controlling vehicle. The communication link between the controlling and remote vehicles may be established responsive to the linking message being received by the remote vehicle and a confirmation message being received by the controlling vehicle. Alternatively, the communication link between the controlling and remote vehicles may be established once the linking message is received at the remote vehicles, without requiring a confirmation message from being received back at the controlling vehicle.

The controlling vehicle may determine vehicle identifiers for the remote vehicles by receiving a list of unique identifying codes associated with the remote vehicles in the vehicle consist. This list may be received from one or more systems other than the communication system 100, such as a vehicle control system that restricts movement of the vehicle consists based at least in part on the location of the vehicle consists. One example of such a vehicle control system includes a positive train control or PTC system. Another example of such a system may include an energy management system that creates a trip plan to control movement of the vehicle consist. The trip plan can designate operational settings of the vehicle consist as a function of time, location, and/or distance along the route. The operational settings designated by the trip plan can reduce fuel consumed and/or emissions generated by the vehicle consist relative to the vehicle consist traveling according to other operational settings. Alternatively, the vehicle identifiers may be received from another type of system, such as a dispatch facility, a vehicle yard such as a rail yard, or the like. In one aspect, and operator may manually input the vehicle identifiers onboard the controlling vehicle.

For some embodiments, the operator is onboard the remote vehicle when confirming receipt of the linking message. Responsive to operator manipulation of the user interface onboard the remote vehicle, the user interface generates signals that indicate the linking message has been received. In other embodiments, however, operators may not be required to enter onboard the remote vehicles to identify these remote vehicles to the controlling vehicle. Instead, the remote vehicles are identified by a separate system such that the operators do not need to enter onboard the remote vehicles to determine which remote vehicles are in the vehicle consist. Thus, communication links between the controlling and remote vehicles may be established without requiring operators to enter onboard the remote vehicles. Consequently, considerable time and effort can be saved by avoiding requiring the operators to enter onboard the remote vehicles.

As described above, one or more embodiments enable changing a mode of operation of one or more of the remote vehicles of the vehicle consist such that a decoupled remote vehicle of the vehicle consist is able to operate independently of the controlling vehicle and other remote vehicles, if any. For illustration, the propulsion-generating vehicles 106A and 106B may be decoupled from each other. Such decouplings may occur when assembling or re-sorting a vehicle system. The decoupled propulsion-generating vehicle 106A may then be independently driven by an operator without the controlling vehicle 104 controlling or otherwise influencing tractive and/or braking efforts of the remote vehicle. The decoupled propulsion-generating vehicle 106A may be subsequently re-coupled to the vehicle system 102 and revert to its previous dependent relationship with respect to the controlling vehicle 104, wherein the controlling vehicle 104 can command the remote vehicle in coordinating the tractive and breaking efforts of the vehicle consist.

Figure 2:
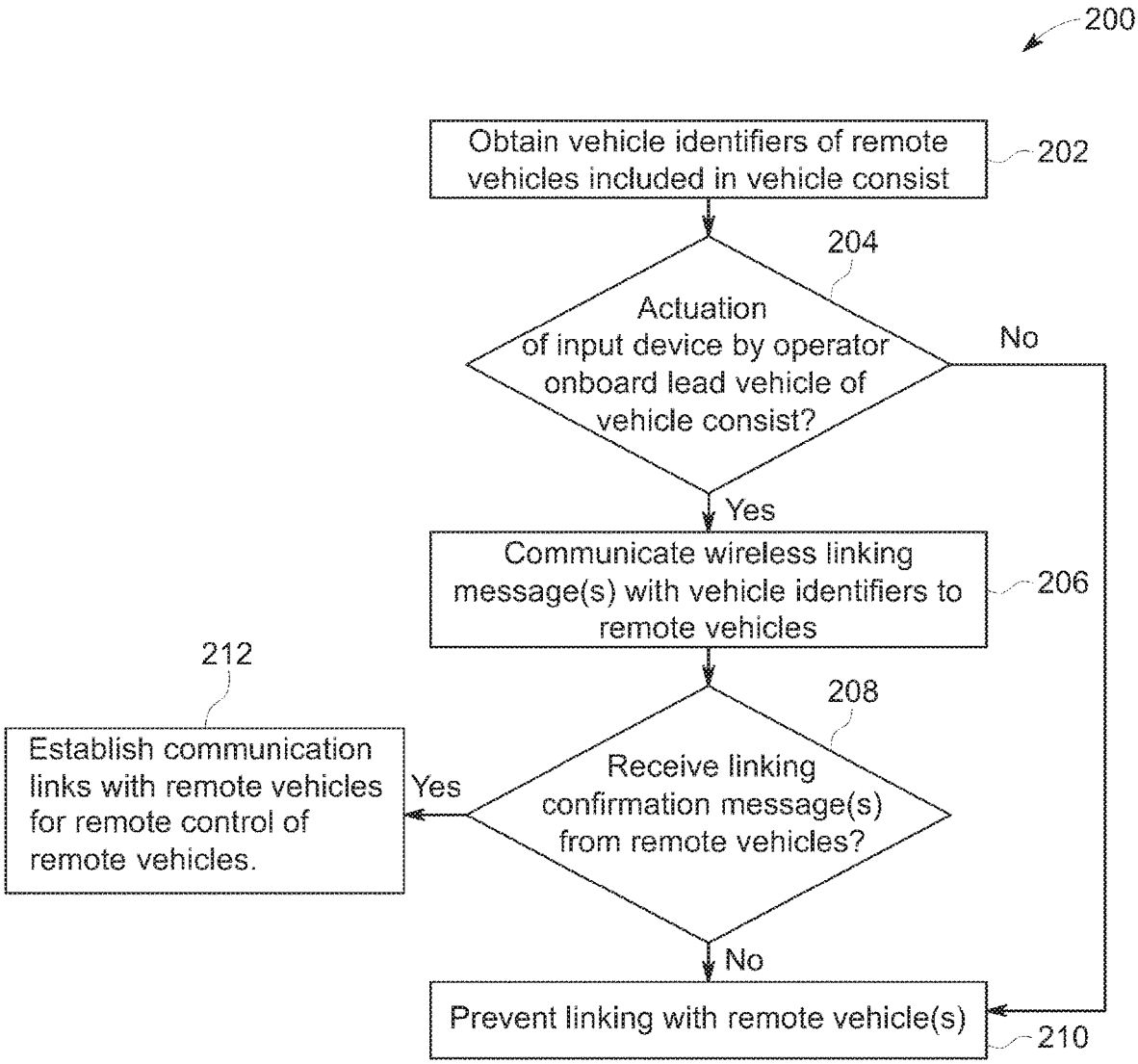
FIG. 2 illustrates a flowchart of one embodiment of a method for communicatively linking vehicles in a vehicle consist.

FIG. 2 illustrates a flowchart of one embodiment of a method 200 for communicatively linking vehicles in a vehicle consist. The method 200 may be performed by communication system 100 shown in FIG. 1. At 202, the vehicle identifiers of remote vehicles included in the vehicle consist are obtained. The vehicle identifiers may be obtained from a system other than the communication system, such as a vehicle control system, energy management system, a dispatch facility, or the like. Optionally, the vehicle identifiers may be input by an operator onboard the controlling vehicle. The vehicle identifiers that are obtained may be unique codes that uniquely identify the remote vehicles included in the vehicle consist, and that do not include vehicles that are not included in the vehicle consist. For example, the vehicles that are included in the vehicle consist may already be mechanically linked and/or otherwise positioned near one another to travel together along the route as a consist. The vehicle identifiers that are obtained may represent those vehicles in the consist, and not any vehicles not included in the consist.

At 204, a determination is made as to whether an input device onboard the controlling vehicle of the vehicle consists has been actuated. For example, a determination may be made as to whether an operator has pressed a button, flip the switch, moved a lever, typed on a keyboard, touched a touch-sensitive display screen, spoken commands into a microphone, or the like. Actuation of an input device may indicate that the operator wishes to initiate establishment of the communication links between the controlling and remote vehicles in the consist. For example, once the vehicle identifiers of the remote vehicles in the consist have been obtained, the operator onboard controlling vehicle can press a single button (or otherwise perform a single actuation of an input device) to initiate the establishment of communication links between the controlling and remote vehicles. Alternatively, the operator may actuate the same input device several times and/or may actuate multiple input devices to cause the linking messages to be sent. If the input device has been actuated, flow of the method 200 can continue to 206. On the other hand, if the input device is not actuated, then flow of the method 200 can proceed to 210, described below.

At 206, linking messages are communicated to the remote vehicles in the consist. These linking messages may be wirelessly communicated from the controlling vehicle to the remote vehicles. Linking messages may be addressed to the remote vehicles. For example, the linking messages may include the vehicle identifiers of the remote vehicles included in the consist. Different linking messages may be communicated to different remote vehicles. For example, a first linking message having a first vehicle identifier may be communicated to a first remote vehicle, a second linking message having a different, second vehicle identifier may be communicated to a different, second remote vehicle, and so on. Optionally, one or more linking messages may include multiple vehicle identifiers. For example, a linking message may be wirelessly communicated from the controlling vehicle and may include the vehicle identifiers of the remote vehicles included in the vehicle consist.

Onboard the remote vehicles, if a linking message is received that includes a vehicle identifier that matches or otherwise corresponds with the remote vehicle receiving the linking message, the remote vehicle may communicate a linking confirmation message back to the controlling vehicle. This confirmation message may be wirelessly communicated to the controlling vehicle to indicate or confirm receipt of the linking message. The linking confirmation messages may be communicated from the remote vehicles to controlling vehicles by an onboard operator action (pressing a button, flipping a switch, moving a lever, typing on a keyboard, touching a touch-sensitive display screen, speaking into a microphone, or the like). Alternatively, the linking confirmation messages may be communicated from the remote vehicles to controlling vehicles without operators having to go onboard the remote vehicles. For example, responsive to a remote vehicle receiving a linking message from the controlling vehicle that includes the vehicle identifier of the remote vehicle, the remote vehicle may autonomously (e.g., without operator intervention) wirelessly communicate the linking confirmation message to controlling vehicle. Alternatively, the remote vehicles may not communicate a linking confirmation message responsive to receiving the linking message.

At 208, a determination is made as to whether a linking confirmation message is received at the controlling vehicle from one or more of the remote vehicles in the vehicle consist. For example, the controlling vehicle may determine if all remote vehicles included in the vehicle consist communicated linking confirmation messages responsive to communicating the linking messages. Receipt of the linking confirmation messages from all remote vehicles at the controlling vehicle can indicate or confirm that the remote vehicles received the linking messages from the controlling vehicle. Failure to receive linking confirmation messages or an absence of linking confirmation messages from all remote vehicles at the controlling vehicle can indicate that one or more remote vehicles did not receive linking messages from the controlling vehicle. In one aspect, the controlling vehicle may re-communicate one or more additional linking messages to the remote vehicles from which the controlling vehicle did not receive a linking confirmation message.

If it is determined that linking confirmation messages were received from all remote vehicles, then flow of the method can proceed to 212. Alternatively, if linking confirmation messages were not received from the remote vehicles, then flow the method 200 can proceed to 210.

At 210, communication linking between the controlling and remote vehicles is prevented. For example, if the remote vehicles did not receive the linking messages, if the controlling vehicle did not receive confirmation of receipt of the linking messages at the remote vehicles, and/or if an operator did not actuate any input device to initiate establishment of communication links between the controlling and remote vehicles, the communication links between the controlling vehicle and one or more remote vehicles may not be established. This can prevent communication links from being established between the controlling and remote vehicles that are not included in the vehicle consist, prevent communication links from being established between the controlling vehicle and remote vehicle that did not receive a linking message, and/or prevent communication links from being established between vehicles in the vehicle consist without the operator initiating formation of the communication links.

At 212, communication links between the controlling vehicle and the remote vehicles are established. These communication links allow for the controlling vehicle to remotely control operations and movement of the remote vehicles. For example, the communication links can allow the controlling vehicle to issue command messages to the remote vehicles. The command messages may direct the remote vehicles to change throttle settings, brake settings, accelerations, speeds, power outputs, or the like. Upon receipt of the command messages, the remote vehicles may implement the changes in operational settings dictated by the command messages.

A communication link may be established by the controlling vehicle identifying which remote vehicles are included in the vehicle consist, communicating linking messages to those remote vehicles, and receiving confirmation that the linking messages are received at the remote vehicles. The failure of the controlling vehicle to determine which remote vehicles are included in the vehicle consist, the failure of the controlling vehicle to communicate linking messages to those remote vehicles, or the failure of controlling vehicle to receive confirmation that linking messages were received at the remote vehicles can prevent communication links from being established between the controlling and remote vehicles. Alternatively, the communication links may be established by the controlling vehicle identifying which remote vehicles are included in the vehicle consist and communicating linking messages to those remote vehicles, regardless of whether confirmation that the linking messages were received remote vehicles is received controlling vehicle. For example, the communication links may be established without the remote vehicles communicating linking confirmation messages and/or without the controlling vehicle receiving linking confirmation messages.

A communication link may be defined by a communication handshake between controlling and remote vehicles. For example, communication of a first message from a controlling vehicle to remote vehicle (e.g., a linking message) followed by successful communication of a second message from the remote vehicle to controlling vehicle (e.g., a linking confirmation message) may be a communication handshake that establishes a communication link. Optionally, the communication link may be established by a dedicated communications channel being used between the controlling and remote vehicles. For example, a designated frequency or frequency band may define a communication link.

Optionally, the communication links between the controlling and remote vehicles may be established without an operator having to go onboard the remote vehicles. As described above, the operator may go onboard the controlling vehicle and, once the controlling vehicle has determined which remote vehicles are included in the vehicle consist, the controlling vehicle may establish communication links with the remote vehicles without the operator or other operators having to go onboard the remote vehicles to communicate information from the remote vehicles to the controlling vehicle. Thus, considerable time and effort may be saved in setting up a vehicle consist for travel. Alternatively, the communication links between the controlling and remote vehicles may only be established when an operator is onboard the remote vehicle.

Figure 3:
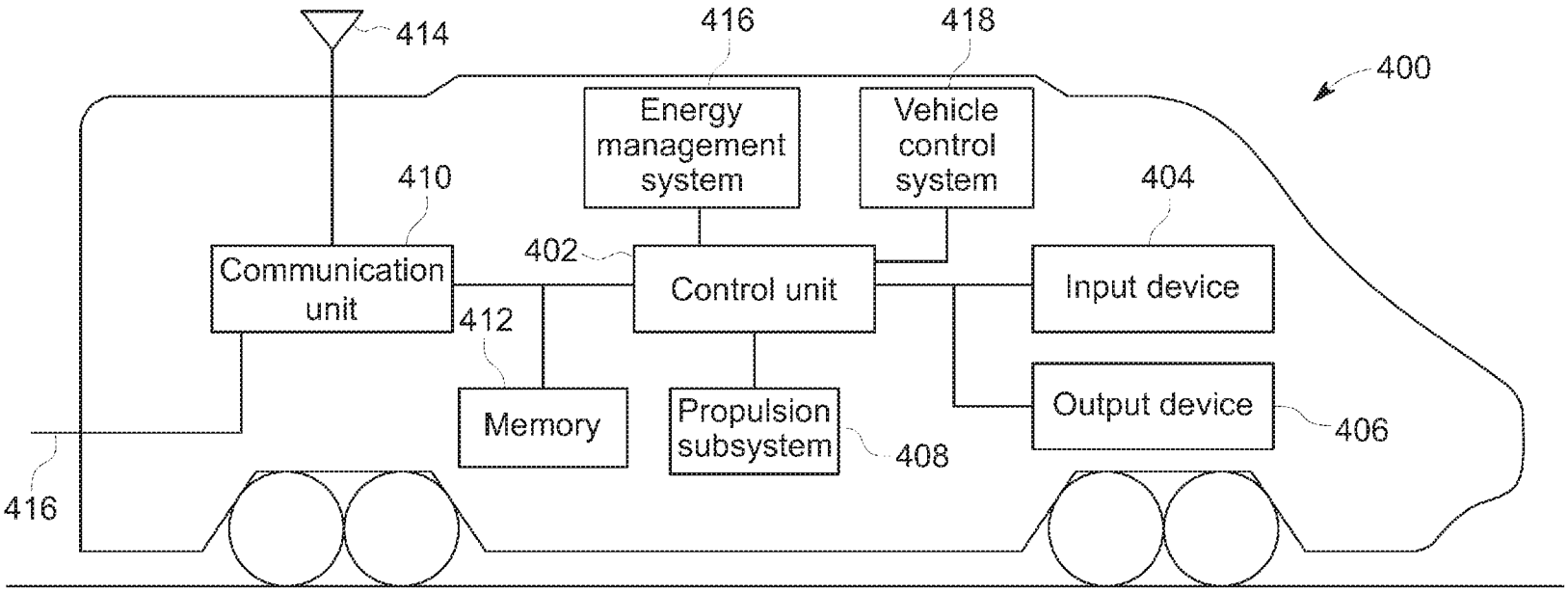
FIG. 3 is a schematic diagram of a propulsion-generating vehicle in accordance with one embodiment.

FIG. 3 is a schematic diagram of a propulsion-generating vehicle 400 in accordance with one embodiment. The vehicle 400 may represent one or more of the vehicles 104, 106 shown in FIG. 1. The communication system 100 shown in FIG. 1 may include one or more components onboard the vehicle 400 that are used to establish communication links between the vehicle 400 and one or more other vehicles in the same vehicle consist.

The vehicle 400 includes a control unit 402 that controls operations of the vehicle 400. The control unit 402 can include or represent one or more hardware circuits or circuitry that include, are connected with, or that both include and are connected with one or more processors, controllers, or other hardware logic-based devices. The control unit 402 is connected with an input device 404 and an output device 406. The control unit 402 can receive manual input from an operator of the propulsion-generating vehicle 400 through the input device 404, such as a touchscreen, keyboard, electronic mouse, microphone, or the like. For example, the control unit 402 can receive manually input changes to the tractive effort, braking effort, speed, power output, and the like, from the input device 404. The control unit 402 may receive a single instance of an actuation of the input device 404 to initiate the establishment of communication links between controlling and remote vehicles in the vehicle consist. For example, instead of having one or more operators go onboard controlling and remote vehicles of a consist to establish communication links for the remote control of the remote vehicles by the controlling vehicles, an operator may go onboard the controlling vehicle and press a single button or other input device to cause the controlling vehicle to communicate linking messages to the remote vehicles to establish the communication links.

The control unit 402 can present information to the operator using the output device 406, which can represent a display screen (e.g., touchscreen or other screen), speakers, printer, or the like. For example, the control unit 402 can present the identities and statuses of the remote vehicles 106, identities of the missing remote vehicles 106 (e.g., those remote vehicles 106 from which the controlling vehicle 104 has not received the status), contents of one or more command messages, or the like.

The control unit 402 is connected with a propulsion subsystem 408 of the propulsion-generating vehicle 400. The propulsion subsystem 408 provides tractive effort and/or braking effort of the propulsion-generating vehicle 400. The propulsion subsystem 408 may include or represent one or more engines, motors, alternators, generators, brakes, batteries, turbines, and the like, that operate to propel the propulsion-generating vehicle 400 under the manual or autonomous control that is implemented by the control unit 402. For example, the control unit 402 can generate control signals autonomously or based on manual input that is used to direct operations of the propulsion subsystem 408.

The control unit 402 also is connected with a communication unit 410 and a memory 412 of the communication system in the propulsion-generating vehicle 400. The memory 412 can represent an onboard device that electronically and/or magnetically stores data. For example, the memory 412 may represent a computer hard drive, random access memory, read-only memory, dynamic random access memory, an optical drive, or the like. The communication unit 410 includes or represents hardware and/or software that is used to communicate with other vehicles 400 in the vehicle consist 102. For example, the communication unit 410 may include a transceiver and associated circuitry (e.g., antennas) 414 for wirelessly communicating (e.g., communicating and/or receiving) linking messages, command messages, linking confirmation messages, reply messages, retry messages, repeat messages, or the like. Optionally, the communication unit 410 includes circuitry for communicating the messages over a wired connection 416, such as an electric multiple unit (eMU) line of the vehicle consist 102, catenary or third rail of electrically powered vehicle, or another conductive pathway between or among the propulsion-generating vehicles 104, 106, 400 in the vehicle consist 102. The control unit 402 may control the communication unit 410 by activating the communication unit 410. The communication unit 410 can examine the messages that are received by the vehicle 400. For example, the communication unit 410 of a remote vehicle 106 can examine received command messages to determine the directive sent by the controlling vehicle 104. The directive can be conveyed to the control unit 402, which then implements the directive by creating control signals that are communicated to the propulsion subsystem 408 for autonomous control or by presenting the directive to the operator on the output device 406 for manual implementation of the directive.

The memory 412 can store vehicle identifiers. In the controlling vehicle 104, the memory 412 can store the vehicle identifiers of the remote vehicles 106 in the same consist as the controlling vehicle 104. In the remote vehicles 106, the memory 412 can store the vehicle identifier of the remote vehicle 106 in which the memory 412 is located (e.g., to allow the remote vehicle 106 to communicate the vehicle identifier), the vehicle identifier of the controlling vehicle 104 (e.g., to allow the remote vehicle 106 to verify that received messages are sent from the controlling vehicle 104 in the same consist), and/or other information.

The control unit 402 can obtain the vehicle identifiers from another system, such as a vehicle control system 418, an energy management system 416, or another system. The vehicle control system 418 shown in FIG. 3 can include hardware circuits or circuitry that include and/or are connected with one or more processors. The vehicle control system 418 can control or limit movement of the vehicle 400 and/or the vehicle consist that includes the vehicle 400 based on one or more limitations. For example, the vehicle control system 418 can prevent the vehicle and/or vehicle consist from entering a restricted area, can prevent the vehicle and/or vehicle consist from exiting a designated area, can prevent the vehicle and/or vehicle consist from traveling at a speed that exceeds an upper speed limit, can prevent the vehicle and/or vehicle consist from traveling at a speed that is less than a lower speed limit, or the like. In one embodiment, the vehicle control system 418 includes or represents a positive train control system. The vehicle control system 418 may be programmed or otherwise have access to the vehicle identifiers of the vehicles included in the vehicle consist that includes the vehicle 400. For example, the vehicle control system 418 may store right access to the vehicle identifiers so that the vehicle control system 418 can determine how to control or limit control of the vehicle 400 and/or the vehicle consist that includes the vehicle 400 to prevent the vehicle 400 and/or vehicle consist from violating one or more of the limits.

The energy management system 416 can include hardware circuits or circuitry that include and and/or are connected with one or more processors. The energy management system 416 can create a trip plans for trips of the vehicle 400 and/or the vehicle consist that includes the vehicle 400. As described above, a trip plan may designate operational settings of the vehicle 400 and/or the vehicle consist as a function of time, location, and/or distance along a route for a trip. Traveling according to the operational settings designated by the trip plan can reduce fuel consumed and/or emissions generated by the vehicle 400 and/or the vehicle consist relative to the vehicle 400 and/or vehicle consist traveling according to other operational settings that are not designated by the trip plan. The energy management system 416 may be programmed with or otherwise have access to the vehicle identifiers of the vehicles included in the vehicle consist. The identities of the vehicles in the consists may be known to energy management system 416 so that the energy management system 416 can determine what operational settings to designate for a trip plan to achieve a goal of reducing fuel consumed and/or emissions generated by the consists during the trip.

One or more of the vehicle control system 418, the energy management system 416, or another system may communicate or otherwise provide the vehicle identifiers to the control unit 402 and/or the communication unit 410. As described above, the communication unit 410 and/or the control unit 402 may communicate wireless linking messages that are addressed to the remote vehicles in the consist using the vehicle identifiers obtained from one or more of the systems.

Figure 4:
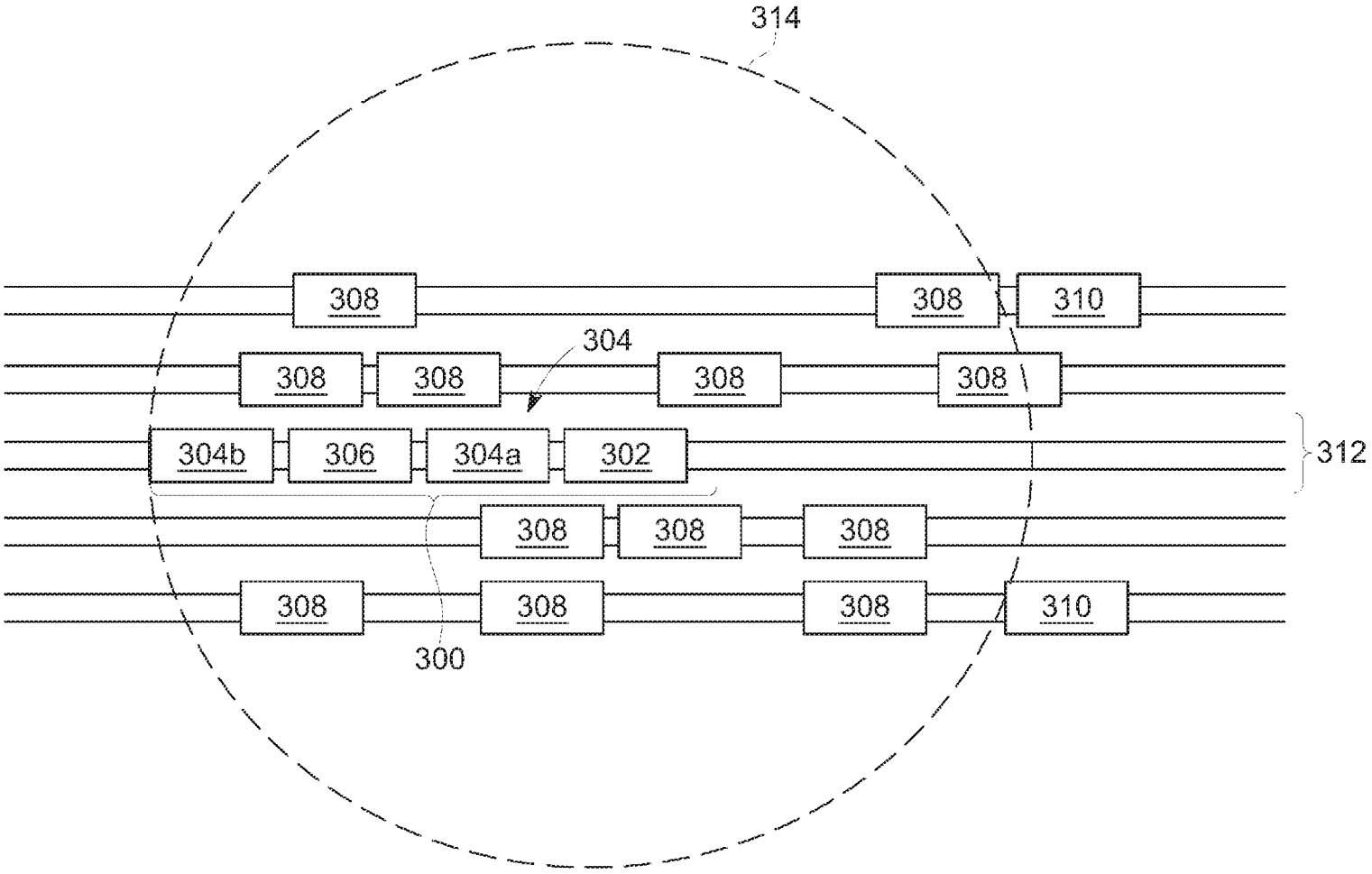
FIG. 4 illustrates several vehicles located on neighboring routes according to one example.

FIG. 4 illustrates several vehicles 302, 304 (e.g., 304A, 304B), 306, 308, 310 located on neighboring routes 312 according to one example. The vehicles 302, 304, 306, 308, 310 can represent one or more of the vehicles 104, 106, 108, 400 shown in FIGS. 1 and 3. The routes 312 may be relatively close to one another, such as within five, ten, fifteen, twenty, twenty-five meters or another distance apart. For example, the routes 312 may be neighboring tracks in a vehicle yard, such as a rail yard. Alternatively, the routes may be another type of route and/or another location.

The vehicles 302, 304, 306 may be grouped together in the vehicle consist 300. For example, the vehicle 302 may represent the controlling vehicle 104 shown in FIG. 1, the vehicles 304A, 304B may represent remote vehicles 106 shown in FIG. 1, and the vehicle 306 may represent a non-propulsion-generating vehicle 108 shown in FIG. 1. Other vehicles 308, 310 shown in FIG. 4 are not included in the vehicle consist 300. For example, vehicles 308, 310 are not grouped with the vehicles 302, 304, 306 to travel with the vehicles 302, 304, 306 along a route 312. Instead, the vehicles 308, 310 may be included in another vehicle consist or may not be included in any vehicle consist.

The communication unit 410 (shown in FIG. 3) of the controlling vehicle 302 may have a wireless communication range 314. The range 314 indicates how far wireless messages sent from the communication unit 410 of the controlling vehicle 302 may be successfully communicated to another vehicle. In the illustrated example, the vehicles 304, 306, 308 are within the wireless range 314 controlling vehicle 302, while the vehicles 310 are outside of the wireless range 314 the controlling vehicle 302. Thus, wireless messages (such as wireless linking messages) communicated from the controlling vehicle 302 may be received by the vehicles 304, 306, 308, but not received by the vehicles 310.

Communicating the wireless linking messages from the controlling vehicle 302 with the vehicle identifiers of the remote vehicles 304A, 304B can prevent establishment of communication links with the vehicles 308 that are within the wireless range 314 of the controlling vehicle 302, but that are not included in the vehicle consist 300 of the controlling vehicle 302. For example, one or more of the vehicles 308 may receive a wireless linking message the controlling vehicle 302. These vehicles 308 can examine the vehicle identifier or vehicle identifiers included in the wireless linking message to determine if the vehicle identifier or identifiers in the wireless linking message matches the vehicle identifier associated with the vehicle 308. Because the vehicle identifiers in the wireless linking messages do not match or otherwise correspond with the vehicles 308, the vehicles 308 may determine that the wireless linking messages are not addressed to the vehicles 308. Thus, the vehicles 308 do not establish a communication link with the controlling vehicle and/or do not respond to the wireless linking message with a linking confirmation message sent back to controlling vehicle 302. Because the vehicle identifiers included in the linking message do match or otherwise correspond with the remote vehicles 304A, 304B, these vehicles 304A, 304B do establish communication link with the controlling vehicle 302 and/or establish the communication links by responding with a linking confirmation message.

In one embodiment, a method (e.g., for communicatively linking vehicles in a vehicle consist) includes determining a vehicle identifier for a first remote vehicle included in a vehicle consist formed from a controlling vehicle and at least the first remote vehicle, communicating a wireless linking message addressed to the vehicle identifier from the controlling vehicle to the first remote vehicle, and establishing a communication link between the controlling vehicle and the first remote vehicle responsive to receipt of the wireless linking message at the first remote vehicle. The communication link can be established such that movement of the first remote vehicle is remotely controlled from the controlling vehicle via the communication link. The communication link can be established without an operator entering the first remote vehicle.

In one aspect, establishing the communication link can include receiving a wireless linking confirmation message from the first remote vehicle at the controlling vehicle responsive to the wireless linking message being received at the first remote vehicle.

In one aspect, determining the vehicle identifier can include receiving a list of one or more unique identifying codes associated with at least the first remote vehicle from a vehicle control system that restricts movement of the vehicle consist based at least in part on a location of the vehicle consist.

In one aspect, the vehicle control system can include a positive train control system.

In one aspect, determining the vehicle identifier can include receiving a list of one or more unique identifying codes associated with at least the first remote vehicle from an energy management system that creates a trip plan to control movement of the vehicle consist. The trip plan can designate operational settings of the vehicle consist as a function of one or more of time, location, or distance along a route.

In one aspect, the vehicle consist includes the controlling vehicle, the first remote vehicle, and at least a second remote vehicle. Determining the vehicle identifier can include determining a first unique vehicle identifier for the first remote vehicle and at least a second unique vehicle identifier for at least the second remote vehicle. Communicating the wireless linking message can include communicating a first wireless linking message to the first remote vehicle and communicating at least a second wireless linking message to at least the second remote vehicle. Establishing the communication link can include establishing a first communication link between the controlling vehicle and the first remote vehicle and at least a second communication link between the controlling vehicle and at least the second remote vehicle.

In one aspect, the method also can include detecting a single instance of an operator actuating an input device onboard the controlling vehicle and communicating the first wireless linking message and the at least the second wireless linking message responsive to detecting the single instance of the operator actuating the input device.

In one aspect, communicating the wireless linking message can include broadcasting the wireless linking message such that the first remote vehicle receives the wireless linking message and at least one other remote vehicle that is located within a wireless communication range of the controlling vehicle but that is not included in the vehicle consist receives the wireless linking message. Establishing the communication link between the controlling vehicle and the first remote vehicle can include preventing the at least one other remote vehicle from establishing a communication link with the controlling vehicle based at least in part on the vehicle identifier.

In another embodiment, a system (e.g., a communication system) includes a control unit and a communication unit. The control unit can be configured to determine a vehicle identifier for a first remote vehicle included in a vehicle consist formed from a controlling vehicle and at least the first remote vehicle. The communication unit can be configured to communicate a wireless linking message addressed to the vehicle identifier from the controlling vehicle to the first remote vehicle. The communication unit also can be configured to establish a communication link between the controlling vehicle and the first remote vehicle responsive to receipt of the wireless linking message at the first remote vehicle. The control unit can be configured to remotely control movement of the first remote vehicle from the controlling vehicle via the communication link. The communication link can be established without an operator entering the first remote vehicle.

In one aspect, the communication unit can be configured to receive a wireless linking confirmation message from the first remote vehicle at the controlling vehicle responsive to the wireless linking message being received at the first remote vehicle.

In one aspect, the control unit can be configured to determine the vehicle identifier by receiving a list of one or more unique identifying codes associated with at least the first remote vehicle from a vehicle control system that restricts movement of the vehicle consist based at least in part on a location of the vehicle consist.

In one aspect, the vehicle control system can include a positive train control system.

In one aspect, the control unit can be configured to determine the vehicle identifier by receiving a list of one or more unique identifying codes associated with at least the first remote vehicle from an energy management system that creates a trip plan to control movement of the vehicle consist. The trip plan can designate operational settings of the vehicle consist as a function of one or more of time, location, or distance along a route.

In one aspect, the vehicle consist can include the controlling vehicle, the first remote vehicle, and at least a second remote vehicle. The control unit can be configured to determine the vehicle identifier by determining a first unique vehicle identifier for the first remote vehicle and at least a second unique vehicle identifier for at least the second remote vehicle. The communication unit can be configured to communicate the wireless linking message by communicating a first wireless linking message to the first remote vehicle and communicating at least a second wireless linking message to at least the second remote vehicle. The communication unit also can be configured to establish the communication link by establishing a first communication link between the controlling vehicle and the first remote vehicle and at least a second communication link between the controlling vehicle and at least the second remote vehicle.

In one aspect, the control unit can be configured to detect a single instance of an operator actuating an input device onboard the controlling vehicle and the communication unit can be configured to communicate the first wireless linking message and the at least the second wireless linking message responsive to the control unit detecting the single instance of the operator actuating the input device.

In one aspect, the communication unit can be configured to communicate the wireless linking message by broadcasting the wireless linking message such that the first remote vehicle receives the wireless linking message and at least one other remote vehicle that is located within a wireless communication range of the communication unit but that is not included in the vehicle consist receives the wireless linking message. The communication unit can be configured to prevent the at least one other remote vehicle from establishing a communication link with the controlling vehicle based at least in part on the vehicle identifier.

In another embodiment, a method (e.g., for communicatively linking vehicles in a vehicle consist) includes receiving unique vehicle identifiers of remote vehicles included in a vehicle consist with a controlling vehicle, communicating linking messages with the unique vehicle identifiers to the remote vehicles, and responsive to the unique vehicle identifiers in the linking messages matching the remote vehicles in the vehicle consist, establishing one or more communication links between the controlling vehicle and the remote vehicles to permit the controlling vehicle to remotely control movement of the remote vehicles included in the vehicle consist. The one or more communication links are established without an operator being onboard the remote vehicles to communicate responsive messages from the remote vehicles to the controlling vehicle.

In one aspect, establishing the one or more communication links can include receiving one or more linking confirmation messages from the remote vehicles at the controlling vehicle responsive to the linking messages being received at the remote vehicles without the operator being onboard the remote vehicles.

In one aspect, determining the vehicle identifiers can include receiving a list of one or more unique identifying codes associated with the remote vehicles from one or more of a vehicle control system that restricts movement of the vehicle consist based at least in part on a location of the vehicle consist and/or an energy management system that creates a trip plan to control movement of the vehicle consist. The trip plan can designate operational settings of the vehicle consist as a function of one or more of time, location, or distance along a route.

In one aspect, the method also can include detecting a single instance of an operator actuating an input device onboard the controlling vehicle and communicating the linking messages occurs responsive to detecting the single instance of the operator actuating the input device.

In another embodiment, a method (e.g., for communicatively linking vehicles in a vehicle consist) includes determining a first unique vehicle identifier for a first remote vehicle and a second unique vehicle identifier for a second remote vehicle included in a vehicle consist formed from a controlling vehicle, the first remote vehicle, and the second remote vehicle, detecting a single instance of an operator actuating an input device onboard the controlling vehicle, communicating from the controlling vehicle a first wireless linking message addressed to the first unique vehicle identifier to the first remote vehicle and communicating a second wireless linking message addressed to the second unique vehicle identifier to the second remote vehicle responsive to detecting the single instance of the operator actuating the input device, establishing a first communication link between the controlling vehicle and the first remote vehicle responsive to receipt of the first wireless linking message at the first remote vehicle and a second communication link between the controlling vehicle and the second remote vehicle responsive to receipt of the second wireless linking message at the second remote vehicle (where the communication link is established without an operator entering the first remote vehicle or the second remote vehicle), and remotely controlling movement of the first remote vehicle and the second remote vehicle from the controlling vehicle via the first communication link and the second communication link, respectively. Communicating the wireless linking message can include broadcasting the first wireless linking message and the second wireless linking message such that the first remote vehicle receives the first wireless linking message and the second remote vehicle receives the second wireless linking message and at least one other remote vehicle that is located within a wireless communication range of the controlling vehicle but that is not included in the vehicle consist receives at least one of the first wireless linking message or the second wireless linking message. Establishing the first communication link between the controlling vehicle and the first remote vehicle and the second communication link between the controlling vehicle and the second remote vehicle can include preventing the at least one other remote vehicle from establishing a communication link with the controlling vehicle based at least in part on the first unique vehicle identifier or the second unique vehicle identifier.

Additional embodiments of the inventive subject matter are directed toward a system, method, and a computer software code for remotely establishing distributed power operations of a vehicle consist, such as a train. For example, one embodiment relates to a system for establishing distributed power operations of a vehicle consist (e.g., such as, but not limited to, a locomotive consist) from a single location in the vehicle consist. The vehicle consist may have a controlling propulsion unit (e.g., such as, but not limited to, a locomotive) and/or a remote propulsion unit, with a distributed power system on each propulsion unit. The system includes a communication network providing communications within the vehicle consist, and at least one distributed power setup unit in communication with the propulsion units by way of the communication network. The distributed power setup unit has a processor, display, and/or an input device to allow a user to establish distributed power operations, or the setup unit may work autonomously. In one embodiment, a method (e.g., for controllably linking propulsion units, or propulsion units, in a vehicle consist) includes transmitting a linking signal from a first controlling propulsion unit of a vehicle consist to a remote propulsion unit of the vehicle consist. The linking signal includes a first identity of the first controlling propulsion unit. The remote propulsion unit and the first controlling propulsion unit are controllably linked with each other when the first identity of the first controlling propulsion unit in the linking signal corresponds to a designated identity that is stored onboard the remote propulsion unit. The remote propulsion unit allows the first controlling propulsion unit to remotely control operations of the remote propulsion unit when the first controlling propulsion unit and the remote propulsion unit are controllably linked. The method also includes transmitting an unlinking signal from the first controlling propulsion unit to the remote propulsion unit when the first controlling propulsion unit is to be mechanically decoupled from the vehicle consist. The unlinking signal includes a replacement identity of a propulsion unit other than the first controlling propulsion unit that is to be mechanically coupled to the vehicle consist to replace the first controlling propulsion unit. The method further includes transmitting a replacement linking signal from a second controlling propulsion unit to the remote propulsion unit. The replacement linking signal includes a second identity of the second controlling propulsion unit. The remote propulsion unit and the second controlling propulsion unit are controllably linked when the second identity of the second controlling propulsion unit corresponds to the replacement identity received at the remote propulsion unit. The remote propulsion unit allows the second controlling propulsion unit to remotely control the operations of the remote propulsion unit when the second controlling propulsion unit and the remote propulsion unit are controllably linked.

At least one technical effect of the inventive subject matter provides for a method, system, and computer software code for re-sorting or re-assembling (automatically or at least partially manually) a vehicle system, wherein a decoupled remote vehicle is permitted to operate independently from the controlling vehicle but then at least partially reverts back to a prior dependent relationship with the controlling vehicle when subsequently re-coupled to the vehicle system. At least one other technical effect of the inventive subject matter provides for a method, system, and computer software code that enables a decoupled remote vehicle to operate independently from the controlling vehicle. After operating independently, the remote vehicle may be re-coupled to the controlling vehicle (and other vehicles of the vehicle system) and re-establish a dependent relationship with respect to the controlling vehicle.

At least one technical effect of the inventive subject matter provides for a method, system, and computer software code for automated set-up of a vehicle system, such as a distributed power train or another vehicle consist. To facilitate an understanding of the embodiments of the inventive subject matter, it is described hereinafter with reference to specific implementations thereof. Embodiments of the inventive subject matter may use program modules that may include routines, programs, objects, components, data structures, etc. that perform particular tasks or implement particular abstract data types. For example, the software programs that underlie embodiments of the inventive subject matter may be coded in different languages for use with different platforms.

Though one or more embodiments of the inventive subject matter are disclosed below as operating with hand-held devices, other embodiments may be practiced with other computer system configurations, including multiprocessor systems, microprocessor-based or programmable consumer electronics, minicomputers, mainframe computers, and the like. Embodiments of the inventive subject matter may also be practiced in distributed computing environments where tasks are performed by remote processing devices that are linked through a communications network. In a distributed computing environment, program modules may be in both local and remote computer storage media including memory storage devices. These local and remote computing environments may be contained entirely within the locomotive, or adjacent locomotives in consist, or off-board in wayside or central offices where wireless communication is used.

Throughout this document the term vehicle consist is used. A vehicle consist is a group of two or more vehicles that are mechanically coupled to travel together along a route. A vehicle consist may have one or more propulsion-generating units (e.g., vehicles capable of generating propulsive force, which also are referred to as propulsion units) in succession and connected to provide motoring and/or braking capability for the vehicle consist. The propulsion units may be connected with no other vehicles or cars between the propulsion units. One example of a vehicle consist is a locomotive consist that includes locomotives as the propulsion units. Other vehicles may be used instead of or in addition to locomotives to form the vehicle consist. A vehicle consist can also include non-propulsion units, such as where two or more propulsion units are connected with each other by a non-propulsion unit, such as a rail car, passenger car, or other vehicle that cannot generate propulsive force to propel the vehicle consist. A larger vehicle consist, such as a train, can have sub-consists. Specifically, there can be a controlling consist (of propulsion units), and one or more remote consists (of propulsion units), such as midway in a line of cars and another remote consist at the end of the train. The vehicle consist may have a controlling propulsion unit and a trail or remote propulsion unit. The terms "controlling," "lead," "command," "remote," and "trailing" are used to indicate which of the propulsion units control operations of other propulsion units, and which propulsion units are controlled by other propulsion units, regardless of locations within the vehicle consist. For example, a controlling propulsion unit can control the operations of the trail or remote propulsion units, even though the controlling propulsion unit may or may not be disposed at a front or leading end of the vehicle consist along a direction of travel. A vehicle consist can be configured for distributed power operation, wherein throttle and braking commands are relayed from the controlling propulsion unit to the remote propulsion units by a radio link or physical cable. Toward this end, the term vehicle consist should be not be considered a limiting factor when describing multiple propulsion units within the same vehicle consist.

Figure 5:
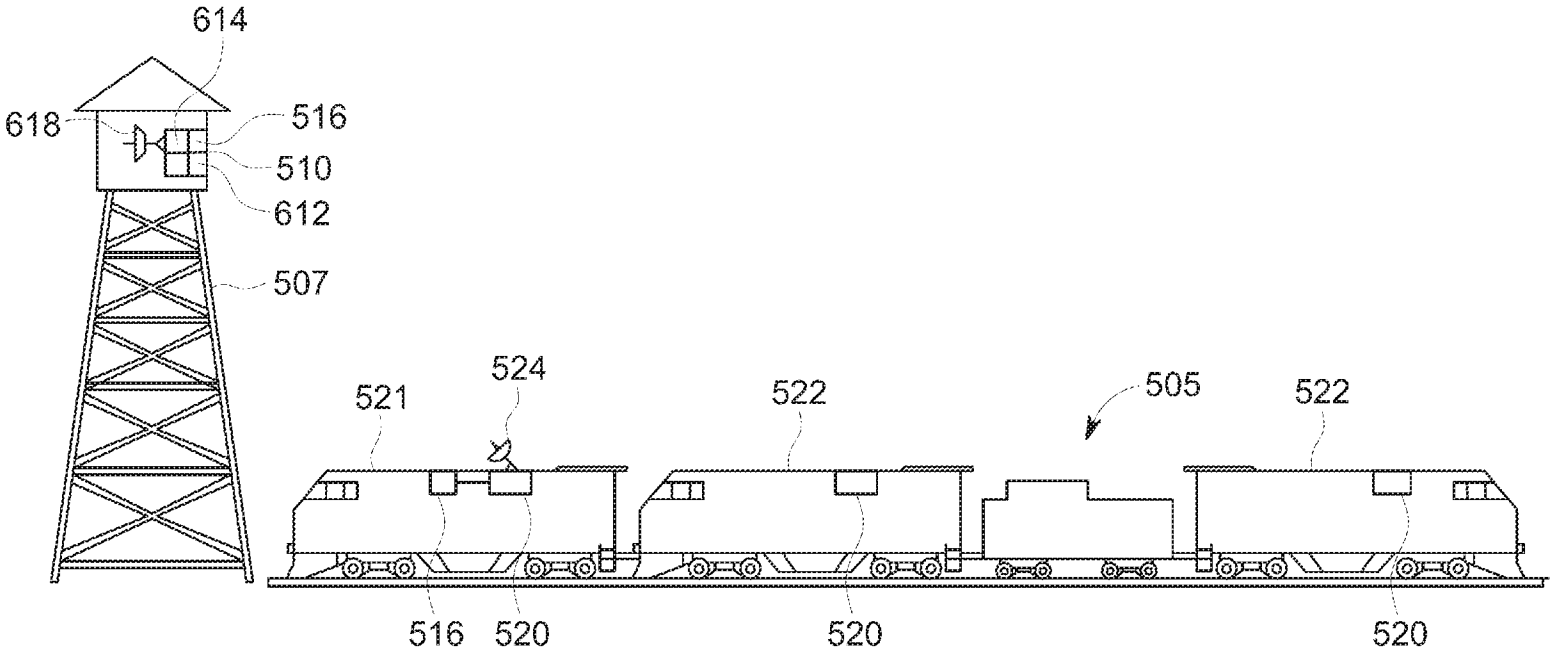
FIG. 5 depicts an embodiment of a system for remotely setting up, linking, and testing distributed power operations of a vehicle system, such as a vehicle consist.

FIG. 5 depicts an embodiment of a system for remotely setting up, linking, and testing operations of a vehicle consist. In one embodiment, the system may set up, link, and/or test distributed power operations of a vehicle consist such as a train. At a location, or remote location, such as away from a vehicle consist or system 505, such as in a tower 507, a setup unit 510 is provided for an operator to use. The setup unit 510 can be a unit that sets up the vehicle consist 505 for distributed power operations or for other operations. In another embodiment, an operator aboard a vehicle consist, such as located in a controlling propulsion unit 521 of the vehicle consist 505, may use the setup unit 510 to remotely setup remote propulsion units 522 in the vehicle consist 5 for operations, such as distributed power operations. While the propulsion units 521, 522 may be referred to as controlling and remote locomotives, respectively, alternatively the units 521, 522 may represent other vehicles capable of generating propulsive force to propel the vehicle consist 505.

Figure 6:
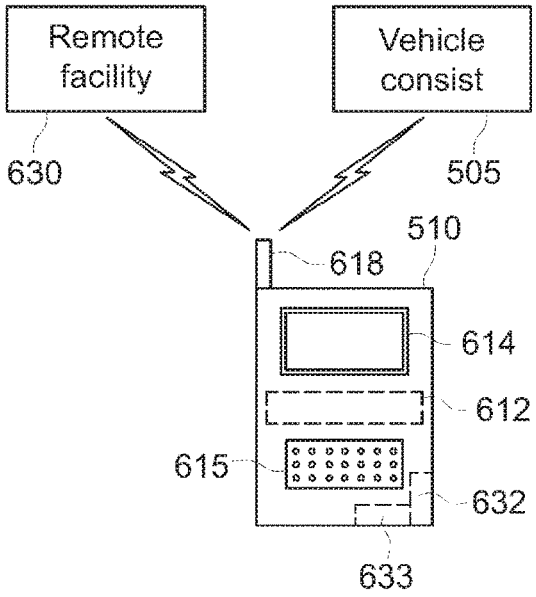
FIG. 6 depicts an embodiment of a setup unit.

FIG. 6 depicts an embodiment of a setup unit. The setup unit 510 has one or more computers or processors 612 with a display 614 and operator input device 615, such as but not limited to a mouse and/or a keyboard. As disclosed herein, the setup unit 510 may be a hand-held device. A first communication interface 618 is also connected to the setup unit 510. As further illustrated in FIG. 5, the first communication interface 618 can communicate with a distributed power system 520 on the propulsion units 521, 522. In other embodiments, the setup unit 510 is not a handheld device and, for example, may be a single standalone off-the-shelf computer or large workstation.

At the vehicle consist 505, a second communication interface 524 is provided to receive and send communications between the second communication interface 524 and the first communication interface 618 at the setup unit 510. The first communication interface 618 at the setup unit 510 is in communication with the distributed power system 520 so that the setup unit 510 can receive information from the distributed power system 520 and send commands to the distributed power system 520. Examples of the distributed power system include, but are not limited to Assignee's LOCOTROL® Locomotive System Integration (LSI) Electronics, or System, and/or other systems/equipment that functions with the LSI system.

In an example use of the inventive subject matter, an operator may use the setup unit 510 to input such information as, but not limited to, road numbers of the controlling propulsion unit 521 and all remote propulsion units 522 within the vehicle consist 505 to be linked (or other identifying information), the orientation of each propulsion unit 521, 522 within the vehicle consist 505 (e.g., whether the short hood or long hood of the respective propulsion unit 521, 522 is forward), and the like. By doing so, the propulsion units will know which direction is forward since each of the propulsion units 521, 522 may have either its respective short hood or long hood facing the direction that the vehicle consist 505 will move.

The setup unit 510 may transmit this information to each distributed power generating unit 521, 522 in the vehicle consist 505, or to the controlling propulsion unit 521, which in turn can communicate with the remote propulsion units 522. In one embodiment, the on-board distributed system 520 only accepts such data when the propulsion units 521, 522 are not already linked. In another embodiment, the operator may override a prior link of the propulsion units 521, 522 with new information.

The on-board distributed system 520 may accept the data and proceed with linking the propulsion units 521, 522. The linking process could continue through completion of a test that confirms proper linking of the locomotives. The complete linking process could be completed without human intervention aboard any of the propulsion units 521, 522 and prior to operators physically entering the vehicle consist 505.

For example, with the LOCOTROL® LSI system, in an embodiment, information that may be provided on a display of the LSI system is also provided on a display on the setup unit 510. Based on how the LSI system functions, the remote propulsion units 521, 522 in a vehicle consist 505 are set up first. The controlling propulsion unit 521 of the vehicle consist 505 is only set after all setups for the remote propulsion units 522 are completed. The distributed power operations can also be shutdown using an embodiment of the inventive subject matter. As described in more detail below with respect to FIG. 7, the controlling propulsion unit 521 may report a status back to the setup unit 510, either confirming the linking process was successful or reporting a failure and identifying what step in the process detected the failure along with any information, or data, as to what could have caused the failure.

As further illustrated in FIG. 6, the setup unit may be accessible by other remote locations 630, such as a dispatch location and/or a repair depot. This remote location will know when the vehicle consist 505 is properly linked. If the linking process is not completed due to a failure, this information can also be forwarded.

In an embodiment, connections between the setup unit 510 and the distributed power system 520 may be via radio and/or any other form of wireless communication. In another embodiment, communication may take place via a wired connection. Communications between the setup unit 510 and the remote facility 507 may be via wireless communications and/or wired communications. For example, communications may occur using the Internet where dial-in-connections, cable modems, special high-speed IDSN lines, networks such as local area networks, wide area networks, etc. may be utilized. Furthermore, when the setup unit 510 is used aboard the vehicle consist 505, such aboard the controlling propulsion unit 521, the unit 510 may be directly interfaced into the distributed power system 520 aboard the controlling propulsion unit 521.

In addition to the parts of the setup unit 510 disclosed above, the setup unit 510 may also have a mass storage device 632 and memory 633. The setup unit 510 may store information regarding linking processes that are completed so that data about prior linking processes may be later communicated to a remote facility.

Figure 7:
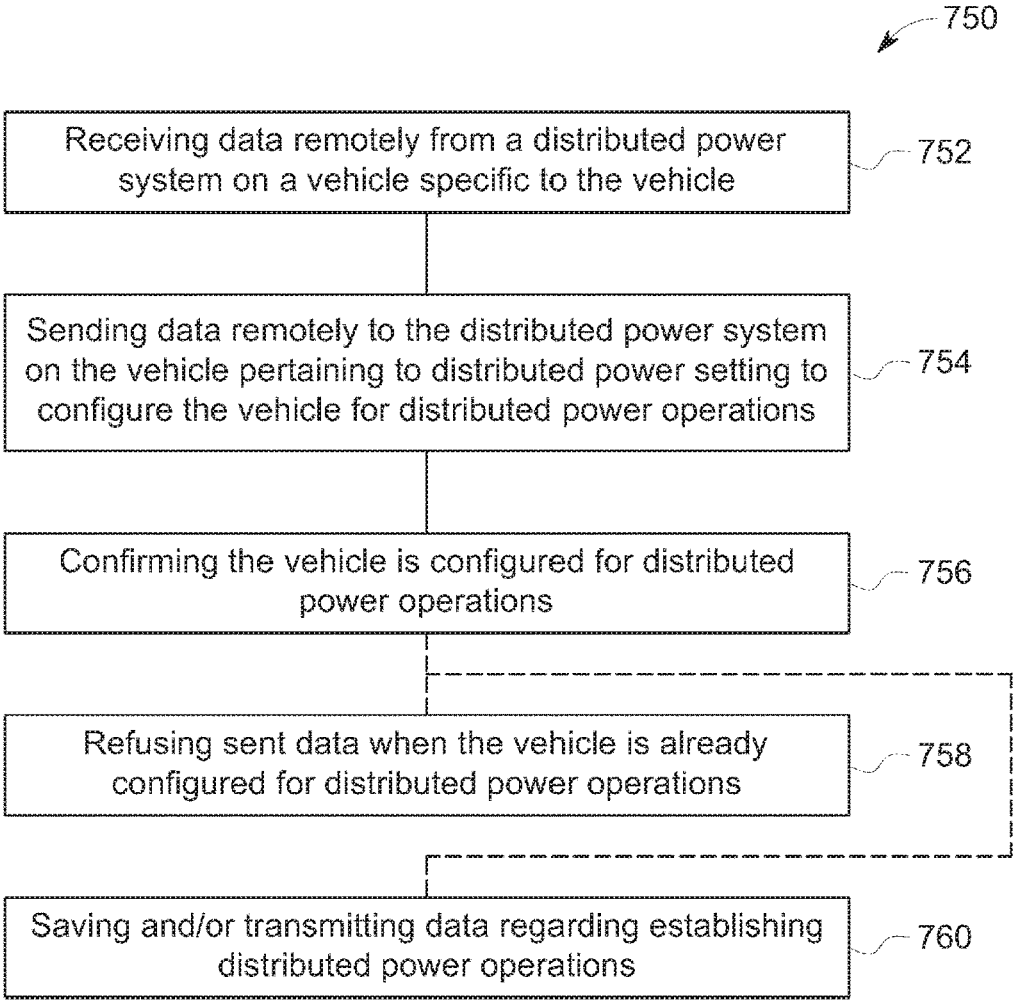
FIG. 7 depicts an embodiment of a flowchart of a method for remotely setting up, linking and testing distributed power operations of a vehicle consist.

FIG. 7 depicts a flowchart of a method for remotely setting up, linking, and testing operations of a vehicle consist. As described above and illustrated in the flowchart 750, the method includes receiving data remotely from a distributed power system on a propulsion unit, at 752. This data may be specific to the propulsion unit that receives the data. The data is sent remotely to the distributed power system on the propulsion unit pertaining to distributed power settings in order to configure the propulsion unit for distributed power operations, at 754. A confirmation is made as to whether the propulsion unit is configured for distributed power operations, at 756. As described above, if the propulsion unit 521, 522 is already configured for distributed power operations, the method may refuse the sent data, at 758. Additionally, data may be saved and/or transmitted regarding the establishment, or inability to establish, distributed power operations, at 760. As described above, the data may be sent back to the setup unit 510. If a failure occurs the data may include, but is not limited to, what step in the process detected the failure including data as to what could have caused the failure.

Figure 8:
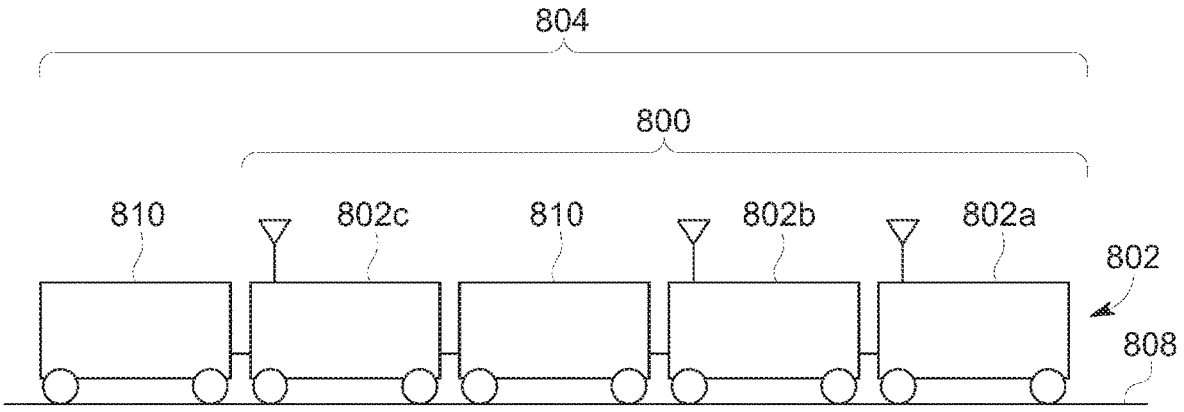
FIG. 8 is a schematic illustration of another embodiment of a communication system for controllably linking propulsion units in a vehicle consist.

FIG. 8 is a schematic illustration of another embodiment of a system 800 (e.g., a communication system) for controllably linking propulsion units 802 in a vehicle consist or system 804. The vehicle consist includes one or more propulsion units 802 (e.g., vehicles that generate propulsive force to propel the vehicle consist 804). In the illustrated embodiment, the vehicle consist includes three propulsion units 802A, 802B, 802C, but alternatively may include two propulsion units or more than three propulsion units. The vehicle consist is shown as a train, but alternatively may represent another system of vehicles that are connected with each other to travel together along a route 808, such as a track, road, waterway, and the like. The propulsion units may represent rail vehicles that are powered to propel the vehicle consist. Alternatively, the propulsion units may represent other vehicles that generate propulsive force, such as other rail vehicles, other off-highway vehicles, automobiles, marine vessels, and the like. The vehicle consist includes several non-propulsion units 810, such as vehicles that do not generate propulsive force to propel the vehicle consist. Examples of such non-propulsion units include, but are not limited to, rail cars, passenger cars, trailers, barges, and the like.

The communication system allows for the propulsion units of the vehicle consist to be controllably linked with each other. When the propulsion units are controllably linked, at least one of the propulsion units (referred to herein as a controlling propulsion unit) can remotely control operations of other propulsion units (referred to herein as trail or remote propulsion units). When the propulsion units are not controllably linked, the controlling propulsion unit may not be able to control operations of the remote propulsion units. The communication system is shown as including antennas of the propulsion units that wirelessly communicate with each other, but alternatively or additionally may include one or more wired connections, such as by using communications through one or more cables, buses, trainlines, conductors used for communications with electronically controlled pneumatic (ECP) brakes, conductors used for communications within an electric multiple unit (MU cable), and the like.

By "remotel control" or "remotely control" or the like, it is meant that the operations of the remote propulsion unit are controlled from a location that is outside of the remote propulsion unit, although not necessarily far away from the remote propulsion unit. In one embodiment, the communication system controllably links the propulsion units in a distributed power system so that the controlling propulsion unit remotely controls the tractive efforts (e.g., propulsive forces) generated by the remote propulsion units.

The remote propulsion units can prevent a controlling propulsion unit from remotely controlling operations of the remote propulsion units unless the controlling propulsion unit and the remote propulsion unit are controllably linked with each other. Several remote propulsion units (e.g., propulsion units 802B, 802C) may be controllably linked with a single controlling propulsion unit (e.g., propulsion unit 802A). Alternatively, one or more remote propulsion units can be controllably linked with more than one controlling propulsion unit.

In order to controllably link propulsion units with each other, such as in a distributed power system, a linking process may be performed. The linking process described herein is used to associate (e.g., controllably link) a single controlling propulsion unit with a single remote propulsion unit. The process may be used, however, to controllably link the controlling propulsion unit with several remote propulsion units.

Figure 9A:
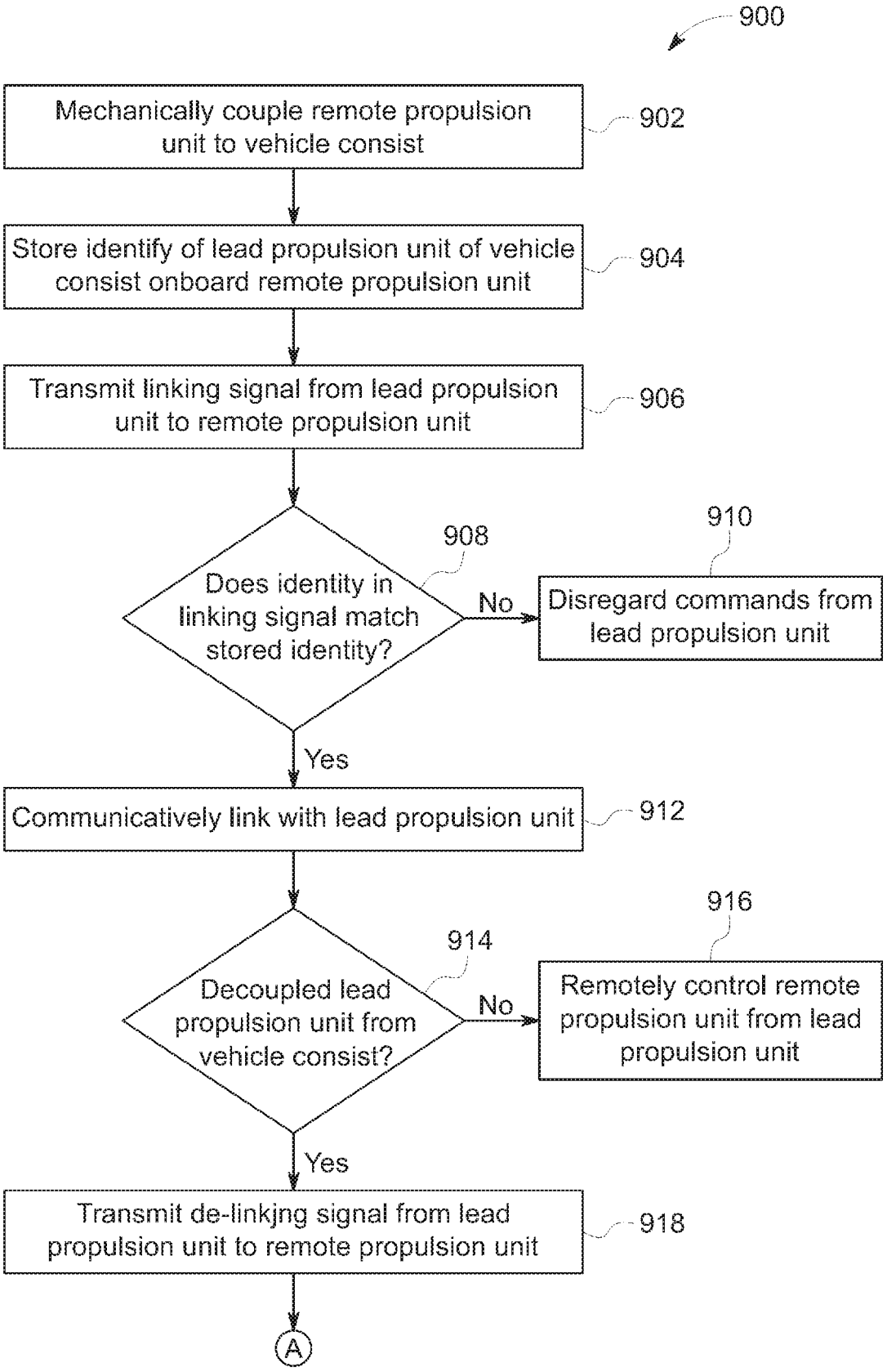
FIG. 9A illustrates a portion of a flowchart of one embodiment of a method or process for controllably linking propulsion units of a vehicle consist.
Figure 9B:
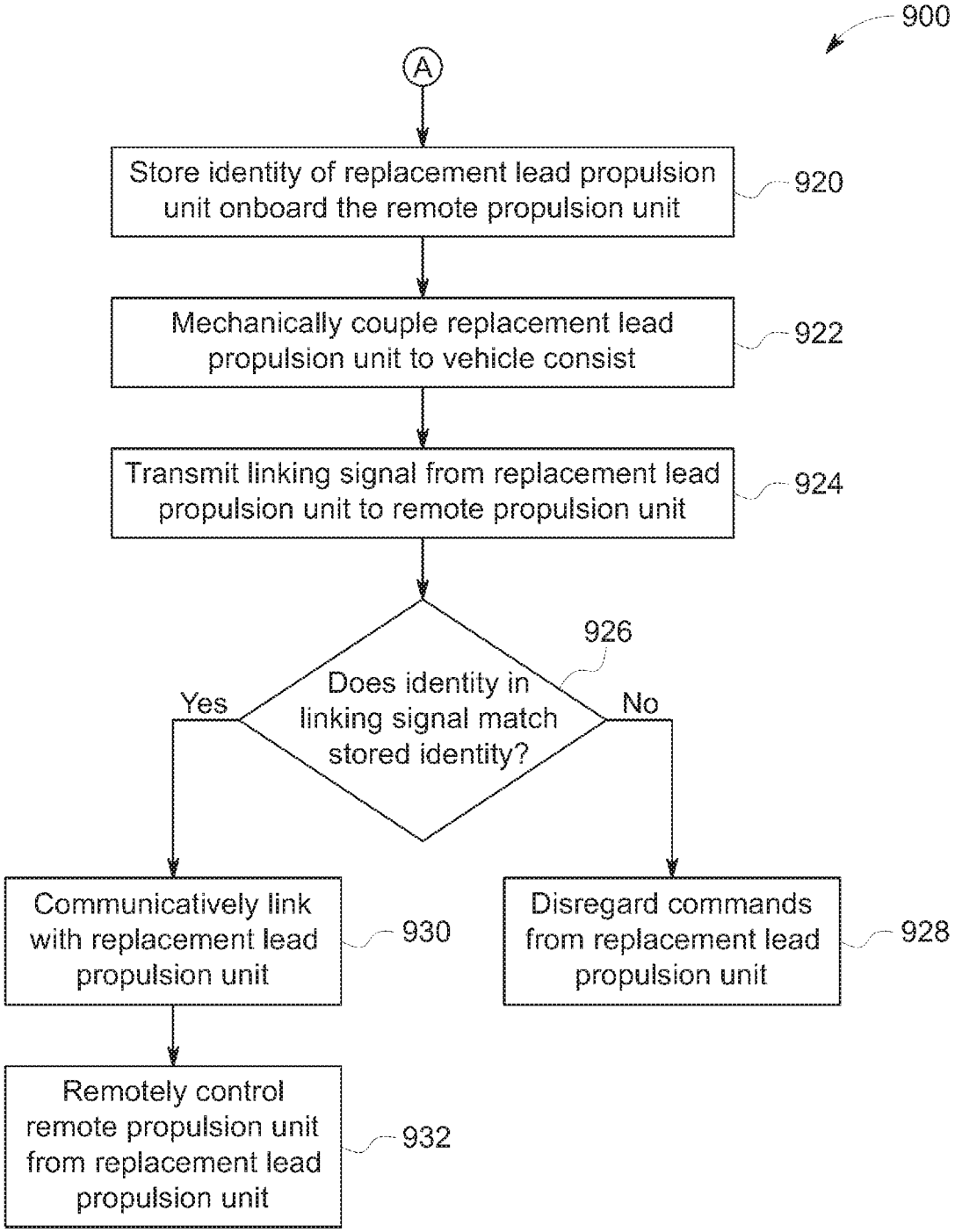
FIG. 9B illustrates a portion of the flowchart that follows the flowchart portion of FIG. 9A.

FIGS. 9A and 9B illustrate a flowchart of one embodiment of a method or process 900 for controllably linking propulsion units of a vehicle consist. The method 900 can represent the linking process that is used to controllably link or couple a remote propulsion unit with a first controlling propulsion unit, to communicatively de-couple the remote propulsion unit from the first controlling propulsion unit, and then to controllably link the remote propulsion unit with another, replacement controlling propulsion unit. The linking of the remote propulsion unit with the replacement controlling propulsion unit can be performed without requiring a human operator to enter the remote propulsion unit after the remote propulsion unit is first controllably linked with the first controlling propulsion unit. In other embodiments, the linking of the remote propulsion unit with the replacement controlling propulsion unit requires that an operator by onboard the remote propulsion unit.

At 902, a remote propulsion unit 802B (shown in FIG. 8) is mechanically coupled with the vehicle consist. The remote propulsion unit 802B can be sequentially coupled with other propulsion units and/or non-propulsion units.

At 904, an identity of the first controlling propulsion unit 802A is provided to the remote propulsion unit 802B. For example, an operator may enter the remote propulsion unit 802B and manually input the identity of the first controlling propulsion unit 802A into a setup unit of the remote propulsion unit 802B. The propulsion units may be associated with unique identities that allow the remote propulsion unit 802B to differentiate between the different propulsion units. These identities may be alphanumeric strings, numeric strings, letter strings, or the like. The identity of the controlling propulsion unit 802A that is provided to the remote propulsion unit 802B is referred to herein as a designated identity, as the identity may be designated by a person, component, device, or system other than the controlling propulsion unit 802A.

At 906, a linking signal is transmitted from the controlling propulsion unit 802A to the remote propulsion units. For example, a communication interface of the controlling propulsion unit 802A may transmit or broadcast signals to the remote propulsion units of the vehicle consist. The linking signal includes an identity of the controlling propulsion unit 802A that transmitted the linking signal. A communication interface onboard the remote propulsion unit 802B may receive the linking signal and extract the identity of the controlling propulsion unit 802A from the linking signal.

At 908, a determination is made as to whether the identity that is included in the received linking signal corresponds to the designated identity that is locally stored at the remote propulsion unit 802B. For example, a setup unit onboard the remote propulsion unit 802B can compare the identity in the received linking signal with the locally stored designated identity to see if the identities both represent the same controlling propulsion unit 802A. If the identity input at the remote propulsion unit 802B and the identity communicated in the received linking signal do not both represent the same controlling propulsion unit 802A, then the remote propulsion unit 802B determines that the linking signal was sent from a propulsion unit that is not the same propulsion unit identified by the identity provided to the remote propulsion unit 802B. As a result, flow of the method 900 proceeds to 910. If both identities represent the same controlling propulsion unit 802A, then the remote propulsion unit 802B determines that the linking signal was sent from the controlling propulsion unit 802A previously identified by the operator. Thus, flow of the method 900 proceeds to 912.

At 910, the remote propulsion unit 802B does not controllably link with the controlling propulsion unit 802A that transmitted the linking signal and command or control signals that are sent by the controlling propulsion unit 802A to the remote propulsion unit 802B are ignored by the remote propulsion unit 802B.

At 912, the remote propulsion unit 802B is controllably linked with the controlling propulsion unit 802A. For example, once a setup unit onboard the remote propulsion unit 802B confirms that the controlling propulsion unit 802A is identified by both the designated identity stored onboard the remote propulsion unit 802B and the identity sent in the linking signal, then the setup unit may controllably link with the controlling propulsion unit 802A. The controlling propulsion unit 802A may then remotely control operations of the remote propulsion unit 802B.

At 914, a determination is made as to whether the controlling propulsion unit 802A is to be removed from the vehicle consist or remain in the vehicle consist. For example, one or more faults may occur during operation of the controlling propulsion unit, such as faults in the communication interface of the controlling propulsion unit. Thus, the controlling propulsion unit may be unable to remotely control the remote propulsion units. If the controlling propulsion unit does not need to be decoupled from the vehicle consist and replaced with another controlling propulsion unit, flow of the method 900 may proceed to 916. If the controlling propulsion unit does need to be decoupled from the vehicle consist and replaced, then flow of the method 900 can continue to 918.

At 916, the controlling propulsion unit remotely controls operations of the remote propulsion unit 802B during movement of the vehicle consist along the route. For example, the controlling propulsion unit 802A can direct the tractive efforts, braking efforts, and the like, that are provided by the remote propulsion unit 802B during travel of the vehicle consist.

At 918, the controlling propulsion unit is to be removed from the vehicle consist and, as a result, transmits an unlinking signal to the remote propulsion unit 802B. The unlinking signal may be transmitted before or after the controlling propulsion unit is removed from the vehicle consist. The unlinking signal notifies the remote propulsion unit 802B that the controlling propulsion unit is being removed and replaced by another, replacement propulsion unit.

In some embodiments, the remote propulsion unit 802B (or other remote propulsion unit of the vehicle system 804) may be operating in a suspended mode of operation in which the remote propulsion unit is physically decoupled from the vehicle system 804 and permitted to operate independently. As described herein, the remote propulsion unit may be subsequently re-coupled to the vehicle system and re-establish a dependent relationship such that the remote vehicle operates again in a remote mode of operation. However, the re-coupling may occur with the replacement controlling vehicle such that the replacement controlling vehicle now has the relationship the prior controlling vehicle had with the remote propulsion unit.

Figure 10:
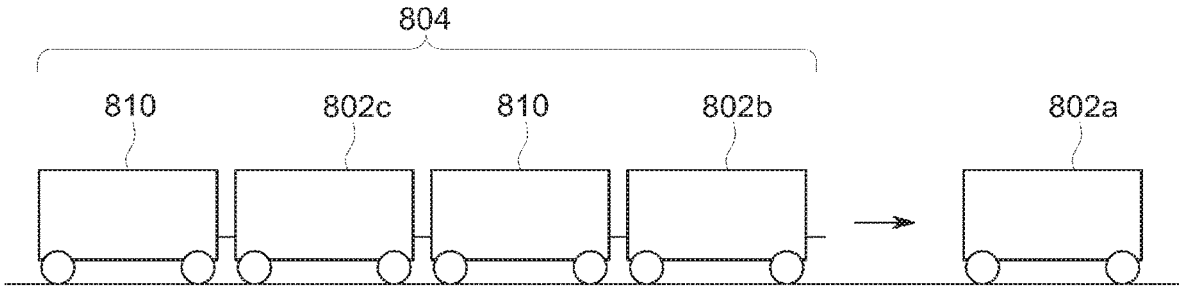
FIG. 10 schematically illustrates removal of a controlling propulsion unit from the vehicle system in accordance with one embodiment.
Figure 11:
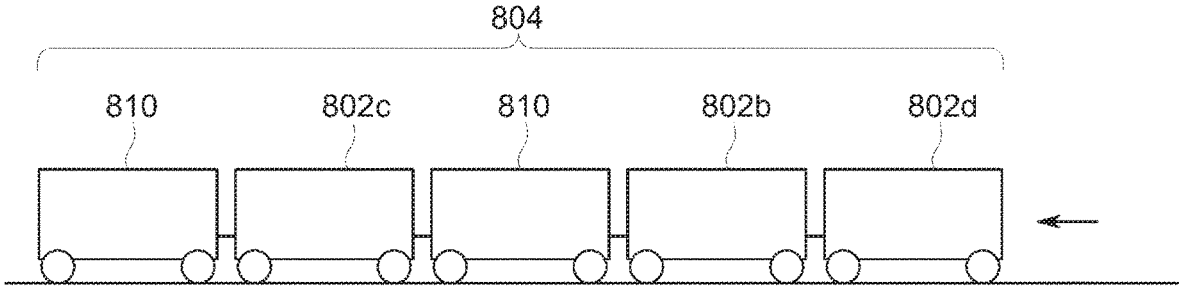
FIG. 11 schematically illustrates coupling of a replacement controlling propulsion unit with the vehicle consist in accordance with one embodiment.

FIG. 10 schematically illustrates removal of the controlling propulsion unit 802A from the vehicle consist 804 in accordance with one embodiment. The controlling propulsion unit can be mechanically and/or logically de-coupled from the vehicle consist and moved away from the vehicle consist. FIG. 11 schematically illustrates coupling of a replacement controlling propulsion unit 802D with the vehicle consist 804 in accordance with one embodiment. The replacement controlling propulsion unit can be mechanically coupled with the vehicle consist after the controlling propulsion unit 802A is removed from the vehicle consist.

Returning to the description of the method 900 shown in FIGS. 9A and 9B, the unlinking signal also can include an identity of the replacement controlling propulsion unit 802D (referred to herein as a replacement identity). An operator may input the replacement identity into a setup unit onboard the controlling propulsion unit. Alternatively, the replacement identity may be communicated to the controlling propulsion unit from a remote location.

At 920 (shown in FIG. 9B), the identity of the replacement controlling propulsion unit is stored onboard the remote propulsion unit 802B. For example, the setup unit disposed onboard the remote propulsion unit 802B can locally store the replacement identity in an onboard memory.

At 922, the replacement controlling propulsion unit is mechanically coupled with the vehicle consist 804, as shown in FIG. 11. At 924, a linking signal (also referred to herein as a replacement linking signal) is transmitted from the replacement controlling propulsion unit to the remote propulsion unit 802B. Like the linking signal transmitted by the previous controlling propulsion unit 802A, the replacement linking signal may include the identity of the replacement propulsion unit 802D.

At 926, a determination is made as to whether the identity that is included in the replacement linking signal corresponds to the replacement identity that is locally stored at the remote propulsion unit 802B. For example, the setup unit onboard the remote propulsion unit 802B can compare the identity in the received replacement linking signal with the locally stored replacement identity to see if the identities both represent the same replacement controlling propulsion unit. If the identities do not both represent the same replacement controlling propulsion unit, then the remote propulsion unit 802B determines that the replacement linking signal was sent from a propulsion unit that is not the same propulsion unit identified by the replacement identity provided to the remote propulsion unit 802B in the unlinking signal sent by the previous controlling propulsion unit 802A. Thus, flow of the method 900 proceeds to 928.

If both identities represent the same replacement controlling propulsion unit 802D, then the remote propulsion unit 802B determines that the replacement linking signal was sent from the same replacement controlling propulsion unit previously identified by the unlinking signal from the previous controlling propulsion unit 802A. Thus, flow of the method 900 proceeds to 930.

At 928, the remote propulsion unit 802B does not controllably link with the replacement controlling propulsion unit that transmitted the replacement linking signal. Consequently, command or control signals that are sent by the replacement controlling propulsion unit to the remote propulsion unit 802B are ignored by the remote propulsion unit 802B.

At 930, the remote propulsion unit 802B is controllably linked with the replacement controlling propulsion unit 802D. For example, once a setup unit onboard the remote propulsion unit 802B confirms that the replacement controlling propulsion unit is identified by both the replacement identity stored onboard the remote propulsion unit 802B and the identity sent in the replacement linking signal, then the setup unit may controllably link with the replacement controlling propulsion unit 802D.

At 932, the replacement controlling propulsion unit remotely controls operations of the remote propulsion unit 802B. For example, the replacement controlling propulsion unit can direct the tractive efforts, braking efforts, and the like, that are provided by the remote propulsion unit 802B during travel of the vehicle consist.

Figure 12:
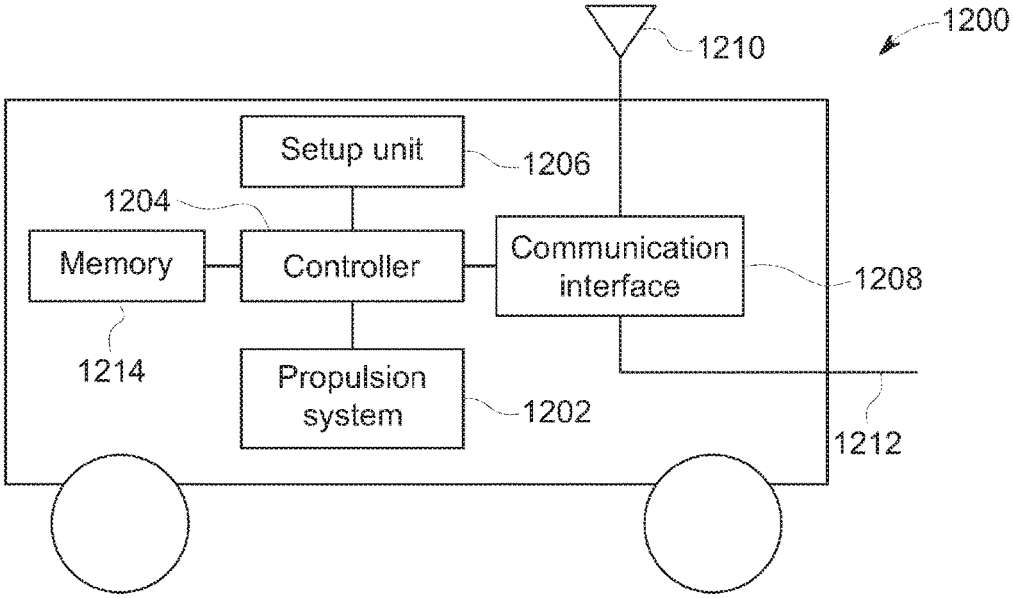
FIG. 12 is a schematic illustration of one embodiment of a propulsion unit.

FIG. 12 is a schematic illustration of one embodiment of a propulsion unit 1200. The propulsion unit 1200 may represent one or more of the propulsion units 802 shown or described herein. For example, the propulsion unit 1200 may represent the controlling propulsion unit 802A, the remote propulsion unit 802B, and/or the replacement controlling propulsion unit 802D.

The propulsion unit 1200 includes a propulsion system 1202 that generates propulsive force to propel the propulsion unit 1200. The propulsion system 1202 may include or represent one or more engines, alternators, generators, energy storage devices (e.g., batteries, flywheels, and the like), catenaries, shoes, traction motors, and the like.

The propulsion system 1202 is controlled by a controller 1204. The controller 1204 includes or represents one or more processors, input devices, output devices, and the like, that is used to control operations of the propulsion system 1202. The controller 1204 may receive input from an operator disposed onboard the propulsion unit 1200 to control the propulsion system 1202. Alternatively or additionally, the controller 1204 may be remotely controlled by another propulsion unit 1200. For example, if the controller 1204 is disposed onboard a remote propulsion unit that is controllably linked with a controlling propulsion unit in a distributed power system, the controller 1204 may receive control signals or commands from the controlling propulsion unit. The controller 1204 may then implement the commands from the controlling propulsion unit to control operations of the propulsion system 1202.

A setup unit 1206 disposed onboard the propulsion unit 1200 may be similar to the setup unit 510 shown in FIG. 5. As described above, the setup unit 1206 can include or represent one or more processors, output devices (e.g., a display), and/or input devices. The setup unit 1206 can be a portable, hand-held device that is capable of being moved by an average human being within the propulsion unit 1200 and/or outside of the propulsion unit 1200 without mechanical assistance to lift and carry the setup unit 1206. Alternatively, the setup unit 1206 may be fixed within the propulsion unit 1200, such as by being mounted to a surface within the propulsion unit 1200.

The setup unit 1206 is operably connected with a communication interface 1208, which may be similar to the communication interface 518 shown in FIG. 5. The communication interface 1208 can include circuitry and associated hardware and/or software for allowing the propulsion unit 1200 to communicate with one or more other propulsion units 1200 or other locations. The communication interface 1208 includes an antenna 1210 that wirelessly communicates with other propulsion units 1200. Additionally or alternatively, the communication interface 1208 can be connected with a conductive pathway 1212 that is joined with the communication interface 1208 of another propulsion unit 1200. The communication interfaces 1208 can communicate with each other over this conductive pathway 1212. The conductive pathway 1212 can represent one or more cables, buses, and the like, such as an ECP line, a trainline, an eMU line, or the like.

A memory 1214 is disposed onboard the propulsion unit 1200 and is accessible to the controller 1204, setup unit 1206, and/or communication interface 1208. The memory 1214 can represent a tangible and non-transitory computer readable storage medium, such as a computer hard drive or other volatile or non-volatile memory. The memory 1214 can store one or more sets of instructions (e.g., software) that directs the setup unit 1206 and/or controller 1204 to perform one or more operations. As described herein, the memory 1214 can be used to store identities of propulsion units 1200. For example, where the propulsion unit 1200 represents a remote propulsion unit 1200 (e.g., the remote propulsion unit 802B in FIG. 8), the setup unit 1206 can be used to receive an operator-designated identity of a first controlling propulsion unit and to store the designated identity in the memory 1214. The setup unit 1206 can then compare the designated identity in the memory 1214 with an identity that is received by the communication interface 1206 via a linking signal, as described above. When a replacement identity is received by the communication interface 1206, the setup unit 1206 can store the replacement identity in the memory 1214, also as described above.

In one embodiment, the propulsion units described herein may be interchangeable in that one or more propulsion units may can operate as controlling propulsion units and remote propulsion units. For example, a first propulsion unit may operate as a controlling propulsion unit in a vehicle consist to control operations of other propulsion units in the vehicle consist during a first time period. During a different, second time period (e.g., during the same or different trip of the vehicle consist), the first propulsion unit may operate as a remote propulsion unit so that operations of the first propulsion unit are controlled by another propulsion unit in the vehicle consist.

Figure 13:
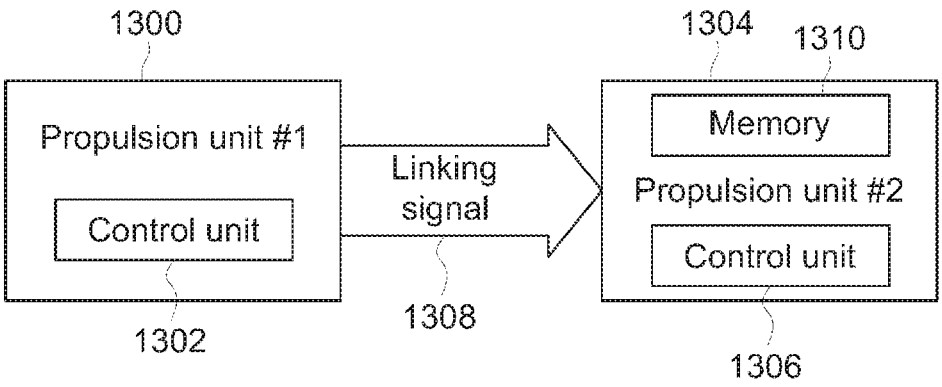
FIG. 13 illustrates one embodiment of a control unit of a propulsion unit operating in a first mode of operation.
Figure 14:
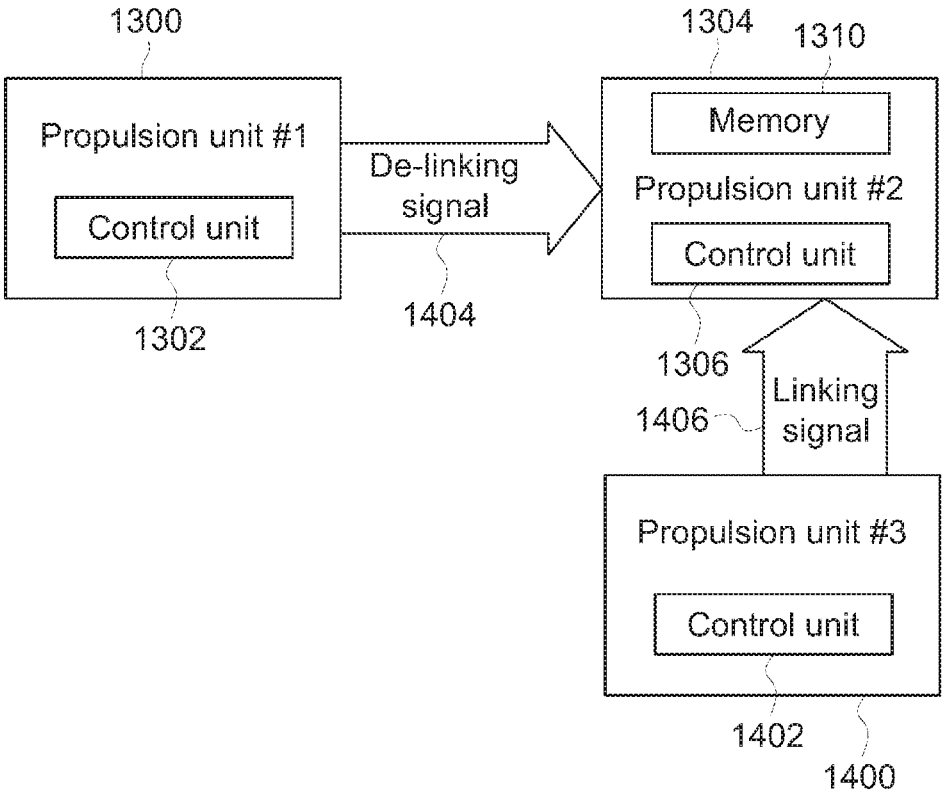
FIG. 14 illustrates one embodiment of the control unit of the propulsion unit shown in FIG. 13 operating in a different, second mode of operation.
Figure 15:
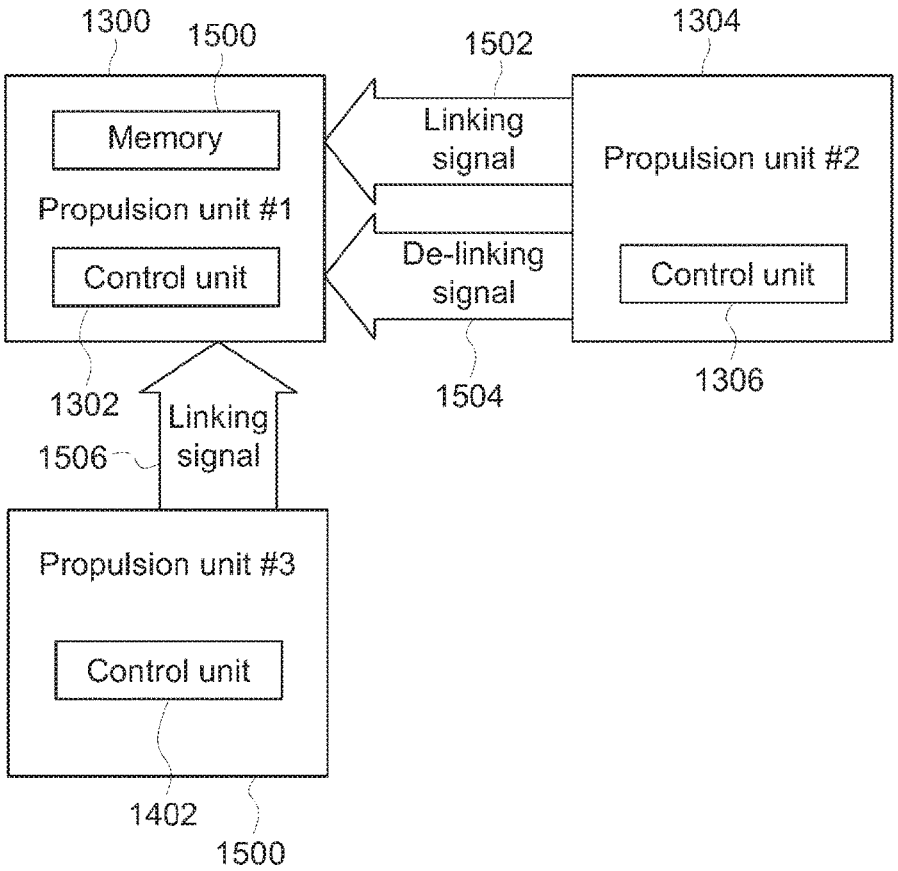
FIG. 15 illustrates one embodiment of the control unit of the first propulsion unit shown in FIG. 13 operating in a different, third mode of operation.

FIGS. 13 through 15 illustrate schematic diagrams of one embodiment of a first propulsion unit 1300 (e.g., "Propulsion Unit #1") operating in different modes. The first propulsion unit 1300 may represent one or more of the propulsion units described herein. The first propulsion unit 1300 includes a control unit 1302, which may represent the setup unit 1206, controller 804, and/or communication interface 1206 (shown in FIG. 12). The first propulsion unit 1300 also can include a memory 1500 (shown in FIG. 15) similar to the memory 814 (shown in FIG. 12). Also shown in FIGS. 13 through 15 are second and third propulsion units 1304, 1400 (e.g., "Propulsion Unit #2" and "Propulsion Unit #3," respectively), which may represent one or more of the propulsion units described herein. The second and third propulsion units 1304, 1400 also can include control units 1306, 1402 and/or memories 1310, similar to the first propulsion unit 1300. In one embodiment, the control units 1302, 1306, 1402 of the first, second, and third propulsion unit 1300, 1304, 1400 may interchangeably switch between operating modes to switch which of the propulsion units 1300, 1304, 1400 operate as a controlling propulsion unit (e.g., that remotely controls operations of other propulsion units in a vehicle consist) and which of the propulsion units 1300, 1304, 1400 operate as a remote propulsion unit. While the description herein focuses on the control unit 1302 of the first propulsion unit 1300 switching between different operations modes, the description also may apply to the control units 1306 and/or 1402 of the second and/or third propulsion units 1304, 1400.

FIG. 13 illustrates the control unit 1302 of the first propulsion unit 1300 operating in a first mode of operation where the first propulsion unit 1300 is to controllably link with the second propulsion unit 1304 to control operations of the second propulsion unit 1304. As described above, the control unit 1302 transmits a first linking signal 1308 to the control unit 1306 of the second propulsion unit 1304. The first linking signal 1308 includes or represents an identity of the control unit 1302 of the first propulsion unit 1300 (and/or an identity of the first propulsion unit 1300). The control unit 1306 compares this identity to a designated identity stored in the memory 1310 (or received from an operator, received from an off-board location, or the like), as described above. If the received identity of the first linking signal 1308 matches the designated identity, then the control unit 1302 of the first propulsion unit 1300 is controllably linked with the control unit 1306 of the second propulsion unit 1304 to remotely control operations of the second propulsion unit 1304.

FIG. 14 illustrates the control unit 1302 of the first propulsion unit 1300 operating in a different mode of operation where the first propulsion unit 1300 unlinks from the second propulsion unit 1304. The control unit 1302 transmits a first unlinking signal 1404 to the control unit 1306 of the second propulsion unit 1304 when the first propulsion unit 1300 is to be mechanically decoupled from the vehicle consist that includes the first and second propulsion units 1300, 1304. The first unlinking signal 1404 includes a first replacement identity of the third propulsion unit 1400 that is to be mechanically coupled to the vehicle consist to replace the first propulsion unit 1304. The control unit 1402 of the third propulsion unit 1400 can transmit a second linking signal 1406 to the control unit 1306 of the second propulsion unit 1400 that includes or represents an identity of the control unit 1402 (and/or an identity of the third propulsion unit 1400). As described above, the third propulsion unit 1400 can be joined with the vehicle consist to control the second propulsion unit 1304 if the first replacement identity that is received in the unlinking signal 1404 matches or otherwise corresponds to the identity that is communicated in the linking signal 1406.

FIG. 15 illustrates the control unit 1302 of the first propulsion unit 1300 operating in a another mode of operation where the first propulsion unit 1300 can operate as a remote propulsion unit. Similar to as described above, the control unit 1302 of the first propulsion unit 1300 can receive a third linking signal 1502 from the control unit 1306 of the second propulsion unit 1304. The control unit 1302 can compare an identity that is communicated in the third linking signal 1502 with a designated identity that is stored in the memory 1500 of the first propulsion unit 1300 (or received from an operator, received from an off-board source, or the like). If the identities match, then the control unit 1302 may be controllably linked with the control unit 1306 of the second propulsion unit 1304 such that the control unit 1306 of the second propulsion unit 1304 remotely controls operations of the first propulsion unit 1300.

In the third mode, the control unit 1302 of the first propulsion unit 1300 can receive a second unlinking signal 1504 from the control unit 1306 of the second propulsion unit 1304. As described above, the unlinking signal 1504 may be transmitted when the second propulsion unit 1304 is to separate from the vehicle consist that includes the first propulsion unit 1300. The second unlinking signal 1504 can include a replacement identity of a control unit on another propulsion unit.

The control unit 1402 of the third propulsion unit 1500 transmits a fourth linking signal 1506 to the control unit 1302 of the first propulsion unit 1300 when the third propulsion unit 1500 is to connect with the vehicle consist as a controlling propulsion unit. The fourth linking signal 1506 includes an identity of the control unit 1402 of the third propulsion unit 1500 and/or an identity of the third propulsion unit 1500. The control unit 1302 of the first propulsion unit 1300 compares the identity that is received via the fourth linking signal 1506 with the replacement identity that is received via the unlinking signal 1504. If the identities match or otherwise correspond with each other (e.g., by identifying the same control unit and/or propulsion unit), then the control unit 1302 of the first propulsion unit 1300 can be controllably linked with the control unit 1402 of the third propulsion unit 1500 such that the control unit 1402 can remotely control operations of the first propulsion unit 1300.

Figure 16:
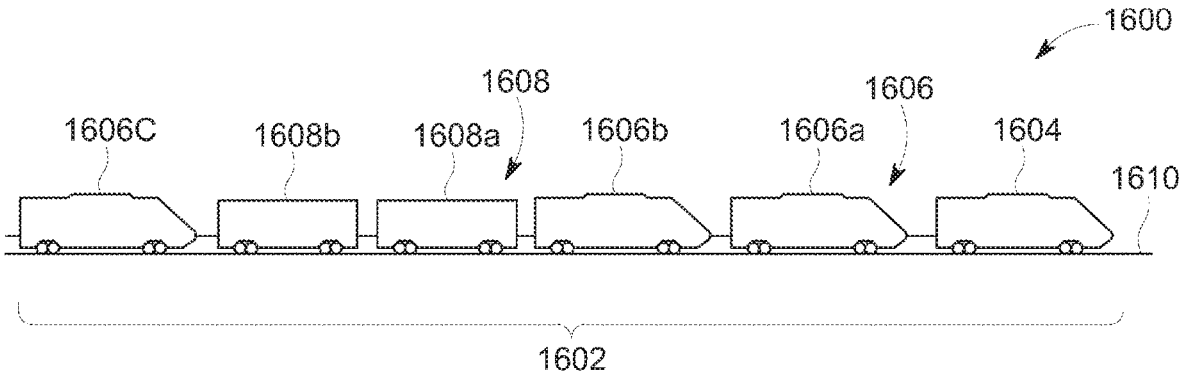
FIG. 16 is a schematic view of one embodiment of a communication system of a vehicle consist or vehicle system.

FIG. 16 is a schematic view of one embodiment of a communication system 1600 of a vehicle consist or vehicle system 1602. The illustrated vehicle consist 1602 includes propulsion-generating vehicles 1604, 1606 (e.g., vehicles 1604, 1606A, 1606B, 1606C) and non-propulsion-generating vehicles 1608 (e.g., vehicles 1608A, 1608B) mechanically coupled with each other. The propulsion-generating vehicles are capable of self-propulsion while the non-propulsion-generating vehicles are not capable of self-propulsion. The propulsion-generating vehicles 1604, 1606 are shown as locomotives, the non-propulsion-generating vehicles 1608 are shown as rail cars, and the vehicle consist 1602 is shown as a train in the illustrated embodiment. Alternatively, the vehicles 1604, 1606 may represent other vehicles, such as automobiles, marine vessels, or the like, and the vehicle consist 1602 can represent a grouping or coupling of these other vehicles. In one embodiment, the vehicles 1604, 1606 may not be mechanically coupled with each other. For example, the vehicles 1604, 1606 may be separate from each other, but may communicate with each other to coordinate operations of the vehicles 1604, 1606. For example, the vehicle 1604 may wirelessly communicate operational command messages to the vehicles 1606 that remotely control or direct operational settings of the vehicles 1606 so that the vehicles 1604, 1606 can remain designated distances from each other or otherwise travel together. The number and arrangement of the vehicles 1604, 1606 in the vehicle consist 1602 are provided as one example and are not intended as limitations on all embodiments of the inventive subject matter described herein.

The vehicles 1604, 1606 can be arranged in a distributed power (DP) arrangement. For example, the vehicles 1604, 1606 can include a controlling vehicle 1604 that issues command messages to the other vehicles 1606A, 1606B, 1606C which are referred to herein as remote vehicles. The designations "controlling" and "remote" are not intended to denote spatial locations of the vehicles 1604, 1606 in the vehicle consist 1602, but instead are used to indicate which vehicle 1604, 1606 is communicating (e.g., transmitting, broadcasting, or a combination of transmitting and broadcasting) operational command messages and which vehicles 1604, 1606 are being remotely controlled using the operational command messages. For example, the controlling vehicle 1604 may or may not be disposed at the front end of the vehicle consist 1602 (e.g., along a direction of travel of the vehicle consist 1602). Additionally, the remote vehicles 1606A-C need not be separated from the controlling vehicle 1604. For example, a remote vehicle 1606A-C may be directly coupled with the controlling vehicle 1604 or may be separated from the controlling vehicle 1604 by one or more other remote vehicles 1606A-C and/or vehicles 1608.

The operational command messages may include directives that direct operations of the remote vehicles. These directives can include propulsion commands that direct propulsion subsystems of the remote vehicles to move at a designated speed and/or power level, brake commands that direct the remote vehicles to apply brakes at a designated level, and/or other commands. The controlling vehicle 1604 issues the command messages to coordinate the tractive efforts and/or braking efforts provided by the vehicles 1604, 1606 to propel the vehicle consist 1602 along a route 1610, such as a track, road, waterway, or the like.

The operational command messages can be communicated using the communication system 1600, as described below. In one embodiment, the operational command messages are wirelessly communicated using the communication system 1600. Prior to communicating the operational command messages, the vehicles 1604, 1606 may need to be communicatively coupled with each other. For example, one or more communication links may need to be established between the vehicles 1604, 1606 before the vehicles 1606 will operate according to the operational command messages. A communication link may be established between the controlling vehicle 1604 and the remote vehicle 1606 responsive to a link command message being communicated between the vehicles 1604, 1606 that correctly identifies the other of the vehicles 1604, 1606 (e.g., the message identifies the vehicle 1604, 1606 that is sending the message and/or the vehicle 1604, 1606 that is receiving the message) and the vehicle 1604, 1606 that receives the link command message communicating a reply link message to confirm receipt of the link command message.

The messages can identify the vehicles 1604, 1606 by a vehicle identifier. The vehicle identifier can represent a unique numeric and/or alphanumeric sequence or code that distinguishes one vehicle 1604, 1606 from other vehicles 1604, 1606. Alternatively, a vehicle identifier may identify two or more vehicles 1604, 1606 differently from one or more other vehicles 1604, 1606. For example, a vehicle identifier can represent a type of vehicle, a group of vehicles, or the like.

Optionally, the messages may identify vehicles 1604, 1606 by a consist name. A consist name can represent a unique numeric and/or alphanumeric sequence or code that distinguishes one vehicle consist 1602 from other vehicle consists 1602. For example, in a vehicle yard such as a rail yard, several vehicle consists 1602 may be relatively close to each other such that the vehicles 1604, 1606 in the different vehicle consists 1602 can wirelessly communicate with each other. To prevent the vehicles 1604, 1606 in one vehicle consist 1602 from mistakenly communicating with a vehicle 1604, 1606 in another vehicle consist 1602 (e.g., such as by operating according to operational command messages from another vehicle consist 1602), the messages optionally may include a consist name to identify which vehicle consist 1602 that the messages are associated with.

Figure 17:
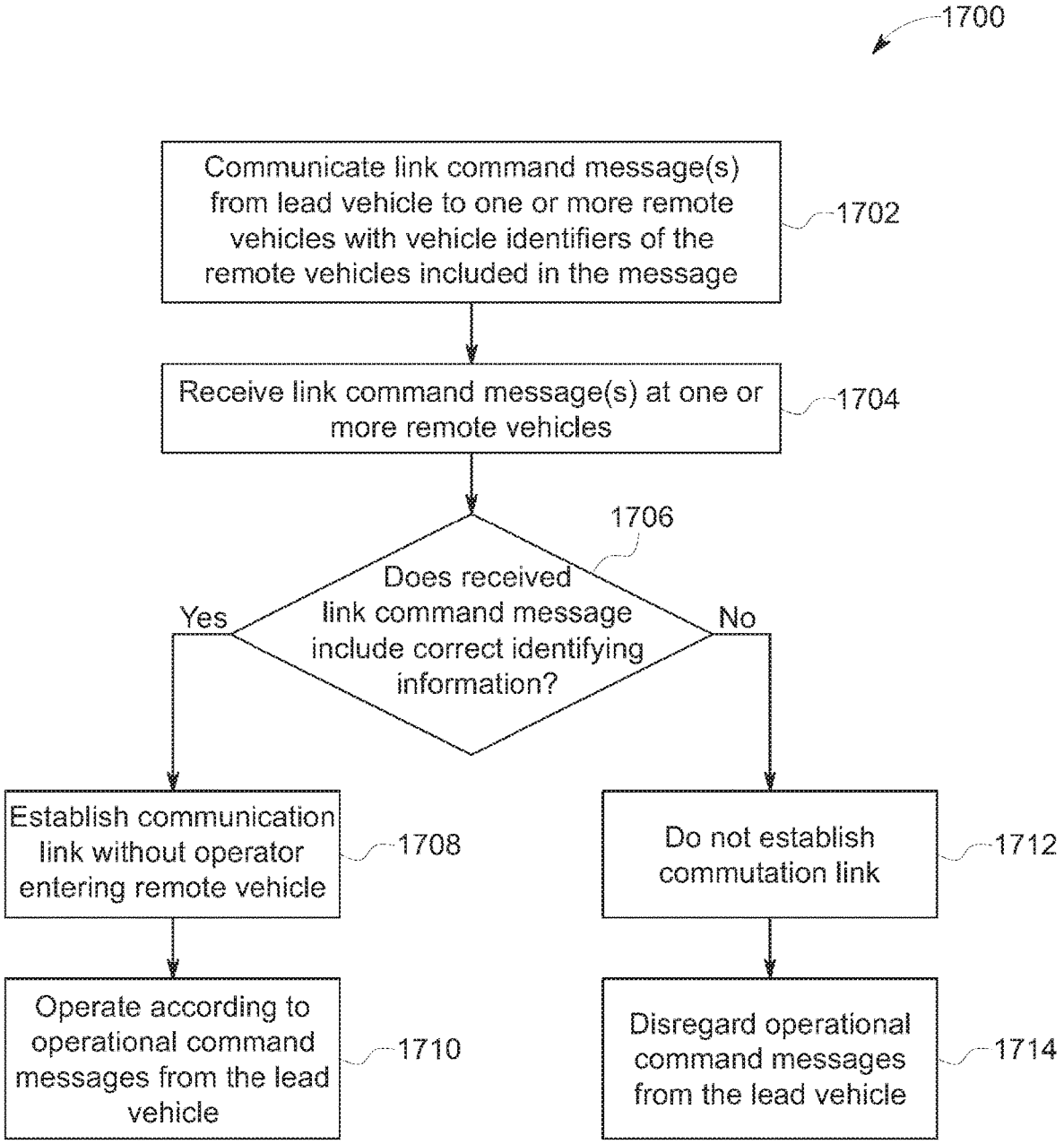
FIG. 17 illustrates a flowchart of one embodiment of a method for communicatively coupling vehicles in the vehicle consist shown in FIG. 16.

FIG. 17 illustrates a flowchart of one embodiment of a method 1700 for communicatively coupling vehicles 1604, 1606 in the vehicle consist shown in FIG. 16. The method 1700 may be used to establish communication links between the vehicles 1604, 1606 so that the controlling vehicle 1604 can coordinate tractive efforts and/or braking efforts provided by the vehicles 1606. For example, the method 1700 may be used to set up the vehicles 1604, 1606 to operate in a distributed power (DP) mode. The method 1700 can be used to establish the communication links between the vehicles 1604, 1606 without an operator having to travel to and/or board the remote vehicles 1606.

At 1702, one or more link command messages are communicated to the remote vehicles 1606. The link command message(s) may be broadcast from the controlling vehicle 1604 to the remote vehicles 1606. Alternatively, the link command message(s) may be communicated from another source, such as a tower, a dispatch center, a remote control device (e.g., an operator control unit), or the like. The link command message(s) can be wirelessly transmitted and/or broadcast. Prior to communicating the link command message(s), the vehicles 1604, 1606 may not be communicatively coupled. For example, the vehicles 1606 may not be set up to operate according to operational command messages received from the controlling vehicle 1604.

The link command message(s) include a vehicle identifier of one or more of the remote vehicles 1606. For example, the link command message(s) can include unique identifiers of the plural remote vehicles 1606 that are to be included in the vehicle consist 1602. Alternatively, each of the link command messages can include a single vehicle identifier of a single remote vehicle 1606 that is to be included in the vehicle consist 1602. Several link command messages may be sent with each link command message identifying another remote vehicle 1606 so that several remote vehicles 1606.

In one embodiment, the link command message(s) can include a vehicle consist identifier. For example, the link command message(s) can include the vehicle identifiers of the remote consists 1606 that are to be communicatively linked with the controlling vehicle 1604 and the vehicle consist identifier of the vehicle consist 1602 that will include the vehicles 1604, 1606. Alternatively, the link command message(s) may include the vehicle consist identifier and not the vehicle identifiers of the remote vehicles 1606.

At 1704, the link command message(s) are received at the remote vehicles 1606. In one aspect, the link command message(s) may be received by the remote vehicles 1606 that are to be included in the vehicle consist 1602 and one or more other remote vehicles that are not to be included in the vehicle consist 1602. For example, due to the close proximity between several vehicle consists 1602, the remote vehicles 1606 in one or more other vehicle consists may receive the link command message(s) for the vehicle consist 1602 shown in FIG. 16. Thus, both the remote vehicles 1606 in the vehicle consist 1602 and the remote vehicles 1606 that are not in the vehicle consist 1602 may wirelessly receive the link command message(s). Alternatively, the link command message may only be received by the remote vehicles 1606 that are in the vehicle consist 1602.

At 1706, the link command message is examined to determine if the link command message includes correct identifying information. For example, in response to receiving the link command message at a remote vehicle 1606, the remote vehicle 1606 can parse the link command message to determine if the link command message includes one or more types of identifying information that identifies the remote vehicle 1606 and/or the vehicle consist 1602. The vehicle identifiers and/or consist identifiers can be stored onboard the remote vehicles 1606, such as in memories, control units, or the like, of the remote vehicles 1606.

If the link command message includes the correct identifying information, then the remote vehicle 1606 can determine that the remote vehicle 1606 can communicatively link with the controlling vehicle 1604 to receive operational command messages from the controlling vehicle 1604. Thus, flow of the method 1700 can proceed to 1708. On the other hand, if the link command message does not include the correct identifying information, then the remote vehicle 1606 can determine that the remote vehicle 1606 cannot communicatively link with the controlling vehicle 1604 to receive operational command messages from the controlling vehicle 1604. Thus, flow of the method 1700 can proceed to 1716. The determination performed at 1706 can be performed onboard each of the remote vehicles 1606 without an operator being onboard the remote vehicles 1606.

In one aspect, the identifying information in the link command message is correct when the link command message includes the vehicle identifier of the remote vehicle 1606 and the consist identifier stored onboard the remote vehicle 1606. For example, if the link command message includes one or more vehicle identifiers, and at least one of the vehicle identifiers matches or otherwise corresponds to the vehicle identifier of the remote vehicle 1606 that received the link command message, then the link command message includes the correct vehicle identifier for that remote vehicle 1606. If the link command message includes a consist identifier that matches or otherwise corresponds to a consist identifier stored onboard the remote vehicle 1606, then the link command message includes the correct consist identifier for that remote vehicle 1606. If either the vehicle identifier or the consist identifier in the link command message does not match or otherwise correspond to the vehicle identifier of the remote vehicle 1606 or the consist identifier stored onboard the remote vehicle 1606 that receives the link command message, then the identifying information in the link command message is not correct. Alternatively, the identifying information may be correct if the link command message includes the vehicle identifier of the remote vehicle 1606. For example, the link command message may not include the consist identifier of the vehicle consist 1602.

The link command message optionally can include an orientation identification of the remote vehicle 1606. The orientation identification indicates the orientation of the remote vehicle 1606 relative to the controlling vehicle 1604. For example, the vehicles 1604, 1606 may be facing different directions, which can be referred to as "short hood forward," "long hood forward," forward, backward, or the like. Depending on whether the remote vehicle 1606 that is to be communicatively linked with the controlling vehicle 1604 is facing the same or opposite direction of the controlling vehicle 1604, operational settings that are communicated to the remote vehicle 1606 by operational command messages from the controlling vehicle 1604 may be implemented differently. For example, the direction in which the remote vehicle 1606 is to rotate wheels of the remote vehicle 1606 may change based on whether the remote vehicle 1606 is facing the same or opposite direction of the controlling vehicle 1604 to avoid stretching or compressing the vehicle consist 1602. The link command message can include the orientation of the remote vehicle 1606 relative to the controlling vehicle 1602 so that an operator does not need to travel to the remote vehicle 1606 and manually provide this information onboard the remote vehicle 1606.

At 1708, a communication link between the remote vehicle 1606 and the controlling vehicle 1604 is established. As described above, because the link command message includes the correct identifying information, the remote vehicle 1606 that received and examined the identifying information can be communicatively linked with the controlling vehicle 1604 to be remotely controlled by the controlling vehicle 1604 without an operator having to travel to and go onboard the remote vehicle 1606. The examination of the link command message and the establishment of the communication link at 1706 and 1708 can be performed for each of the remote vehicles 1606 (or at least one or more of the remote vehicles 1606) that is included in the vehicle consist 1602.

At 1710, the remote vehicle 1606 that is communicatively linked with the controlling vehicle 1604 operates according to operational command messages communicated from the controlling vehicle 1604. For example, the controlling vehicle 1604 may broadcast operational command messages that include operational settings (e.g., throttle settings, brake settings, or the like) for the remote vehicles 1606 in the vehicle consist 1602. The operational command messages may be received by remote vehicles 1606 that are included in the vehicle consist 1602 and by other remote vehicles that are not included in the vehicle consist 1602. The remote vehicles 1606 that are in the vehicle consist 1602 are communicatively linked with the controlling vehicle 1604 and use the operational settings in the received operational command messages to control movement of the remote vehicles 1606. The remote vehicles that are not in the vehicle consist 1602 are not communicatively linked with the controlling vehicle 1604 and disregard the operational command messages.

In one embodiment, an operator onboard the controlling vehicle 1604 may initiate a test message to verify that the remote vehicles 1606 are communicatively linked with the controlling vehicle 1604 prior to the controlling vehicle 1604 remotely controlling movement of the remote vehicles 1606. For example, the controlling vehicle 1604 may reduce fluid pressure in a brake system of the vehicle system (e.g., reduce the air pressure in an air brake pipe). This reduction in fluid can propagate through one or more conduits to the brake pipes in the remote vehicles 1606. The remote vehicles 1606 can communicate the reduction in pressure in the brake pipes and/or the rate at which fluid (e.g., air) is flowing through the brake pipes to the controlling vehicle 1604. The controlling vehicle 1604 can use the communicated reduction in pressure and/or airflow from the remote vehicles 1606 as confirmation that the remote vehicles 1606 are communicatively linked with the controlling vehicle 1604. If no such reduction in pressure and/or airflow from a remote vehicle 1606 is received at the controlling vehicle 1604, then the controlling vehicle 1604 can determine that the remote vehicle 1606 is not communicatively linked with the controlling vehicle 1604. Alternatively, the test message may be initiated automatically (e.g., without operator action). For example, following an attempted linking of the controlling and remote vehicles, the control unit 1502 and/or communication unit 1510 can automatically direct the brake system to reduce the fluid pressure as the test message.

Returning to the description of the determination made at 1706, if the link command message does not include the correct identifying information, then flow of the method 1700 proceeds to 1716. At 1716, a communication link is not established between the remote vehicle (that received the link command message having the incorrect identifying information) and the controlling vehicle 1604. For example, because the remote vehicle is not in the vehicle consist 1602, the remote vehicle may have a different vehicle identifier and/or consist identifier that does not match the identifying information in the link command message. Thus, the remote vehicle 1606 is not communicatively linked with the controlling vehicle 1604.

At 1714, the remote vehicle disregards operational command messages received from the controlling vehicle 1604. For example, because the link command message did not include identifying information that corresponded to the remote vehicle, the remote vehicle disregards operational command messages received from the controlling vehicle 1604.

As described herein, the method 1700 may be used to establish communication links between the vehicles 1604, 1606 in the vehicle consist 1602 without an operator having to travel to and board the remote vehicles 1606. In another embodiment, however, the vehicles 1604, 1606 can be communicatively linked with a process that involves the operator traveling to the remote vehicles 1606. The method 1700 can save time in setting up the vehicle consist 1602 by potentially eliminating the need for an operator to travel to and board the remote vehicles 1606 to set up the remote vehicles 1606 for DP operations. Additionally, the method 1700 can reduce human error by reducing the number of times that the operator has to enter the identifying information into control units, memories, or the like, of the vehicles 1604, 1606. Human error of this type can result in communication link failures and additional time required to diagnose the failures and then to properly set up the vehicles 1604, 1606.

Figure 18:
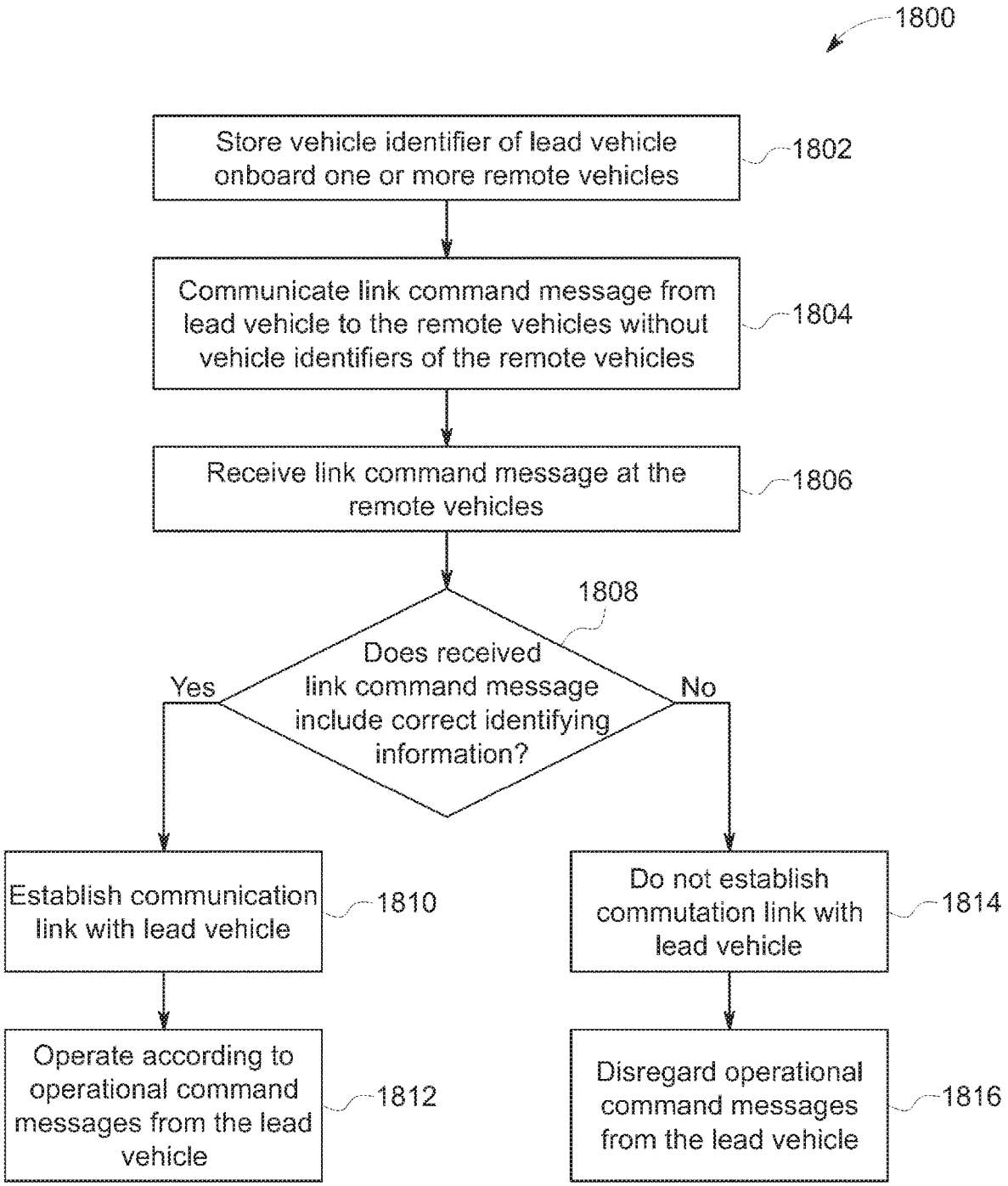
FIG. 18 illustrates a flowchart of another embodiment of a method for communicatively coupling vehicles in the vehicle consist shown in FIG. 16.

FIG. 18 illustrates a flowchart of another embodiment of a method 1800 for communicatively coupling vehicles 1604, 1606 in the vehicle consist 1602 shown in FIG. 16. The method 1800 may be used to establish communication links between the vehicles 1604, 1606 so that the controlling vehicle 1604 can coordinate tractive efforts and/or braking efforts provided by the vehicles 1606. For example, the method 1800 may be used to set up the vehicles 1604, 1606 to operate in the DP mode.

At 1802, a vehicle identifier of the controlling vehicle 1604 is provided to one or more (or all) of the remote vehicles 1606. For example, an operator can travel to and go onboard the remote vehicles 1606 and input the vehicle identifier of the controlling vehicle 1604 into control units, memories, or the like, of the remote vehicles 1606. The remote vehicles 1606 can store the vehicle identifier in the onboard memories, control units, or the like. Alternatively, the vehicle identifier of the controlling vehicle 1604 may be communicated to the remote vehicles 1606, such as by communicating the vehicle identifier via, over, through, or otherwise using one or more conductive pathways that connect the controlling vehicle 1604 and the remote vehicles 1606 (e.g., a multiple unit cable, train line, brake line, or other cable or bus) or wirelessly communicating the vehicle identifier. The vehicle identifier of the controlling vehicle 1604 that is provided to the remote vehicle 1606 can be referred to as a stored vehicle identifier, a designated vehicle identifier, a controlling vehicle identifier, or the like. Optionally, the vehicle identifier may be automatically communicated to the remote vehicles 1606, such as by the control unit and/or communication unit sending the vehicle identifiers without any action on the part of the operator.

At 1804, a link command message is communicated to the remote vehicles 1606. The link command message may be broadcast from the controlling vehicle 1604 to the remote vehicles 1606. Alternatively, the link command message may be communicated from another source, such as a tower, a dispatch center, a remote control device (e.g., an operator control unit), or the like. The link command message can be wirelessly transmitted and/or broadcast. Prior to communicating the link command message, the vehicles 1604, 1606 may not be communicatively coupled. For example, the vehicles 1606 may not be set up to operate according to operational command messages received from the controlling vehicle 1604. The link command message includes the vehicle identifier of the controlling vehicle 1604. For example, in contrast to the link command message communicated at 1702 in the flowchart of the method 1700 shown in FIG. 17, the link command message that is communicated to the remote vehicles 1606 at 1404 may include the vehicle identifier of the controlling vehicle 1604, but not of the remote vehicles 1606.

At 1806, the link command message is received at the remote vehicles 1606. As described above, the link command message may be received by the remote vehicles 1606 that are to be included in the vehicle consist 1602 and one or more other remote vehicles that are not to be included in the vehicle consist 1602.

At 1808, the link command message is examined to determine if the link command message includes correct identifying information. For example, in response to receiving the link command message at a remote vehicle 1606, the remote vehicle 1606 can parse the link command message to determine if the link command message includes the vehicle identifier of the controlling vehicle 1604. The vehicle identifier that is included in and/or received at the remote vehicle 1606 via the link command message may be referred to as a received vehicle identifier.

The remote vehicle 1606 can compare the received vehicle identifier from the link command message with the stored vehicle identifier that previously was provided to the remote vehicle 1606 at 1802. If the received vehicle identifier and the stored vehicle identifier represent the same controlling vehicle 1604, then the remote vehicle 1606 can determine that the remote vehicle 1606 can communicatively link with the controlling vehicle 1604 to receive operational command messages from the controlling vehicle 1604. As a result, flow of the method 1800 can proceed to 1810. On the other hand, if the received vehicle identifier does not match the stored vehicle identifier, then the remote vehicle 1606 can determine that the remote vehicle 1606 cannot communicatively link with the controlling vehicle 1604 to receive operational command messages from the controlling vehicle 1604. Thus, flow of the method 1800 can proceed to 1814. The determination performed at 1808 can be performed onboard each of the remote vehicles 1606 without an operator being onboard the remote vehicles 1606. For example, after the stored vehicle identifier is provided to the remote vehicles 1606, the operator can return to the controlling vehicle 1604 to cause the controlling vehicle 1604 to communicate the link command message while the operator remains onboard the controlling vehicle 1604 and/or does not go back onboard one or more of the remote vehicles 1606.

At 1810, a communication link between the remote vehicle 1606 and the controlling vehicle 1604 is established. The examination of the link command message and the establishment of the communication link at 1808 and 1810 can be performed for each of the remote vehicles 1606 (or at least one or more of the remote vehicles 1606) that is included in the vehicle consist 1602. At 1416, the remote vehicle 1606 that is communicatively linked with the controlling vehicle 1604 operates according to operational command messages communicated from the controlling vehicle 1604. For example, the controlling vehicle 1604 may broadcast operational command messages that include operational settings (e.g., throttle settings, brake settings, or the like) for the remote vehicles 1606 in the vehicle consist 1602. The operational command messages may be received by remote vehicles 1606 that are included in the vehicle consist 1602 and by other remote vehicles that are not included in the vehicle consist 1602. The remote vehicles 1606 that are in the vehicle consist 1602 are communicatively linked with the controlling vehicle 1604 and use the operational settings in the received operational command messages to control movement of the remote vehicles 1606. The remote vehicles that are not in the vehicle consist 1602 are not communicatively linked with the controlling vehicle 1604 and disregard the operational command messages.

In one embodiment, an operator onboard the controlling vehicle 1604 may initiate a test message to verify that the remote vehicles 1606 are communicatively linked with the controlling vehicle 1604 prior to the controlling vehicle 1604 remotely controlling movement of the remote vehicles 1606. For example, the controlling vehicle 1604 may reduce fluid pressure in a brake system of the vehicle system (e.g., reduce the air pressure in an air brake pipe). This reduction in fluid can propagate through one or more conduits to the brake pipes in the remote vehicles 1606. The remote vehicles 1606 can communicate the reduction in pressure in the brake pipes and/or the rate at which fluid (e.g., air) is flowing through the brake pipes to the controlling vehicle 1604. The controlling vehicle 1604 can use the communicated reduction in pressure and/or airflow from the remote vehicles 1606 as confirmation that the remote vehicles 1606 are communicatively linked with the controlling vehicle 1604. If no such reduction in pressure and/or airflow from a remote vehicle 1606 is received at the controlling vehicle 1604, then the controlling vehicle 1604 can determine that the remote vehicle 1606 is not communicatively linked with the controlling vehicle 1604. Alternatively, the test message may be initiated automatically, as described herein.

Returning to the description of the determination made at 1808, if the received vehicle identifier and the stored vehicle identifier do not represent the controlling vehicle 1604 (e.g., if the received vehicle identifier does not match or otherwise correspond with the stored vehicle identifier), then flow of the method 1800 proceeds to 1814. At 1814, a communication link is not established between the remote vehicle (that received the link command message having the received vehicle identifier that does not match or otherwise correspond with the stored vehicle identifier) and the controlling vehicle 1604. For example, because the remote vehicle is not in the vehicle consist 1602, the remote vehicle may have a different stored vehicle identifier than the vehicle identifier in the link command message. As a result, the remote vehicle 1606 is not communicatively linked with the controlling vehicle 1604.

At 1816, the remote vehicle disregards operational command messages received from the controlling vehicle 1604. For example, because the link command message did not include the vehicle identifier that matches the stored vehicle identifier, the remote vehicle disregards operational command messages received from the controlling vehicle 1604.

As described herein, the method 1800 can reduce human error by reducing the number of times that the operator has to enter the identifying information into control units, memories, or the like, of the vehicles 1604, 1606. Human error of this type can result in communication link failures and additional time required to diagnose the failures and then to properly set up the vehicles 1604, 1606.

Figure 19A:
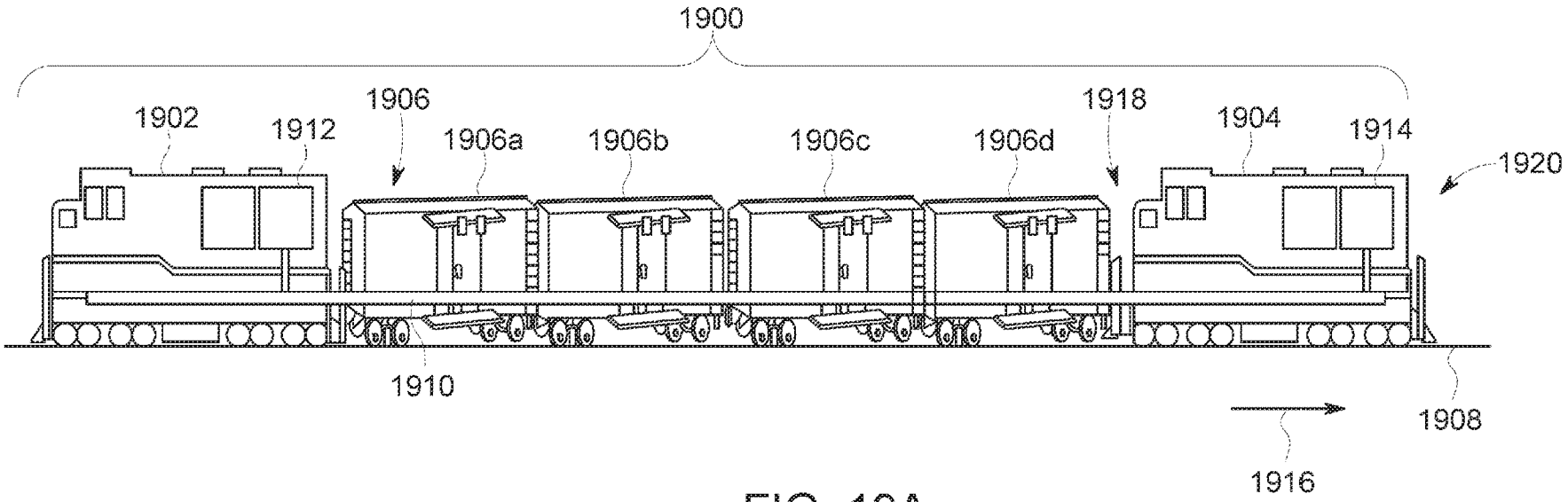
FIG. 19A is a schematic view of one embodiment of a vehicle consist that includes a controlling vehicle and a remote vehicle oriented to face the controlling vehicle.

FIG. 19A is a schematic view of one embodiment of a vehicle consist 1900. The illustrated vehicle consist 1900 includes propulsion-generating vehicles 1902, 1904 and non-propulsion-generating vehicles 1906 (e.g., vehicles 1906A-D) mechanically coupled with each other. The propulsion-generating vehicles 1902, 1904 are capable of self-propulsion while the non-propulsion-generating vehicles 1906 are not capable of self-propulsion. The propulsion-generating vehicles 1902, 1904 are shown as locomotives, the non-propulsion-generating vehicles 1906 are shown as rail cars, and the vehicle consist 1900 is shown as a train in the illustrated embodiment. Alternatively, the vehicles 1902, 1904 may represent other vehicles, such as automobiles, marine vessels, or the like, and the vehicle consist 1900 can represent a grouping or coupling of these other vehicles. The number and arrangement of the vehicles 1902, 1904, 1906 in the vehicle consist 1900 are provided as one example and are not intended as limitations on all embodiments of the inventive subject matter described herein.

The vehicles 1902, 1904 can be arranged in a distributed power (DP) arrangement. For example, the vehicles 1902, 1904 can include a controlling vehicle 1902 that issues command messages to the other vehicles 1904, which are referred to herein as remote vehicles. The designations "controlling" and "remote" are not intended to denote spatial locations of the vehicles 1902, 1904 in the vehicle consist 1900, but instead are used to indicate which vehicle 1902, 1904 is communicating (e.g., transmitting, broadcasting, or a combination of transmitting and broadcasting) operational command messages and which vehicles 1902, 1904 are being remotely controlled using the operational command messages. For example, the controlling vehicle 1902 may or may not be disposed at the front end of the vehicle consist 1900 (e.g., along a direction of travel of the vehicle consist 1900). Additionally, the remote vehicle 1904 need not be separated from the controlling vehicle 1902. For example, the remote vehicle 1904 may be directly coupled with the controlling vehicle 1902 or may be separated from the controlling vehicle 1902 by one or more other remote vehicles 1904 and/or vehicles 1906.

The operational command messages may include directives that direct operations of the remote vehicle 1904. These directives can include propulsion commands that direct propulsion systems of the remote vehicle 1904 to move in a designated location, at a designated speed, and/or power level, brake commands that direct the remote vehicles to apply brakes at a designated level, and/or other commands. The controlling vehicle 1902 issues the command messages to coordinate the tractive efforts and/or braking efforts provided by the vehicles 1902, 1904 to propel the vehicle consist 1900 along a route 1908, such as a track, road, waterway, or the like.

The vehicle consist 1900 includes a fluid conduit 1910 extending along a length of the vehicle consist 1900. In one embodiment, the fluid conduit 1910 extends through at least parts of the propulsion-generating vehicles 1902, 1904. The fluid conduit 1910 can continuously extend through all the propulsion-generating vehicles 1902, 1904 in the vehicle consist 1900, or through less than all the propulsion-generating vehicles 1902, 1904. The fluid conduit 1910 can represent a brake pipe, such as an air brake pipe, or another conduit. For example, the fluid conduit 1910 can hold air that is stored in the conduit 1910 to prevent brake systems (described below) of the vehicles 1902, 1904 from engaging when the pressure of the air in the conduit 1910 is sufficiently large. But, when the pressure in the conduit 1910 falls below a designated threshold, the brake systems of the vehicles 1902, 1904 engage to slow or stop movement of the vehicle consist 1900. The fluid (e.g., air or other fluid) may be added to the conduit 1910 by a fluid source 1912. The fluid source 1912 may be a pump, reservoir, and/or the like, that supplies the fluid to the conduit 1910. The fluid source 1912 is shown as being disposed onboard the controlling vehicle 1902, but optionally may be disposed in another location of the vehicle consist 1900.

During set up of the vehicles 1902, 1904 for operation as the vehicle consist 1900, brake systems of the vehicle consist 1900 may be tested by reducing the fluid pressure in the conduit 1910 to see if the brake systems onboard the vehicles 1902, 1904 are engaged. The fluid source 1912 may then be activated to at least partially fill the conduit 1910 with fluid (e.g., air). As the conduit 1910 is at least partially filled with fluid, the fluid may flow from the fluid source 1912 along the length of the conduit 1910.

The flow of this fluid in the conduit 1910 may be sensed by one or more sensor assemblies 1914 in one or more of the remote vehicles 1904. The sensor assembly 1914 can detect which direction the fluid is flowing in the conduit 1910 within the remote vehicle 1904. Based on this direction, the remote vehicle 1904 can determine the orientation of the remote vehicle 1904. For example, in the illustrated embodiment, the sensor assembly 1914 can detect that the fluid is flowing in the conduit 1910 in a direction 1916 that points from a front end 1918 of the remote vehicle 1904 toward an opposite, back end 1920 of the remote vehicle 1904. A control unit (described below) of the remote vehicle 1904 can determine, based at least in part on this detected fluid flow, that the front end 1918 of the remote vehicle 1904 is facing the controlling vehicle 1902 and/or that the back end 1920 of the remote vehicle 1904 is facing away from the controlling vehicle 1902. The control unit of the remote vehicle 1904 may be programmed with the orientation of the controlling vehicle 1902 (e.g., which direction the front end and/or back end of the controlling vehicle 1902 is facing) so that the control unit can automatically determine the orientation of the remote vehicle 1904 relative to the controlling vehicle 1902 based at least in part on the direction of fluid flow in the conduit 1910. In the illustrated embodiment, the control unit can determine that the controlling vehicle 1902 and the remote vehicle 1904 are facing the same direction.

Figure 19B:
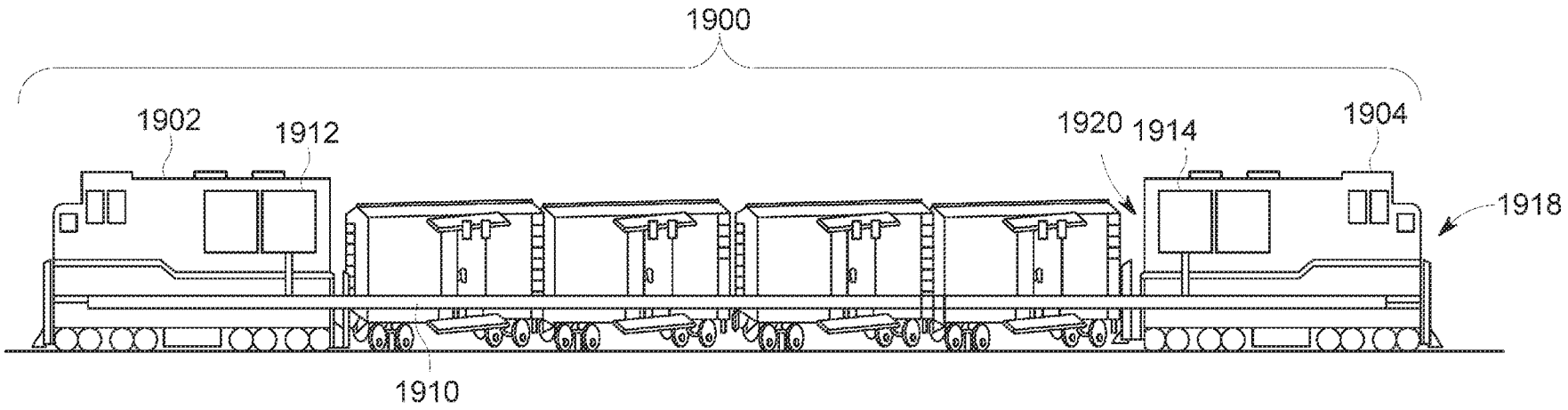
FIG. 19B is a schematic view of one embodiment of a vehicle consist that includes a controlling vehicle and a remote vehicle oriented to face away from the controlling vehicle.

FIG. 19B is a schematic view of another embodiment of the vehicle consist 1900. In contrast to the embodiment shown in FIG. 19A, the vehicle consist 1900 in FIG. 19B includes the remote vehicle 1904 facing in an opposite direction (e.g., away from the controlling vehicle 1902). As the fluid source 1912 at least partially fills the conduit 1910 with fluid, the fluid may flow from the fluid source 1912 along the length of the conduit 1910 toward the remote vehicle 1904.

The flow of the fluid in the conduit 1910 is sensed by the sensor assembly 1914 in the remote vehicle 1904. Based on this direction, the remote vehicle 1904 can determine the orientation of the remote vehicle 1904. In the illustrated embodiment, the sensor assembly 1914 can detect that the fluid is flowing in the conduit 1910 in the direction 1916 that now points from the back end 1920 of the remote vehicle 1904 toward the front end 1918 of the remote vehicle 1904. While the fluid may flow in the same direction as in the embodiment shown in FIG. 19A, because the remote vehicle 1904 is facing an opposite direction, the sensor assembly 1914 can determine that the flow of the fluid in the conduit 1910 is in an opposite direction in the remote vehicle 1904 when compared to the orientation shown in FIG. 19A. The control unit of the remote vehicle 1904 may be programmed with the orientation of the controlling vehicle 1902 so that the control unit can automatically determine that the controlling vehicle 1902 and the remote vehicle 1904 are facing opposite directions.

Figure 20:
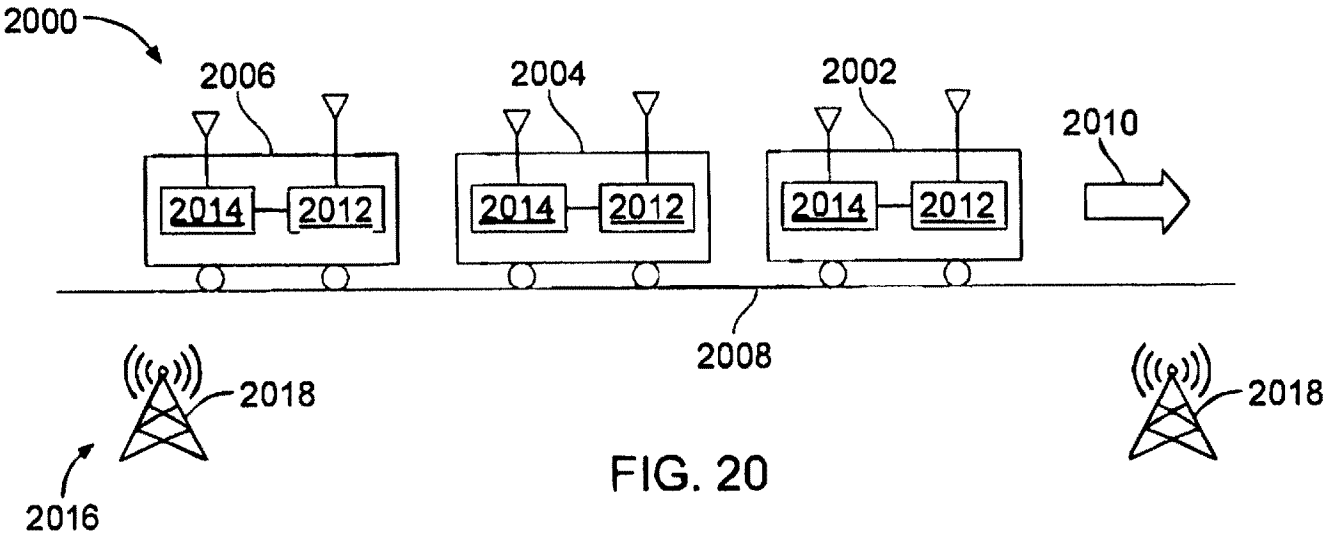
FIG. 20 is a schematic view of another embodiment of the vehicle consist shown in FIG. 25.

FIG. 20 is a schematic diagram of a vehicle system 2000 according to an embodiment. The vehicle system 2000 may be defined or formed by three propulsion-generating vehicles 2002, 2004, 2006, including a first vehicle 2002, a second vehicle 2004, and a third vehicle 2006 that travel with coordinated movements along a route 2008. The second vehicle is disposed between the first and third vehicles. The first vehicle is disposed in front of the other two vehicles relative to a direction of travel 2010 of the vehicle system on the route.

In the illustrated embodiment, the vehicles 2002, 2004, 2006 may be mechanically disconnected from each other, such that the vehicles are not directly or indirectly mechanically coupled or linked. As shown, the vehicles are spaced apart from each other along the length of the route. Because the vehicles are spaced apart and not mechanically connected, tractive efforts or braking efforts of any one of the vehicles do not exert forces on the other vehicles. Instead, the vehicles are logically connected. For example, the vehicles may wirelessly communicate with each other to coordinate the movements of the vehicles with each other so that the vehicles travel together along the route.

The vehicles may be arranged in a distributed power arrangement. For example, the first vehicle 2002 may be designated as a controlling vehicle that issues command messages to the second and third vehicles to control the movement of the second and third vehicles. The second vehicle is referred to herein as a first remote vehicle, and the third vehicle is referred to herein as a second remote vehicle. The vehicle system in the illustrated embodiment may be similar to the vehicle system 102 shown and described with reference to FIG. 1. The controlling vehicle wirelessly communicates the command messages to the remote vehicles via communication links. Prior to the vehicle system traveling along the route with coordinated movements of the vehicles, the communication links between the controlling vehicle and the two remote vehicles must be established.

To establish the communication links between the controlling vehicle and the remote vehicles, the controlling vehicle may wirelessly communicate a linking message to each of the remote vehicles. In an embodiment, the linking message communicated to the first remote vehicle is a first linking message, and a different, second linking message is communicated to the second remote vehicle. The first linking message includes a vehicle identifier (e.g., a first vehicle identifier) that is uniquely associated with the first remote vehicle. The second linking message includes a vehicle identifier (e.g., a second vehicle identifier) that is uniquely associated with the second remote vehicle. For example, the vehicle identifiers may be road identification numbers (e.g., road IDs), vehicle identification numbers (VINs), registration numbers, license plate numbers, or the like. Each identifier is uniquely associated with only one corresponding vehicle, such that the identifier may not be associated with or otherwise identify other remote vehicles. Optionally, instead of communicating two different linking messages to the remote vehicles, the controlling vehicle may communicate a single linking message that includes both the vehicle identifier associated with the first remote vehicle and the vehicle identifier associated with the second remote vehicle. The linking messages may be generated to omit any vehicle identifiers that are associated with vehicles other than the specific remote vehicles currently arranged as components of the vehicle system.

At the remote vehicle that receives linking message, if the vehicle identifier in the linking message matches, is associated with, or otherwise identifies the remote vehicle, then the remote vehicle may communicate a linking confirmation message back to the controlling vehicle. This linking confirmation message may be wirelessly communicated to the controlling vehicle. The communication link between the controlling vehicle and each of the remote vehicles may be established responsive to the linking message being received by the remote vehicle and the confirmation message communicated by the remote vehicle being received by the controlling vehicle. Alternatively, the communication link between the controlling and each of the remote vehicles may be established once the linking message is received at the remote vehicle, without requiring a linking confirmation message received back at the controlling vehicle.

In contrast to some known systems, operators are not required to enter onboard the remote vehicles or otherwise be present at the remote vehicles to identify these remote vehicles to the controlling vehicle. Instead, the remote vehicles according to embodiments described herein can be identified by a separate system such that the operators do not need to be present at the remote vehicles to determine which remote vehicles are in the vehicle consist. Thus, communication links between the controlling and remote vehicles may be established without requiring operators to enter onboard the remote vehicles. In addition, embodiments described herein may enable automated identification of the remote vehicles to the controlling vehicle. For example, the separate system may automatically communicate the vehicle identifiers associated with the specific remote vehicles in the vehicle system to the controlling vehicle. Thus, the communication links between the controlling and remote vehicles may be established without requiring operators to manually enter or input data that identifies the remote vehicles, such as the vehicle identifiers, into a computer or other input device. For example, according to at least one embodiment, the communication links between the controlling and remote vehicles may be established upon detecting a single input selection or actuation of an input device operably connected to the controlling vehicle, such as a single push of a button. Consequently, considerable time and effort can be saved by not requiring the operators to enter onboard the remote vehicles or manually enter data into the computing hardware of the vehicle system.

The vehicles in the vehicle system may be rail vehicles, on-road vehicles, off-road vehicles, water-based vehicles, or the like. For example, the vehicles may be locomotives and the route may be a railroad track. In another example, the vehicles may be automobiles or trucks that are configured to drive on roadways, such as public highways and streets. In yet another example, the vehicles may be off-road trucks, such as mining trucks, construction vehicles, or the like, that are not designated and/or permitted for driving on public roadways.

Each of the vehicles may include a respective first vehicle control system 2012 and a second vehicle control system 2014. The DP command messages are communicated using the first vehicle control systems of the vehicles. For example, the first vehicle control system of the controlling vehicle may wirelessly communicate a command message to the first and second remote vehicles. The command message may include a specific tractive setting or brake setting to be applied by the remote vehicles at a designated time or location. The first vehicle control systems of the remote vehicles may control the movement of the remote vehicles to implement the specific tractive setting or brake setting received in the command message. Thus, the first vehicle control systems are configured to provide intra-vehicle system communications for coordinating control of the vehicle system.

The second vehicle control systems 2014 may be configured to communicate with off-board systems, and may control movement of the vehicle system based on information received from the off-board systems. The second vehicle control system is configured to restrict movement of the vehicles based at least in part on the location of the vehicles along the route, such as the location relative to localities, other vehicle systems, route segments or blocks, work zones, speed restricted zones, and/or the like. In an embodiment, the second vehicle control system on each vehicle may be a positive train control (PTC) system. The second vehicle control systems in FIG. 20 are configured to receive information from an off-board signaling system 2016 that includes wayside devices 2018 disposed proximate to the route. The wayside devices 2018 may be transponders or beacons that wireless communicate with the vehicles via the second vehicle control systems. The wayside devices 2018 may be disposed at predetermined locations along the route, such as at regular intervals, at the junctions between block segments, at terminals or stations (e.g., for departures and/or arrivals), and/or the like.

According to an embodiment, the controlling vehicle may automatically determine the vehicle identifiers for the remote vehicles in the vehicle system by receiving the vehicle identifiers from the second vehicle control system on one or more of the vehicles. For example, the second vehicle control system 2014 may communicate a list of plural vehicle identifiers to the first vehicle control system 2012. The particular vehicle identifiers of the first and second remote vehicles may be included in the list. Prior to communicating the list to the first vehicle control system, the second vehicle control system may receive the list from at least one of the off-board systems, such as the signaling system 2016. Optionally, the second vehicle control system may communicate with the first vehicle control system to convey additional information besides the vehicle identifiers. For example, information about the vehicle system and the remote vehicles thereof can be determined and/or confirmed by the second vehicle control system, as described herein.

Figure 21:
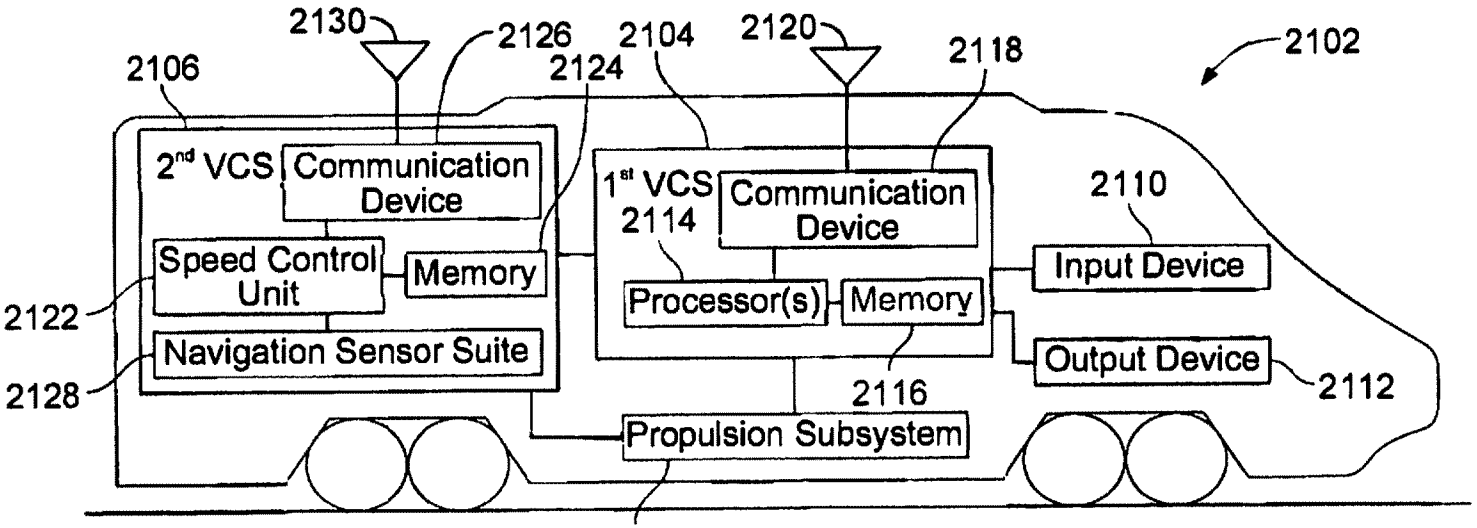
FIG. 21 is a schematic diagram of a vehicle system according to an embodiment.

FIG. 21 is a schematic diagram of a propulsion-generating vehicle 2102 according to an embodiment. The vehicle 2102 may be one of the vehicles 2002, 2004, 2006 of the vehicle system 2000 shown in FIG. 20. For example, the vehicle 2102 may be the controlling vehicle 2002. The vehicle 2102 may include a first vehicle control system 2104, a second vehicle control system 2106, a propulsion subsystem 2108, an input device 2110, and an output device 2112.

The propulsion subsystem 2108 provides tractive effort and/or braking effort of the propulsion-generating vehicle. The propulsion subsystem may include or represent one or more engines, motors, alternators, generators, brakes, batteries, turbines, and the like, that operate to propel the vehicle under the manual or autonomous control that is implemented by first vehicle control system 2104 and/or the second vehicle control system 2106. For example, either of the control systems 2104, 2106 can generate control signals that are used to autonomously direct operations of the propulsion subsystem, and therefore control movement of the vehicle.

The input device 2110 and the output device 2112 are operably coupled to the first vehicle control system 2104. The input device may include or represent a touchscreen, keyboard, electronic mouse, joystick, handheld controller, microphone, or the like. The first vehicle control system can receive manual input from an operator of the propulsion-generating vehicle through the input device. For example, the control unit 402 can receive manually input changes to the tractive effort, braking effort, speed, power output, and the like, from the input device. The control unit may receive a single instance of an actuation of the input device to initiate the establishment of communication links between the controlling and remote vehicles in the vehicle system. For example, instead of having one or more operators go onboard controlling and remote vehicles of a consist to establish communication links for the remote control of the remote vehicles by the controlling vehicles, an operator may go onboard the controlling vehicle and press a single button or other input device one time to cause the controlling vehicle to communicate linking messages to the remote vehicles to establish the communication links. The output device may include or represent a display screen, such as a monitor, that provides a visual user interface to the operator at the controlling vehicle. The output device optionally may include other components, such as audio speakers, haptic or vibration elements, or the like.

The first vehicle control system may include one or more processors 2114, a memory storage device 2116 (referred to herein as memory) operably connected to the one or more processors, and a communication device 2118 operably connected to the one or more processors. Although the one or more processors 2114, the memory 2116, and the communication device 2118 are shown in FIG. 21 commonly disposed within a box representing the first vehicle control system, one or more of these components may be physically spaced apart from each other. For example, the box representing the first vehicle control system may indicate a group and may not represent a physical housing that commonly houses the components together.

The one or more processors 2114 may be the same or similar to the control unit 402 shown in FIG. 3. For example, the one or more processors may control operations of the vehicle. The one or more processors can include or represent one or more hardware circuits or circuitry that include, are connected with, or that both include and are connected with one or more, processors, controllers, or other hardware logic-based devices. The processors may operate based on program instructions (e.g., software) stored within the memory. The memory 2116 may be the same or similar to the memory 412 shown in FIG. 3. The memory can represent an onboard device that electronically and/or magnetically stores data. For example, the memory may represent a computer hard drive, random access memory, read-only memory, dynamic random access memory, an optical drive, or the like.

The communication device 2118 may be the same or similar to the communication unit 410 shown in FIG. 3. For example, the communication device includes or represents hardware and/or software that is used to communicate with other vehicles in the vehicle system, such as the remote vehicles in the DP arrangement. The communication device may include a transmitter and receiver or an integrated transceiver, an antenna 2120, and associated circuitry for wirelessly communicating (e.g., communicating and/or receiving) linking messages, command messages, linking confirmation messages, reply messages, retry messages, repeat messages, or the like. Optionally, the communication device includes circuitry for communicating the messages over a wired connection, such as an electric multiple unit (eMU) line, a catenary or third rail of an electrically powered route, or another conductive pathway between or among the propulsion-generating vehicles. The one or more processors may control the communication device by activating the communication device.

The second vehicle control system 2106 may include a speed control unit 2122, a memory storage device (i.e., memory) 2124, a communication device 2126, and a navigation sensor suite 2128. The speed control unit includes one or more processors that operate based on program instructions stored in the memory 2124. The communication device 2126 may be similar to the communication device 2118. For example, the communication device 2126 may include a transmitter and receiver or an integrated transceiver, an antenna 2130, and associated circuitry for wirelessly communicating (e.g., communicating and/or receiving) with other vehicles and/or off-board systems, such as the signaling system 2016 and the wayside devices 2018 thereof shown in FIG. 20. The navigation sensor suite 2128 may include one or more sensors that are configured to generate operating parameters of the vehicle and/or location information of the vehicle. For example, the sensors in the suite may include a global positioning system (GPS) device, a magnetometer or digital compass, a speed sensor, an inertial sensor, and/or the like.

In an embodiment, the second vehicle control system 2106 is a positive train control (PTC) system and is referred to herein as a PTC system. The PTC system is configured to track the location of the vehicle along a route and automatically enforce any speed or movement restrictions based on the location of the vehicle. The PTC system may automatically prevent unwarranted movement of the vehicle system based on travel restriction information received from an off-board system, such as the wayside signaling system 2016. For example, the PTC system determines the current location and speed of the vehicle system, compares the location and speed to a speed limit or other movement restriction that is associated with the current location of the vehicle along the route, and determines if speed adjustment or other movement adjustment is necessary based on the comparison. The travel restriction information may include upper speed limits, lower speed limits, identification of restricted areas into which the vehicle system is not permitted to enter, identification of permitted areas which the vehicle system is not permitted to leave, and/or the like. The restricted areas may represent locations of vehicle collisions, route maintenance or other work zones, quiet zones, or the like. The travel restrictions may be dynamically updated and received by the communication device of the PTC system from the wayside devices. The travel restrictions may be stored in the memory of the PTC system.

In response to determining that the vehicle system is in violation of a travel restriction, the speed control unit of the PTC system automatically communicates a command message to modify the movement of the vehicle system. For example, upon determining that the vehicle is traveling in excess of an upper speed limit along a designated area of the route, the PTC system may automatically control the propulsion subsystem to slow the speed of the vehicle to a speed below the upper speed limit. The PTC system may also communicate these commands to the other vehicles in the vehicle system to enable the vehicle system to slow down in a coordinated manner. Based on the travel restrictions and movement authorities, the PTC system may be configured to prevent the vehicle system from entering a designated restricted area, prevent the vehicle system from exiting a designated permitted area, prevent the vehicle system from traveling faster than an upper speed limit associated with the location of the vehicle system, prevent the vehicle system from traveling slower than a lower speed limit associated with the location of the vehicle system, and/or the like.

In a non-limiting example, the communication device 2126 of the PTC system may receive PTC status messages as the vehicle system travels along the route. The PTC status messages are received from off-board systems, such as wayside devices of a signaling system. The PTC status messages may include various information, such as the current location of the vehicle system (e.g., either absolute location or relative to a reference point such as a destination), enforceable travel restrictions along the upcoming section or sections of the route (e.g., speed limits or the like), information about the vehicles in the vehicle system (e.g., including vehicle identifiers associated with the vehicles), and/or the like. The information from the PTC status messages may be stored in the memory 2124. The memory may also store a route database that provides information about the route, such as grade, speed limits, etc. The information received in the PTC status messages may be used to update the route database in the memory to reflect current, up-to-date travel conditions. The PTC status messages may be wirelessly received over a wireless network provided by the wayside devices.

As the vehicle system travels, the PTC system may monitor the speed of the vehicle system based on speed measurements generated by a speed sensor of the navigation sensor suite 2128. The PTC system also monitors the location of the vehicle system along the route. The location may be determined by a GPS device of the sensor suite based on data received from a one or more satellites. Alternatively, the location may be determined based on monitored proximity of the vehicle system to known reference points, such as the wayside devices of the signaling system at designated locations. Furthermore, the speed of the vehicle system may be determined by measuring the time it takes for the vehicle system to travel a designated distance and/or by measuring the distance traveled in a designated amount of time, instead of relying on a speed sensor. The speed control unit of the PTC system may autonomously adjust the movement of the vehicle system in response to determining that the vehicle system does, or will, violate at least one of the travel restrictions to cause the vehicle system to stop violating, or prevent the vehicle system from violating, the travel restrictions.

In an embodiment, the PTC system 2106 on the controlling vehicle 2102 may determine the movement adjustments to be made based on the travel restrictions along the route. The PTC system on the controlling vehicle may communicate with the remote vehicles of the vehicle system to coordinate movements by utilizing the communication device 2118 of the first vehicle control system 2104. For example, the communication device 2118 may communicate with the remote vehicles via the communications links that are established as described herein. Therefore, the PTC system 2106 may cooperate with the vehicle control system 2104 to autonomously coordinate control of the vehicles in the vehicle system.

Figure 22:
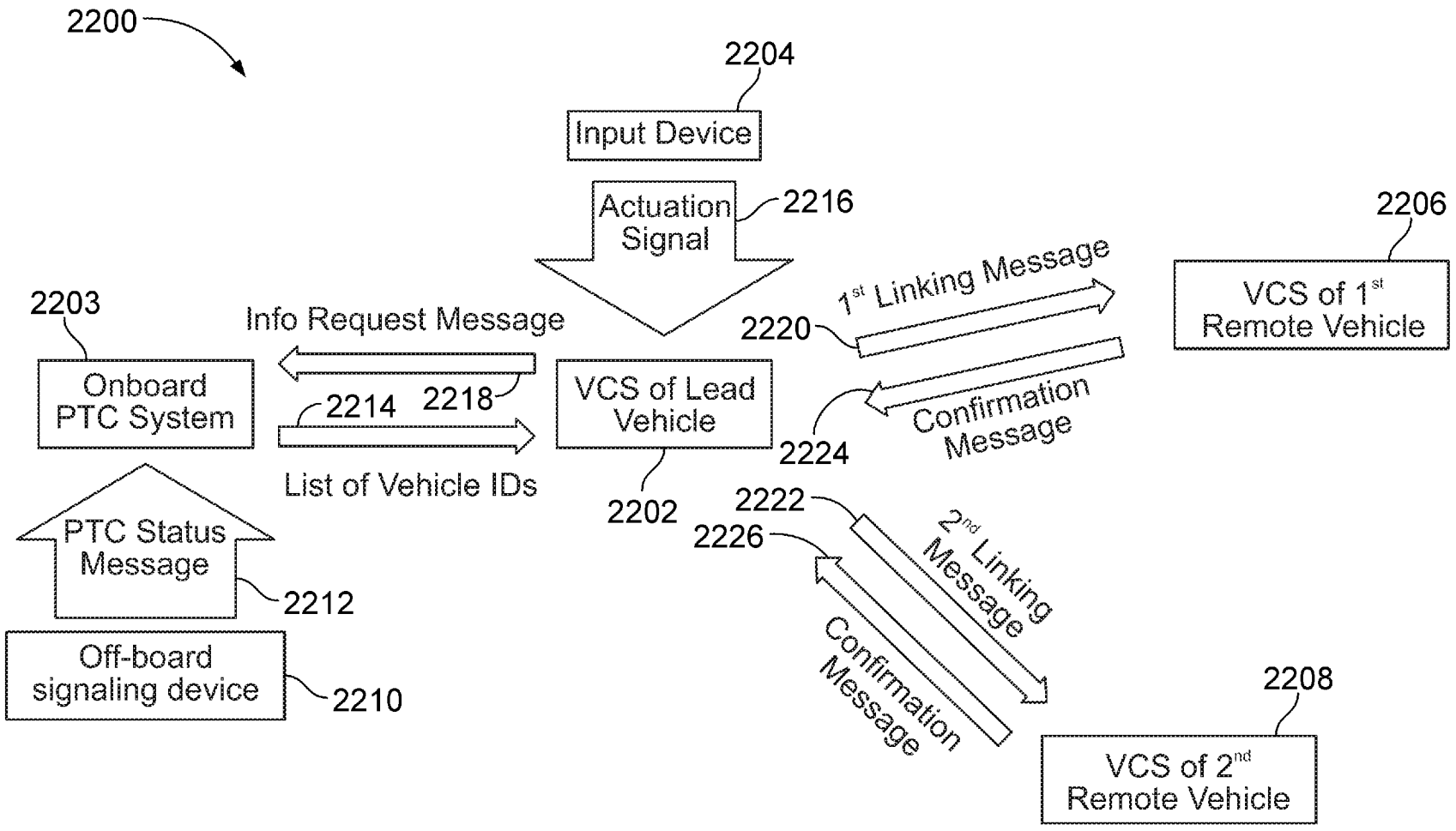
FIG. 22 is a schematic diagram of a propulsion-generating vehicle according to an embodiment.

FIG. 22 is schematic diagram of a communication system 2200 according to an embodiment. The communication system 2200 includes a vehicle control system 2202 of a controlling vehicle, an onboard PTC system 2203, an input device 2204, a vehicle control system 2206 of a first remote vehicle, a vehicle control system 2208 of a second remote vehicle, and an off-board signaling device 2210. The vehicle control system 2202 may represent the first vehicle control system 2104 shown in FIG. 21 and/or the first vehicle control system 2012 of the controlling vehicle 2002 in the vehicle system 2000 shown in FIG. 20. The PTC system 2203 may represent the second vehicle control system 2106 shown in FIG. 21 and/or one or more of the second vehicle control systems 2014 of the vehicles 2002, 2004, 2006 shown in FIG. 20. The input device 2204 may represent the input device 2110 shown in FIG. 21. The vehicle control system 2206 of the first remote vehicle may represent the vehicle control system 2012 of the first remote vehicle 2004 in FIG. 20. The vehicle control system 2208 of the second remote vehicle may represent the vehicle control system 2012 of the second remote vehicle 2006 in FIG. 20. The off-board signaling device 2210 may represent one of the wayside devices 2018 shown in FIG. 20 or a wireless communication device at a station, dispatch facility, or the like.

The diagram in FIG. 22 illustrates a one-button linking procedure according to an embodiment for establishing communication links between the vehicles of a common vehicle system. For example, the controlling vehicle, the first remote vehicle, and the second remote vehicle may represent vehicles of a common vehicle system. The communication links are established for providing distributed power communications and/or other types of communications between the vehicles. Although FIG. 22 illustrates establishing communication links between the controlling vehicle and two remote vehicles, the linking procedure described herein can also be used to establish communication links between the controlling vehicle and other vehicles and equipment, such as additional vehicles of the vehicle system, wayside devices, and/or the like. The PTC system 2203 is onboard the vehicle system and is configured to restrict movement of the vehicle system based at least in part on a location of the vehicle system. The one-button linking procedure is configured to establish communication links between the propulsion-generating vehicles of the vehicle system without requiring operator intervention other than to initiate the procedure.

In the illustrated embodiment, the PTC system 2203 is configured to provide vehicle information to the vehicle control system 2202 of the controlling vehicle that the vehicle control system utilizes to initially contact the remote vehicles for subsequently establishing the communication links. The PTC system onboard the vehicle system may receive the vehicle information from the off-board signaling device or another off-board source. The PTC system may receive the vehicle information within a PTC status message 2212. The vehicle information within the PTC status message 2212 may include the vehicle identifiers uniquely associated with the particular vehicles of the vehicle system. Optionally, the PTC status message may also include additional vehicle information, such as determined orientations of the vehicles, a determined order of the vehicles, determines distances between the vehicles, and/or the like. Besides the vehicle information, the PTC status messages may include additional information, such as trip status information and route information. The trip status information may include a current location of the vehicle system relative to a planned route between a designated departure location and a designated destination location. The route information concerns upcoming sections of the route, such as any updated travel restrictions (e.g., slow orders, modified speed limits, restricted areas, etc.) through the upcoming sections of the route.

The PTC system may provide a list of vehicle identifiers 2214 to the vehicle control system of the controlling vehicle. The list includes the vehicle identifiers associated with the remote vehicles in the vehicle system. The list optionally may also include vehicle identifiers associated with other vehicles that are not in the vehicle system. The vehicle control system of the controlling vehicle may store the vehicle identifiers in a memory of the vehicle control system (e.g., the memory 4016).

The vehicle control system of the controlling vehicle is configured to detect when an operator actuates the input device 2204. For example, the input device is operably coupled to the vehicle control system. In response to the operator actuating the input device, the input device may convey an actuation signal 2216 to the vehicle control system. The actuation of the input device refers to a specific action that is configured to initiate the linking procedure between the vehicles. The action may include or represent pushing a button or key, pressing a virtual button on a touchscreen or a touchpad, flipping a switch, turning a key, rotating a dial, or the like. The actuation signal 2216 may be transmitted in response to a single instance of the operator actuating the corresponding input device or element thereof. For example, a single push of a button designated for initiating the linking procedure may be all that is required to transmit the actuation signal.

In response to receiving the actuation signal and/or detecting the operator actuation of the input device, the vehicle control system of the controlling vehicle is configured to determine whether or not the vehicle control system has received the vehicle identifiers for the remote vehicles in the vehicle system from the PTC system. For example, the vehicle control system may scan the memory of the vehicle control system (e.g., the memory 4016) to search for the vehicle identifiers. If the relevant vehicle identifiers have not been received from the PTC system, the vehicle control system may be configured to communicate a vehicle information request message 2218 to the PTC system. The vehicle information request message prompts the PTC system to send the list of vehicle identifiers 2214 to the vehicle control system. Once the vehicle control system has obtained the vehicle identifiers, either from the local memory or by requesting the PTC system for the list, the vehicle control system is configured to generate and communicate one or more linking messages.

Optionally, the PTC system may provide additional vehicle information to the vehicle control system of the controlling vehicle, such as location parameters of the remote vehicles in the vehicle system, orientation parameters of the remote vehicles in the vehicle system, and the like. For example, the navigation sensor suite 2128 shown in FIG. 21 may include a digital compass or magnetometer that is configured to determine an orientation of the remote vehicles. Optionally, each of the remote vehicles may include a magnetometer mounted onboard. The signals generated by the magnetometer on the first remote vehicle may be transmitted to the PTC system onboard the controlling vehicle either directly or indirectly via other vehicles and/or off-board signaling devices. The PTC system may provide the orientation parameters of the remote vehicles to the vehicle control system with the vehicle identifiers for validating that the remote vehicles are properly oriented (e.g., commonly facing a direction of travel). In another example, the PTC system may provide location parameters of the remote vehicles to the vehicle control system with the vehicle identifiers and/or the orientation parameters. The location parameters may indicate a determined location of each remote vehicle in absolute terms using GPS coordinates or relative to a reference, such as a distance or number of vehicles separating each remote vehicle from a front vehicle in the vehicle system and/or a back vehicle in the vehicle system. The location parameters may be utilized by the vehicle control system to validate a designated vehicle makeup. For example, if the location parameter of a given remote vehicle differs from an intended location of the remote vehicle designated in a trip schedule, the vehicle control system may generate an alert to notify an operator of the discrepancy prior to embarking on the trip.

In an embodiment, the vehicle control system of the controlling vehicle communicates a first linking message 2220 to the vehicle control system 2206 of the first remote vehicle. The first linking message includes the vehicle identifier associated with the first remote vehicle. The vehicle identifier may be a road identification number of the first remote vehicle, a VIN number, a license or registration number, and/or the like. The vehicle control system of the controlling vehicle also communicates a second linking message 2222 to the vehicle control system 2208 of the second remote vehicle. The second linking message includes the vehicle identifier associated with the second remote vehicle. For example, the first linking message may be addressed to the vehicle identifier of the first remote vehicle, and the second linking message may be addressed to the vehicle identifier of the second remote vehicle. The first and second linking messages may be wireless messages that are communicated by the communication devices (e.g., devices 4108) of the respective vehicles using antennas and associated hardware components and circuitry.

In an embodiment, upon receiving the first linking message 2220, the vehicle control system of the first remote vehicle is configured to validate that the vehicle identifier included in the first linking message matches the (known) vehicle identifier of the first remote vehicle. For example, if the vehicle identifier does not match the known identifier of the first remote vehicle, then the linking message may have been sent to the wrong vehicle or the first remote vehicle may be an unintended recipient of the linking message. Upon validating that the vehicle identifier in the first linking message matches the identifier of the first remote vehicle, the vehicle control system of the first remote vehicle may communicate a wireless confirmation message 2224 back to the controlling vehicle. Similarly, the vehicle control system of the second remote vehicle may also communicate a wireless confirmation message 2226 to the controlling vehicle in response to receiving the second linking message 2222 and validating that the vehicle identifier included in the linking message matches the identifier of the second remote vehicle. The confirmation messages may identify the respective vehicle that is the source of the confirmation message. Optionally, the confirmation messages may also provide an indication that the vehicle identifiers matched the recipient vehicles.

In response to receiving each confirmation message, the vehicle control system of the controlling vehicle is configured to establish a communication link with the corresponding remote vehicle that communicated the confirmation message. The linking messages and confirmation messages may represent a bilateral handshake between the vehicle control systems of the vehicles attempting to establish communication links. The receipt of the confirmation message at the controlling vehicle indicates that the corresponding remote vehicle has the capability to successfully receive messages from the controlling vehicle (or else would not know to send the confirmation message) and also has the capability to successfully communicate messages to the controlling vehicle (or else the confirmation message would not have been received).

The communication link may be established to enable subsequent communications between the controlling vehicle and the corresponding remote vehicles. Once the communication links are established, the vehicle control systems of the vehicles may communicate with each other via the communication links without requiring any additional actuation of the input device, communication of linking messages with vehicle identifiers, or the other components of the diagram shown in FIG. 22. For example, the vehicle control system of the controlling vehicle may communicate command messages to the remote vehicles via the communication links. The command messages may control the movement of the remote vehicles by instructing the remote vehicles to implement designated tractive settings and/or brake settings. The command messages enable the vehicles of the vehicle system, which may be spaced apart from each other and disconnected from each other, the coordinate movements as the vehicle system travels along a route. The communication links may refer to specific frequencies, frequency ranges, channels, and/or the like upon which the controlling vehicle may communication with each of the remote vehicles. In an embodiment, the controlling vehicle may communicate with the first remote vehicle using a different communication link than the controlling vehicle communicates with the second remote vehicle to provide customized command messages to each of the remote vehicles over different communication links.

In an alternative embodiment, the vehicle control system may communicate a single, common linking message to both of the remote vehicles, and the linking message includes both of the vehicle identifiers associated with the remote vehicles. For example, the vehicle control system may broadcast the single linking message for receipt by the remote vehicles within a designated range of the controlling vehicle. In another alternative embodiment, the communication link may be established without receiving the confirmation message. For example, receipt of the linking messages at the corresponding remote vehicles and validation of the vehicle identifiers within the linking messages may be sufficient to establish the communication links. Optionally, the linking messages may include instructions about how to set up or utilize network communications to establish the communication links. Instead of communicating the confirmation messages, the vehicle control systems of the remote vehicles may be configured to follow the instructions contained within the linking messages for establishing the communication links.

Figure 23:
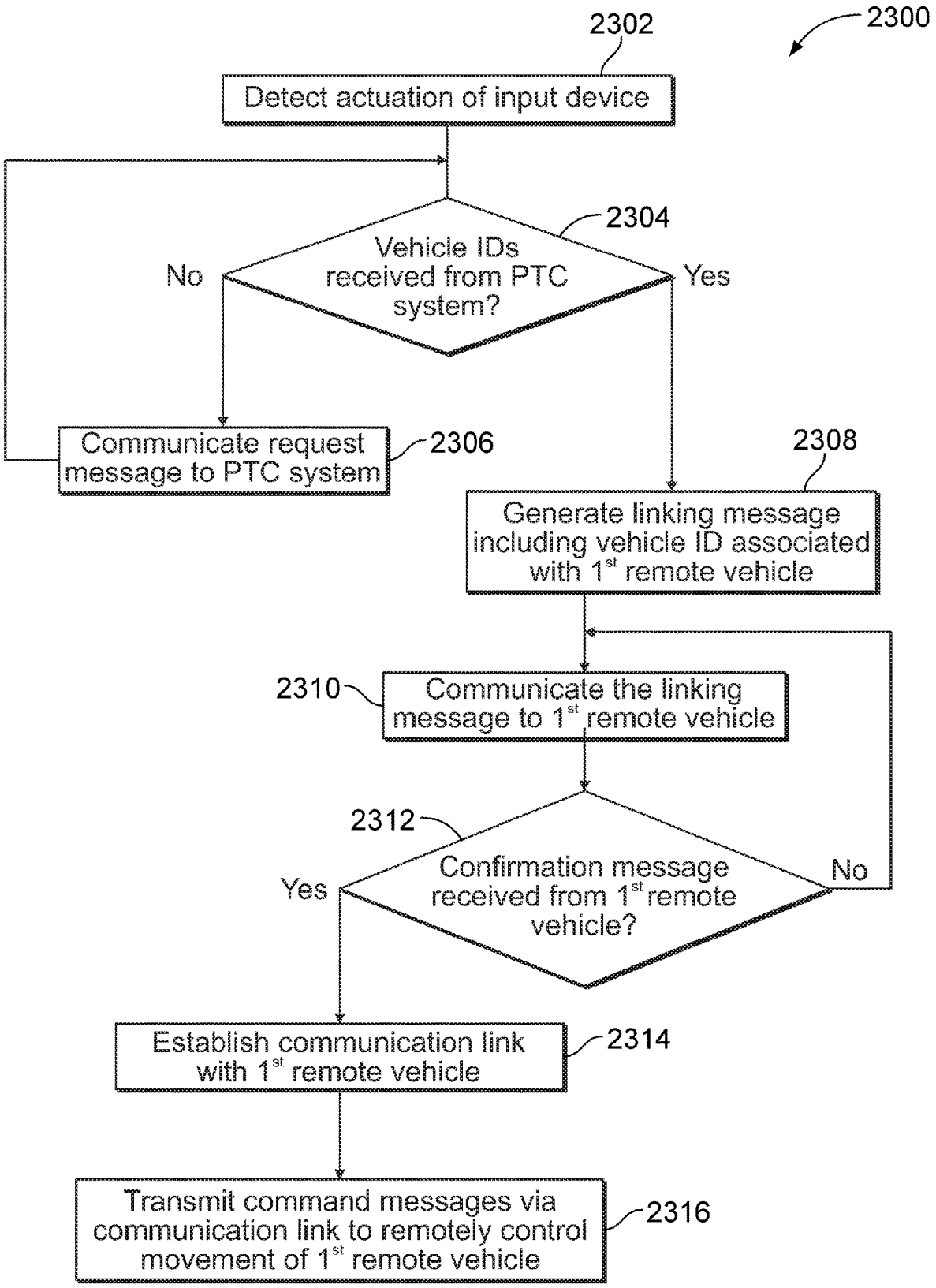
FIG. 23 is schematic diagram of a communication system according to an embodiment.

FIG. 23 is a flowchart for a method 2300 of establishing communication links between vehicles according to an embodiment. The method may be performed in whole or at least in part the vehicle control system of a controlling vehicle in a distributed power arrangement within a vehicle system. The method according to other embodiments may include additional steps than shown in FIG. 23, fewer steps than shown in FIG. 23, a different order of the steps shown in FIG. 23, or at least one different step that is not shown in FIG. 23.

At step 2302, actuation of an input device is detected. The actuation may include or represent a single instance of an operator actuating the input device. The actuation may be detected by receiving an actuation signal from the input device. The operator may actuate the input device to initiate a procedure for linking the vehicles in the vehicle system.

At step 2304, it is determined whether vehicle identifiers ("IDs" in FIG. 23) have been received from a PTC system. Each of the vehicle identifiers is associated with a different vehicle. If the vehicle identifiers have not yet been received, the method proceeds to step 2306. At step 2306, a vehicle information request message is communicated to the PTC system. The vehicle information request message may be communicated via a conductive, wired pathway between the PTC system and the vehicle control system onboard the controlling vehicle. The vehicle information request message prompts the PTC system to send the vehicle identifiers to the vehicle control system. The PTC system may have the vehicle identifiers because the PTC system received the identifiers in a PTC message from an off-board source, such as a wayside signaling system. After communicating the vehicle information request message, the method returns to 2304 to wait for the vehicle identifiers to be received from the PTC system. The PTC system may send the vehicle identifiers in a list that include plural vehicle identifiers. Once the vehicle identifiers are received, the identifiers may be stored on a memory of the vehicle control system.

At step 2308, once it is determined that the vehicle identifiers have been received from the PTC system, a linking message is generated. The linking message includes the vehicle identifier that is associated with a first remote vehicle of the same vehicle system as the controlling vehicle. At step 2310, the linking message is communicated to the first remote vehicle. The linking message may be wirelessly communicated, such as transmitted or broadcast, by a wireless communication device of the vehicle control system onboard the controlling vehicle. At 2312, after sending the linking message, it is determined whether a confirmation message has been received from the first remote vehicle. For example, upon receiving the linking message, the first remote vehicle may determine if the vehicle identifier in the linking message matches the actual, known vehicle identifier of the first remote vehicle. If the match is verified, then the first remote vehicle may communicate a confirmation message back to the controlling vehicle. If the confirmation message is not received after a predetermined amount of time associated with an expected time of response, the method may return to 2310 for re-sending the linking message to the first remote vehicle. On the other hand, if the confirmation message is received, the method may proceed to step 2314.

At step 2314, a communication link is established between the controlling vehicle and the first remote vehicle. The communication link may be a wireless communication link which designates a protocol and/or instructions for subsequent bilateral communications between the two parties, such as frequency, timing, and the like. Optionally, the method may return to step 2308 and the vehicle control system on the controlling vehicle may generate another linking message for communication to a second remote vehicle of the vehicle system for establishing a communication link with the second remote vehicle. For example, the steps 2308, 2310, 2312, and 2314 may be repeated for each of the remote vehicles in the vehicle system with which the controlling vehicle is configured to establish communication links. In an alternative embodiment, a single, omnibus linking message may be generated and communicated that includes all of the vehicle identifiers associated with the specific remote vehicles of the vehicle system. The individual communication links at 2314 between the controlling vehicle and the remote vehicles may be established upon receipt of a confirmation message from each corresponding remote vehicle.

At step 2316, the vehicle control system of the controlling vehicle is configured to transmit command messages to the first remote vehicle via the communication link between the controlling vehicle and the first remote vehicle. The command messages are configured to control the movement of the first remote vehicle along the route. For example, the command messages may be distributed power commands for coordinating the movement of the first remote vehicle with the movement of the controlling vehicle, whether or not the two vehicles are directly or indirectly mechanically coupled together. Furthermore, the vehicle control system of the controlling vehicle may transmit command messages to a second remote vehicle of the vehicle system via the communication link that is established between the controlling vehicle and the second remote vehicle. Thus, the vehicle control system communicates with the different remote vehicles via the corresponding communication links to coordinate movement of the vehicle system.

In the method described above, the communication links may be established with minimal operator intervention, such as no operator intervention other than a single instance of an operator actuating the input device to initiate the method. The communication links can be established without an operator being present at the remote vehicles. For example, a single operator may enter the controlling vehicle to manually actuate the input device without having to leave the controlling vehicle and/or walk to any other vehicles of the vehicle system.

Optionally, the one-button linking procedure described herein can be utilized to establish communication links between a (first) vehicle control system on a vehicle and an off-board vehicle control system (e.g., a second vehicle control system). For example, the off-board vehicle control system may be a PTC system located near a route, such as on a wayside device and/or signaling device. To establish a communication link between the off-board PTC system and the onboard vehicle control system, the off-board PTC system may generate a wireless linking message that is communicated to a communication device of the onboard vehicle control system. The wireless linking message may include a vehicle identifier that is uniquely associated with the vehicle. The communication device is configured to establish a communication link between the onboard vehicle control system and the off-board PTC system responsive to receipt of the wireless linking message at the vehicle and without an operator being present on or in the vehicle. The off-board PTC system may be configured to remotely control movement of the vehicle via the communication link. For example, the PTC system may be configured to restrict movement of the vehicle based at least in part on a location of the vehicle, as described above.

Optionally, the one-button linking procedure described herein can be utilized to establish communication links between two vehicle control systems onboard the same vehicle.

One or more embodiments of the inventive subject matter described herein relate to coordinated control of plural vehicles, e.g., distributed power operations of a train having multiple locomotives, or remote control of on-road vehicles in a convoy. In one aspect, for example, a vehicle system includes a controlling vehicle and plural remote vehicles; each of the vehicles has a respective onboard control unit (e.g., having one or more processors) and communication device (e.g., radio or other wireless unit). After establishing a communication link with the remote vehicles, the controlling vehicle is configured to remotely control movement of the plural remote vehicles over the communication link. The control unit of (for example) a first one of the remote vehicles is configured, responsive to receipt of a designated suspend message from the controlling vehicle, to control movement of the designated remote vehicle independently of the controlling vehicle while the communication link is maintained and while the controlling vehicle continues to remotely control movement of the one or more second remote vehicles. In the case of a train or other rail vehicle consist, this may include the first remove vehicle being mechanically de-coupled from the other vehicles and moved independently and away from the other vehicles, e.g., along a different route, in a different way, for a different purpose, etc.

In this manner, according to one aspect, a remote vehicle of a vehicle consist can be temporarily suspended from remote control operations without fully unlinking the remote vehicle from the controlling vehicle and without the remote vehicle being automatically controlled (for example) to a braked/stopped condition for safety purposes. This allows the remote vehicle to be used for other movement-related purposes apart from the remaining vehicles, while the communication link is maintained, and then to be reconnected to the controlling vehicle without having to re-establish the communication link.

Figure 24A:
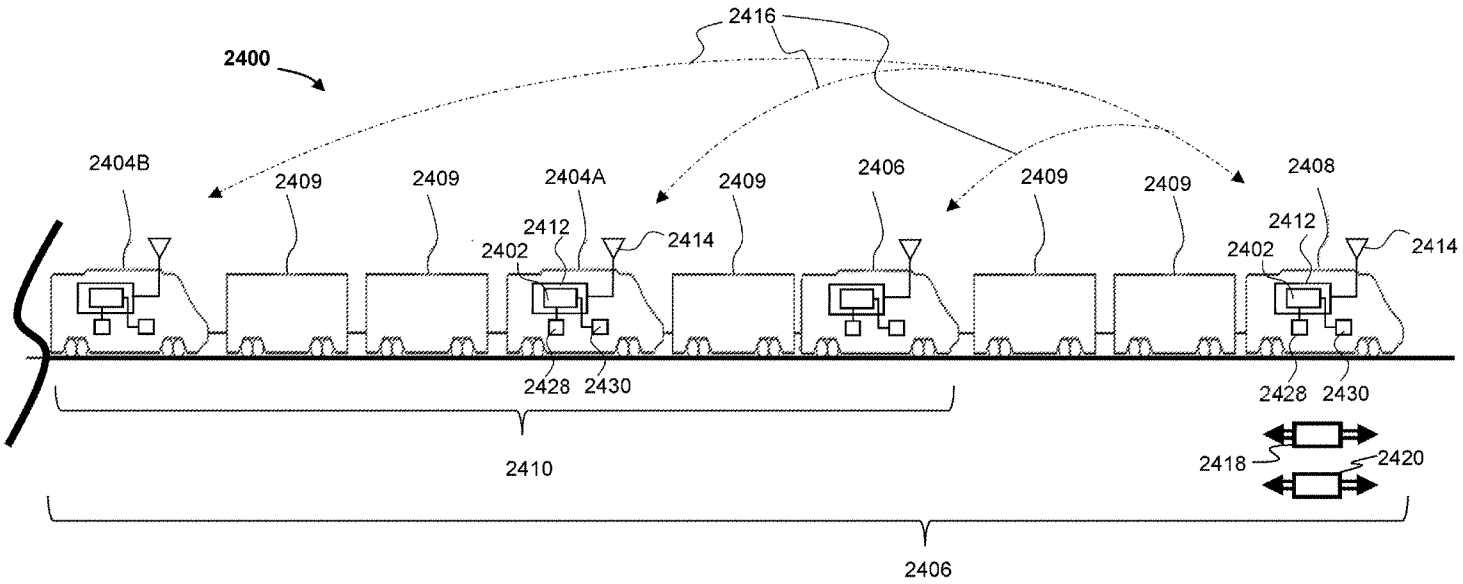
FIG. 24A illustrates one embodiment of a system for communication and control of a vehicle consist or vehicle system having a controlling vehicle and plural remote vehicles.
Figure 24B:
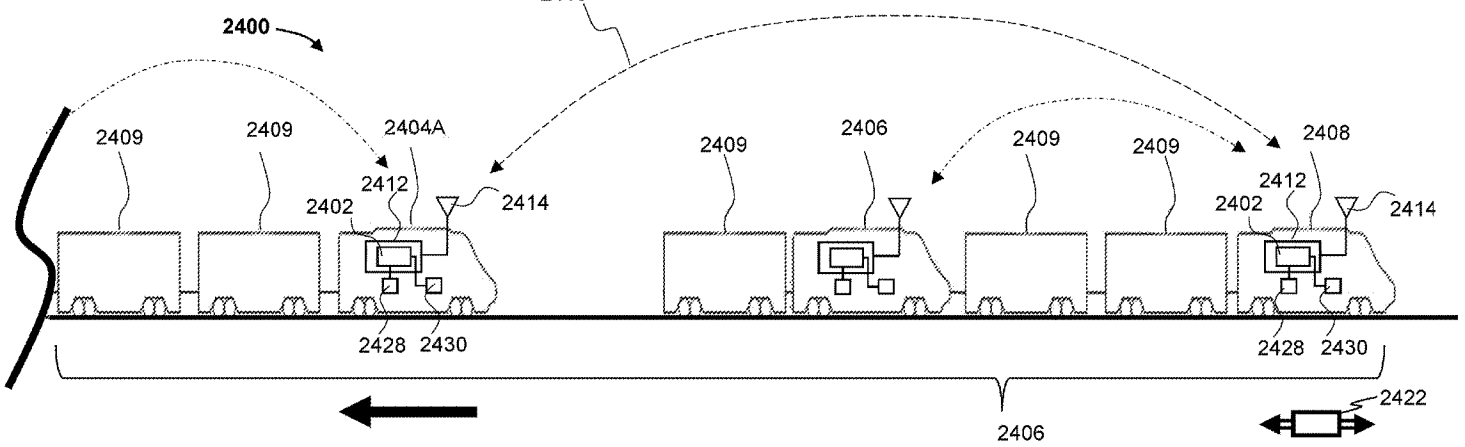
FIG. 24B illustrates the system of FIG. 24A subsequent to one of the remote vehicles having changed from a first mode of operation to a second mode of operation.

With reference to FIGS. 24A and 24B, a vehicle system 2406 includes a first remote vehicle 2404A, a second remote vehicle 2404B, a third remote vehicle 2406, and a controlling vehicle 2408. As described herein, the vehicles may be propulsion-generating vehicles, having onboard propulsion systems for self-movement and potentially pulling/pushing other vehicles. Optionally, a vehicle system (consist) may include more or fewer vehicles. A vehicle system may also include cargo vehicles 2409 (e.g., flatbed rail cars, boxcars, hoppers), passenger vehicles (e.g., passenger rail cars), and other non-propulsion generating vehicles (i.e., vehicles incapable of self-propulsion).

The first, second, and third remote vehicles form plural remote vehicles 2410. As described with respect to FIGS. 24A and 24B, the first and/or second remote vehicles can form a separate vehicle sub-system that can be, at times, remotely controlled by the controlling vehicle and, at other times, separately controlled from the controlling vehicle. For example, the designated remote vehicle may be separately controlled when the designated remote vehicle is operably decoupled (e.g., physically or mechanically decoupled, pneumatically decoupled, electrically decoupled, and/or communicatively decoupled) from the controlling vehicle. In such instances, the second remote vehicle may be grouped with the designated remote vehicle and, optionally, one or more non-propulsion generating vehicles (e.g., rail cars) 2409 to form a vehicle sub-system. The controlling vehicle, the third remote vehicle and, optionally, one or more non-propulsion generating vehicles may for another vehicle sub-system. The two vehicle sub-system may operate independently until it is determined that the two vehicle sub-systems should be rejoined into the vehicle system.

According to one aspect, a "controlling" vehicle refers to a vehicle that is designated for taking primary control for coordinated vehicle movement of a group of vehicles. It is not necessarily the front or first vehicle in the group, although that is a possibility. "Remote" refers to vehicles in a group that are designated as being subservient from a control perspective. The remote vehicles may be spaced apart from the controlling by one or more non-propulsion generating vehicles or other vehicles, although that is not necessarily or always the case.

A system 2400 (e.g., for vehicle communications and control) includes one or more processors 2402 configured to be operably disposed onboard one or more of the propulsion-generating vehicles or units of a vehicle system. The one or more processors may be disposed onboard one or more remote vehicles and/or one or more controlling vehicles of the vehicle system. For example, in a particular embodiment, the system 2400 includes the one or more processors configured to be disposed onboard a first remote vehicle 2404A of a vehicle system 2406 that includes a controlling vehicle 2408 and plural remote vehicles 2410. The one or more processors may be part of a vehicle controller or control unit 2412 of the designated remote vehicle 2404A. The system can also include a communication device 2414 that is configured to be operably disposed onboard the designated remote vehicle and coupled to the one or more processors. Under such circumstances, the phrase "configured to be operably disposed" means, e.g., configured to be electrically powered by a power source available onboard the vehicle, and to withstand, within a defined or designated use-case, the operating environs of the vehicle.

The communication device may be the same or similar to the communication devices and units described herein. For example, the communication device includes or represents hardware and/or software (e.g., wireless radio, cellular modem, or other wireless unit" that is used to communicate with other vehicles in the vehicle system, such as the remote vehicles in the DP arrangement. The communication device may include a transmitter and receiver or an integrated transceiver, an antenna, and associated circuitry for wirelessly communicating (e.g., communicating and/or receiving) linking messages, command messages, linking confirmation messages, reply messages, retry messages, repeat messages, or the like. Optionally, the communication device includes circuitry for communicating the messages over a wired connection, such as an electric multiple unit (eMU) line, a catenary or third rail of an electrically powered route, or another conductive pathway between or among the propulsion-generating vehicles. The one or more processors may control the communication device by activating the communication device.

In some embodiments, the system (e.g., for vehicle communications and control) includes only elements configured to be disposed onboard the designated remote vehicle. In other embodiments, the system includes only elements disposed onboard the controlling vehicle, such as the one or more processors and the communication device disposed onboard the controlling vehicle. Yet in other embodiments, the system can include elements distributed throughout the vehicle system, such as the one or more processors configured to be disposed onboard the controlling vehicle and the one or more processors configured to be disposed onboard the one or more remote vehicles. Yet still in other embodiments, the system may include elements of the vehicle system and also elements disposed off-board from the vehicle system, such as one or more processors configured to be disposed at a remote monitoring facility.

As shown in FIG. 24A, the one or more processors are configured to establish one or more communication links 2416 with the controlling vehicle responsive to the communication device receiving one or more linking messages 2418 from the controlling vehicle. The one or more processors are also configured to automatically control movement of the designated remote vehicle responsive to movement-control messages 2420 received from the controlling vehicle over the communication link.

Particular embodiments, such as those related to or configured to control a remote vehicle, may be configured to operate not only according to a first mode of operation but also a second mode of operation. Other embodiments, such as those related to or configured to control a controlling vehicle, may be able to communicate with one or more remote vehicles operating in the first mode of operation or the second mode of operation. A "mode of operation" determines how a vehicle interacts with or responds to other vehicles during operation of the vehicle and how the vehicle responds to changes in the environment. For example, in a distributed power arrangement, a remote vehicle may be commanded to duplicate tractive efforts or braking efforts of the controlling vehicle as the vehicle system moves along the route. Alternatively, the remote vehicle may be commanded independently from the controlling vehicle as the vehicle system moves along the route. In either case, the controlling vehicle communicates movement-control messages to the remote vehicle operating according to a first mode of operation. The movement-control messages may direct the remote vehicle (e.g., a controller of the remote vehicle or an operator of the remote vehicle) to change a throttle setting, a brake setting, an acceleration, a speed, a power output, or the like. Upon receipt of the movement-control messages, the remote vehicles may implement the changes in operational settings dictated by the command messages.

As shown in FIG. 24B, the one or more processors are also configured, responsive to receipt of a designated suspend message 2422 from the controlling vehicle, to switch the remote vehicle from the first mode of operation to a second mode of operation where movement of the designated remote vehicle is controlled independently of the controlling vehicle while maintaining the communication link.

The remote vehicle may be separately controlled from the controlling vehicle when, for example, the remote vehicle is decoupled from the vehicle system. For example, a remote locomotive may be decoupled from other locomotives of a train in a rail yard to re-sort the train or to effectively assemble a new train by adding other vehicles to the train. Other examples may include a break-in-two situation in which the train has experienced excessive forces causing the train to separate into at least two sections. In other embodiments, however, it is contemplated that the remote vehicle may be separately controlled from the controlling vehicle while remaining coupled to the controlling vehicle. For example, the remote vehicle may be indirectly coupled to the controlling vehicle through several intervening vehicles.

When decoupled from a vehicle system, a remote vehicle may be at least one of physically decoupled (directly or indirectly from the controlling vehicle), pneumatically decoupled, electrically decoupled, and at least partially communicatively decoupled. For example, a remote locomotive may be pneumatically decoupled from the controlling locomotive such that air pressure of a common brake pipe is not sensed by the remote locomotive.

A remote vehicle and a controlling vehicle may be "at least partially communicatively decoupled" from each other when communication between the remote vehicle and the controlling vehicle is limited compared to the communication between the two prior to being decoupled. For example, the remote and controlling vehicles may be at least partially communicatively decoupled when at least one of (a) the controlling vehicle communicates fewer movement-control messages to the remote vehicle or ceases to communicate movement-control messages to the remote vehicle altogether, (b) the remote vehicle responds (e.g., by controlling tractive or braking sub-systems) to fewer movement-control messages from the controlling vehicle or declines to respond to at least some movement-control messages from the controlling vehicle, or (c) the controlling and remote vehicles communicate through at least fewer frequencies, a narrower band of frequencies, fewer channels, or within a smaller area of coverage.

In many cases, the movement of the decoupled remote vehicle is different from the controlling vehicle and other remote vehicles. While one or more other remote vehicles may remain coupled to the controlling vehicle and, as such, move with the controlling vehicle, the decoupled remote vehicle does not necessarily move with the controlling vehicle. For example, after decoupling, the remote vehicle may move away from the controlling vehicle or the consist that contains the controlling vehicle. The decoupled remote vehicle may travel to another location to, for example, add or remove one or more vehicles (e.g., rail cars or other remote vehicles). In some embodiments, the decoupled remote vehicle may become similar to or identical to the controlling vehicle with respect to other vehicles that are coupled to the remote vehicle. In other words, the decoupled remote vehicle may effectively become a controlling vehicle of the group of vehicles that includes the remote vehicle. For example, the decoupled remote vehicle may establish a communication link with remote vehicles and communicate movement-control messages to the other remote vehicles.

Thus, in the first mode of operation, the designated remote vehicle is controlled by the controlling vehicle, which also controls the other remote vehicles. For example, the controlling vehicle may control braking and throttle operations of the remote vehicles for coordinated movement/traction of the vehicle system. In the second mode of operation, although one or more communication links may be maintained, the designated remote vehicle may be controllable independently of the controlling vehicle and other remote vehicles, for example, it may be mechanically de-coupled and driven to or along a different route or along the same route but in a different and independent manner.

Although examples are described herein relating to one of the remote vehicles being suspended from control by the controlling vehicle, all (or some) of the propulsion-generating vehicles in a group/consist may be similarly configured. In such a case, controlling/remote communications may be configured so that each of the remote vehicles could be suspended from remote control on an individual basis. For this purpose, the suspend message could be individually addressed to a given remote vehicle, such that the given remote vehicle would act responsive to the suspend message being received but other remote vehicles would not. One example is addressing the message with a unique vehicle identifier or code, such as a VIN, or, in the case of a locomotive, a road number.

In some embodiments, however, the controlling/remote communications may be configured so that each of the remote vehicles trailing the one suspended remote vehicle could be automatically suspended from remote control prior to, after, or during the process for suspending the one remote vehicle. For example, upon the one remote vehicle requesting suspension, the controlling vehicle may automatically command the remote vehicles trailing the one remote vehicle to be suspended.

As used herein, a "trailing remote vehicle [or vehicles]" refers to another remote vehicle or vehicles whose operation may have been controlled by the controlling vehicle but is coupled to the designated remote vehicle and, subsequent to the designated remote vehicle being decoupled and suspended, necessarily follows movement of the designated remote vehicle. For example, in FIG. 24A, the remote vehicle 2404B is a trailing remote vehicle with respect to the designated remote vehicle 2404A. For some embodiments, the mode of operation for the remote vehicle 2404B is changed prior to, during, or after the designated remote vehicle is suspended. As the designated remote vehicle moves away from the controlling vehicle (as shown in FIG. 24B), the trailing remote vehicle necessarily moves with the designated remote vehicle. In FIG. 24A, the designated remote vehicle is located between the controlling vehicle and the trailing remote vehicle. In other configurations, however, the trailing remote vehicle may be located between the controlling vehicle and the designated remote vehicle.

Figure 24C:
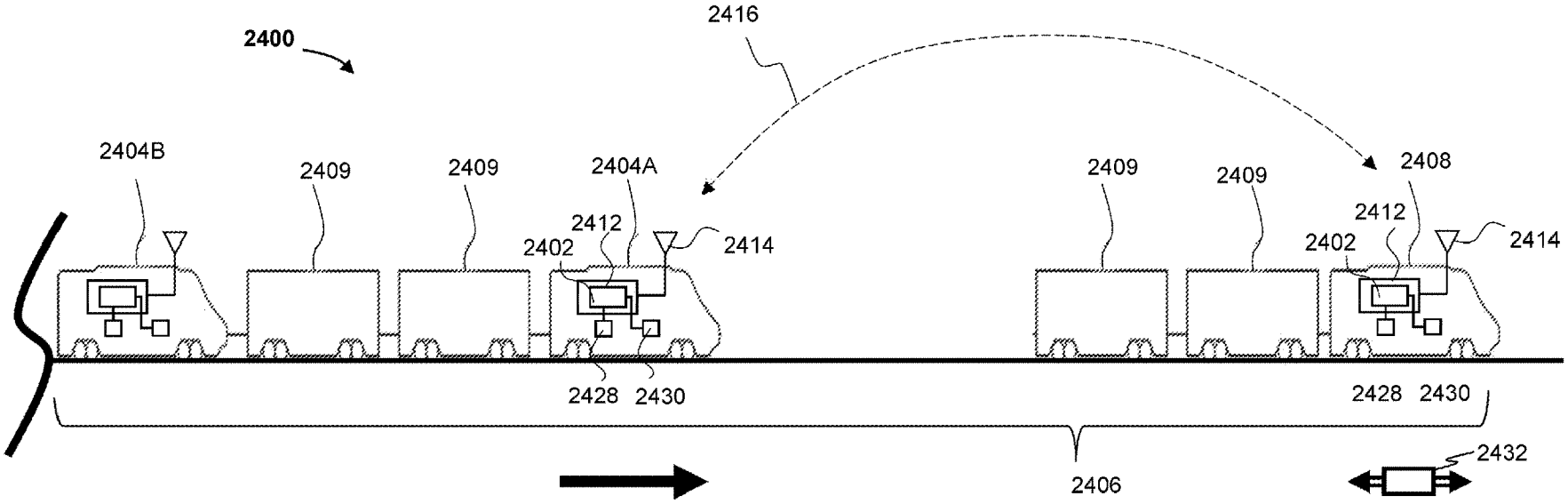
FIG. 24C illustrates the system of FIG. 24A showing the one remote vehicle, after changing to the second mode of operation, returning to resume the first mode of operation in the vehicle consist.

With respect to FIG. 24C, at some point after being suspended and operating in the second mode of operation, the designated remote vehicle may resume operating in the first mode of operation. More specifically, the controlling vehicle is configured to resume remote control of the designated remote vehicle by the controlling vehicle. A designated process or protocol may be established that resumes remote control. For example, the controlling vehicle and the designated remote vehicle may exchange at least one resume message. The exchange could include the controlling vehicle transmitting the resume message to the designated remote vehicle and, optionally, the designated remote vehicle acknowledging receipt of the resume message through a communication to the controlling vehicle. Alternatively, the exchange could include the designated remote vehicle transmitting a resume message (or resume request) to the controlling vehicle and, optionally, the controlling vehicle acknowledging receipt of the resume message through a communication to the designated remote vehicle. Resuming remote control may include an operator having to select a resume function on the user interface on the controlling vehicle and/or the remote vehicle. Optionally, the system may be configured for resuming remote control based on both an exchange of one or more signals between the designated remote vehicle and the controlling vehicle and selection of a resume function/operation onboard one or both of the designated remote and controlling vehicles.

For some embodiments, the different operations performed by the one or more processors may be first approved by an operator through an affirmative action by the operator. The operator may be onboard the vehicle or may be offboard using, for example, a wireless input device. For example, prior to communicating a suspend message (or resume message) from the controlling vehicle to the designated remote vehicle, the operator of the controlling vehicle may use an input device to initiate sending the suspend message (or resume message) to the designated remote vehicle. The operator may press a key or button, pull a lever, select a virtual key/button on a touchscreen, or answer using his or her voice. Likewise, prior to communicating a suspend message (or resume message) from the designated remote vehicle to the controlling vehicle, the operator of the designated remote vehicle may use an input device to initiate sending the suspend message (or resume message) to the controlling vehicle. In a similar manner, prior to communicating a confirmation message (e.g., to suspend or resume) from the controlling vehicle to the designated remote vehicle, the operator of the controlling vehicle may use an input device to initiate sending the confirmation message to the designated remote vehicle. Prior to communicating a confirmation message (e.g., to suspend or resume) from the designated remote vehicle to the controlling vehicle, the operator of the designated remote vehicle may use an input device to initiate sending the confirmation message to the controlling vehicle. In other embodiments, one or more messages may be automatically approved based on one or more conditions.

Figure 25:
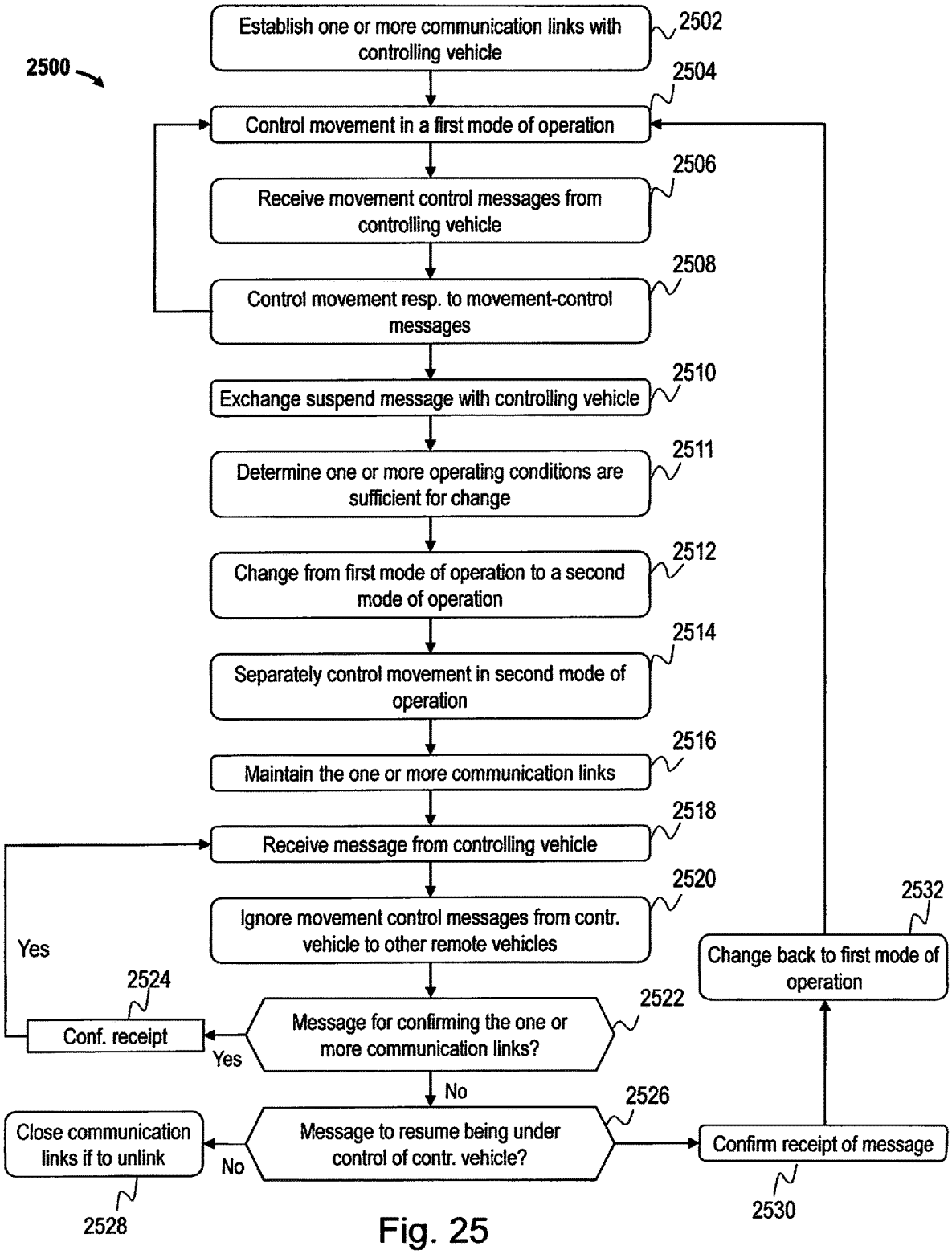
FIG. 25 illustrates a flowchart of a method in accordance with one embodiment that permits control of the remote vehicle that is separate from the controlling vehicle and, subsequently, that permits the controlling vehicle to resume control of the remote vehicle.

FIG. 25 illustrates a flowchart of a method for enabling a remote vehicle to be separately controlled from a controlling vehicle and, subsequently, permitting the controlling vehicle to resume control of the remote vehicle. FIG. 25 describes a method 2500 from the perspective of a system configured to be disposed onboard a designated remote vehicle. The method 2500 may be performed entirely autonomously or partially autonomously in which, for example, one or more inputs are provided by an operator of the designated remote vehicle, by an operator of another vehicle (e.g., controlling vehicle), or by a remote entity, such as a monitoring facility.

The designated remote vehicle may be one remote vehicle among plural remote vehicles of the vehicle system. In some embodiments, the controlling vehicle and the plural remote vehicles have a distributed power arrangement or configuration the tractive efforts and/or braking efforts provided by the vehicles are coordinated to move the vehicle system. Each of the remote vehicles may be responsive to commands provided by the controlling vehicle. The designated remote vehicle can have any position along the vehicle system. For example, if a vehicle system has one controlling vehicle and four remote vehicles, the designated remote vehicle may be the remote vehicle positioned closest to the controlling vehicle, positioned second closest to the controlling vehicle, third closest to the controlling vehicle, or positioned the furthest from the controlling vehicle. In other embodiments, the designated remote vehicle is the only remote vehicle that is responsive to commands (e.g., movement-control messages) from the controlling vehicle.

At 2502, one or more communication links between the designated remote vehicle and the controlling vehicle are established. As described herein, a communication link may be established by the controlling vehicle identifying which remote vehicles are included in the vehicle consist, communicating linking messages to those remote vehicles, and receiving confirmation that the linking messages are received at the remote vehicles. In some embodiments, a communication link may be defined by a communication "handshake" between controlling and remote vehicles. For example, communication of a first message from a controlling vehicle to remote vehicle (e.g., a linking message) followed by successful communication of a second message from the remote vehicle to controlling vehicle (e.g., a linking-confirmation message) may be a communication handshake that establishes a communication link. Optionally, the communication link may be established by a dedicated communications channel being used between the controlling and remote vehicles. For example, a designated frequency or frequency band may define a communication link.

In some embodiments, the one or more communication links between the controlling and remote vehicles may be established while an operator is onboard the remote vehicle. For example, the operator may actuate an input device of a user interface that generates control signals that the remote vehicle wishes to initiate establishment of the communication links between the controlling and remote vehicles. In other embodiments, the communication links between the controlling and remote vehicles may be established without an operator having to go onboard the remote vehicles. The operator may go onboard the controlling vehicle and, once the controlling vehicle has determined which remote vehicles are included in the vehicle consist, the controlling vehicle may establish communication links with the remote vehicles without the operator or other operators having to go onboard the remote vehicles to communicate information from the remote vehicles to the controlling vehicle.

As used herein, the phrase "establish one or more communication links" includes a single communication link being established and then re-established should a communication loss occur using the communication link during operation of the vehicle system. The phrase "establish one or more communication links" may also include establishing more than one communication link between the remote vehicle and the controlling vehicle such that the remote vehicle and the controlling vehicle may communicate with more than one communication link for at least some time periods during operation of the vehicle system. The multiple communication links may be using the same technology (e.g., different radio-frequency bands for the different communication links) or using different technology (e.g., wireless radio for one communication link and also a hardwired line for another communication link). Optionally, the one or more communication links may include or allow for indirect communications. For example, a message transmitted by the controlling vehicle may be received and re-transmitted (with or without modification) by an intervening remote vehicle that is positioned between the controlling vehicle and the designated remote vehicle. Likewise, a return message transmitted by the designated remote vehicle may be received by the intervening remote vehicle and re-transmitted to the controlling vehicle. Optionally, the message may be modified by adding data related to the intervening remote vehicle to the message.

In some embodiments, the communication links may be established without the designated remote vehicle communicating linking confirmation messages and/or without the controlling vehicle receiving linking confirmation messages from the designated remote vehicle. For example, the communication link can be established upon the one or more processors of the designated remote vehicle receiving movement-control messages from the controlling vehicle. Moreover, the communication link can be established upon the one or more processors of the controlling vehicle receiving a message other than a confirmation message from the designated remote vehicle.

At 2504, the one or more processors may control movement in the first mode of operation. The one or more processors control the designated remote vehicle responsive to movement-control messages from the controlling vehicle. More specifically, the one or more processors of the designated remote vehicle may receive, at 2506, the movement-control messages through the one or more communications links using the communication device. At 2508, the one or more processors of the designated remote vehicle may control movement of the designated remote vehicle in response to the movement-control messages. The movement-control messages may, for example, command the one or more processors of the designated remote vehicle to change a throttle setting, a brake setting, an acceleration, a speed, a power output, or the like of the remote vehicle. Optionally, the one or more processors of the designated remote vehicle may confirm receipt and/or execution of the movement-control messages.

While the one or more processors of the designated remote vehicle are controlling the designated remote vehicle, the operator of the designated remote vehicle may or may not be onboard the designated remote vehicle. For example, after confirming receipt of a linking message through the user interface of the designated remote vehicle to establish the communication link, the operator may exit the designated remote vehicle. With the communication link established, the designated remote vehicle may be controlled autonomously by the one or more processors of the designated remote vehicle based on the commands of the controlling vehicle.

For the one or more processors of the designated remote vehicle, communicating with the controlling vehicle and controlling movement of the designated remote vehicle may occur for an indefinite period of time (e.g., minutes, hours, days, weeks, or months) prior to the designated remote vehicle transitioning to the second mode of operation in which the designated remote vehicle is suspended from control of the controlling vehicle. At 2510, the controlling vehicle and the designated remote vehicle exchange one or more suspend messages. As used herein, the term "exchange" includes one and only one suspend message being communicated from the controlling vehicle to the designated remote vehicle, one and only one suspend message being communicated from the designated remote vehicle to the controlling vehicle, or at least two suspend messages communicated between the designated remote vehicle and the controlling vehicle.

In some embodiments, the suspension is requested by the designated remote vehicle. For example, the designated remote vehicle may request suspension by communicating a suspend message to the controlling vehicle. The controlling vehicle may receive the suspend message, confirm receipt of the suspend message, and then permit the suspension by communicating a suspension-confirmation message to the designated remote vehicle. In some cases, the controlling vehicle does not confirm receipt of the suspension request but implies that such request was received by communicating the suspension-confirmation message.

In other embodiments, the suspension is requested (or commanded) by the controlling vehicle. For example, the controlling vehicle may command that the designated remote vehicle be suspended from remote control by communicating the suspend message to the designated remote vehicle. The designated remote vehicle may receive the suspend message, and confirm receipt of the suspend message by sending a confirmation message. Alternatively, a confirmation message from the designated remote vehicle is not communicated to the controlling vehicle. Such circumstances may occur when the designated remote vehicle is already decoupled from the vehicle sub-system (or vehicle consist) that includes the controlling vehicle.

At 2511, the one or more processors of the designated remote vehicle and/or the controlling vehicle may determine that one or more operating conditions are sufficient for changing from the first mode of operation to the second mode of operation. For example, the one or more processors may confirm that the vehicle system is stopped and that the designated remote vehicle is configured for separate control from the controlling vehicle. As used herein, the phrase "determining that one or more operating conditions are sufficient" includes performing actual observations and/or executing calculations to determine whether an operating condition is sufficient and also includes receiving a communication that one or more operating conditions are sufficient. For instance, the controlling vehicle may determine through actual observations and calculations that a first operating condition is sufficient. The controlling vehicle may communicate to the designated remote vehicle that the first operating condition is sufficient. Accordingly, when determining whether the one or more operating conditions are satisfied, the one or more processors of the designated remote vehicle is not required to actively determine (e.g., by performing calculations and/or observing real-time data) that any of the operating conditions are satisfied. More specifically, each and every operating conditions may be actively determined to be sufficient by another entity. Alternatively, one or more operating conditions may be actively determined by the one or more processors of the designated remote vehicle.

Various operating conditions may be considered prior to or during the transition of the designated remote vehicle to the second mode of operation. For example, one operating condition may be that the vehicle system is stopped. For example, the one or more processors of the controlling vehicle and/or the designated remote vehicle may confirm the vehicle system is traveling at a speed of at most 0.1 miles per hour (mph). Another condition may be that the vehicle system is configured to remain stopped. For example, the one or more processors of the controlling vehicle and/or the designated remote vehicle may set a throttle of the vehicle system to idle and set the independent brakes of the controlling vehicle, the designated remote vehicle, and other remote vehicles may be set to a designated pressure (e.g., greater than 75% or greater than 80% of the maximum pressure).

Prior to or during the transition to the second mode of operation, the designated remote vehicle may be in a set-out mode. In a set-out mode, a throttle of the designated remote vehicle may be set to idle, one or more brakes (e.g., independent brakes) may be set to a designated pressure (e.g., maximum pressure), and an emergency brake application may be enabled for control. Optionally, other brake functions may be disabled and/or a brake valve of the designated remote valve may be controlled to decouple the designated remote vehicle from the brake pipe. For example, the brake valve may be set to cut-out, thereby isolating the designated remote vehicle from the brake pipe.

Other conditions may be satisfied prior to or during the transition of the designated remote vehicle to the second mode of operation. Optionally, the one or more processors of the controlling vehicle and/or the designated remote vehicle may determine that the one or more communication links between the controlling vehicle and the designated remote vehicle are enabled. For example, the one or more processors of the controlling vehicle and/or the designated remote vehicle may determine that there has not been a communication loss between the controlling vehicle and the designated remote vehicle within a designated time period (e.g., the previous one minute or 45 seconds). Optionally, the one or more processors of the controlling vehicle and/or the designated remote vehicle may determine that the braking system is operable. For example, one or more braking tests (e.g., brake pipe continuity) may be conducted while the vehicle system is stopped.

At 2512, the one or more processors of the designated remote vehicle may change operation from the first mode of operation to the second mode of operation. As described above, changing from the first mode of operation to the second mode of operation may occur as the one or more processors are determining whether the operating conditions for change are sufficient. In addition, changing from the first mode of operation to the second mode of operation may include preparing the sub-systems that control movement (e.g., sub-systems responsible for tractive and braking efforts) for operation without remote control by the controlling vehicle. Alternatively or in addition to the above, changing from the first mode of operation to the second mode of operation may include preparing the operator and/or other crew members for operation without remote control by the controlling vehicle. For example, the one or more processors may at least one of: (a) display a message to the operator and/or the crew members via an onboard user interface or other displays, (b) announce via an onboard audio system, or (c) alert the operator and/or crew members via an onboard visual system (e.g., illuminated lights) that the designated remote vehicle is currently in a suspended state or is transitioning to a suspended state. Alternatively or in addition to the above, changing from the first mode of operation to the second mode of operation may also include a remote entity (e.g., monitoring facility) that the designated remote vehicle is not controlled by the controlling vehicle.

While in the second mode of operation or during transition from the first mode of operation to the second mode of operation, the one or more processors control a brake component 2428 (shown in FIGS. 24A-24C) of the designated remote vehicle from a first state to a second state. In the first state, the movement of the designated remote vehicle is slowed, stopped, or prevented by the brake component. In the second state, the movement of the designated remote vehicle is not slowed, stopped, or prevented by the brake component. For example, the brake component may include a pipe of an air brake system. In the second state, the brake component (e.g., brake valve) may be cut-out.

In some embodiments, the one or more processors may be configured for the brake component to be in the first state as part of the process for transitioning the designated remote vehicle from being remotely controlled by the controlling vehicle to being independently moveable and controllable. This may include the brake component being controlled to the first state as an initial step (or as part of an initial phase) of such a transition, for safety purposes and/or to ensure the designated remote vehicle is stopped. Or it may include the brake component automatically transitioning to the first state as a result of some aspect of the control transition, e.g., a brake pipe of an air brake system is depressurized subsequent to mechanically uncoupling the designated remote vehicle (e.g., a locomotive) from other vehicles (e.g., rail vehicles) in a consist.

Subsequent to the remote vehicle changing to the second mode of operation, the remote vehicle may be separately controlled from the controlling vehicle at 2514. The phrase "separately controlled from the controlling vehicle" means controlled by an individual or system that is not the controlling vehicle or directly controlled by the controlling vehicle. For example, the movement of the designated remote vehicle may be controlled manually by an operator onboard the remote vehicle. The user interface can be configured to generate control signals that are responsive to operator manipulation of the user interface onboard the designated remote vehicle. For example, the user interface can include throttle and braking levers, a steering wheel, etc. In the second mode of operation (i.e., when not under remote control of the controlling vehicle, but still linked thereto), the designated remote vehicle may be configured for manual operation only using the user interface.

Alternatively or in addition to manual control by an operator onboard the remote vehicle, the movement of the remote vehicle may be separately controlled from the controlling vehicle by one or more processors disposed onboard the remote vehicle. The one or more processors can command the various sub-systems of the remote vehicle to change a throttle setting, a brake setting, an acceleration, a speed, a power output, or the like. The one or more processors of the designated remote vehicle may automatically control movement of the designated remote vehicle while the designated remote vehicle is suspended with or without some operator inputs.

Alternatively or in addition to the above, the movement of the remote vehicle may be separately controlled from the controlling vehicle by a device that is not disposed onboard the controlling vehicle or the remote vehicle. For example, a remote monitoring facility or an individual standing nearby (e.g., alongside the remote vehicle) may control the remote vehicle remotely. For example, an individual may use a handheld device to change a throttle setting or a brake setting, thereby controlling how the designated remote vehicle moves.

While being separately controlled from the controlling vehicle, the designated remote vehicle can be configured so that the designated remote vehicle cannot be linked to another, different controlling vehicle. For example, the controlling vehicle may communicate messages with an identifying code that confirms the communication is from the controlling vehicle. As such, the designated remote vehicle may ignore or decline to follow messages from other possible linking vehicles during the second mode of operation.

At 2516, the one or more processors of the designated remote vehicle may maintain the one or more communication links with the controlling vehicle. As used herein, the term "maintain" or its derivatives does not necessarily mean constant or regular communications between the controlling vehicle and the designated remote vehicle. Instead, the phrase "maintaining the one or more communication links" may include, for example, the controlling and remote vehicles retaining data for the one or more communication links and/or keeping resources available for the one or more communication links. For example, the controlling and remote vehicles may retain an active record/registry, e.g., in a non-transitory memory/storage device, that the controlling and remote vehicles are authorized for communications between each other. The communications may be over a designated communications channel or channels according to designated communications and control protocols/processes. The controlling and remote vehicles may hold these designated communications channel or channels and prevent the channel(s) from being used for other communications.

Another manner of maintaining the one or more communication links may include communicating "handshakes" between the controlling vehicle and the designated remote vehicle. For example, the controlling vehicle may communicate linking messages to confirm that the one or more communication links remain viable. The one or more processors of the designated remote vehicle may receive the linking messages and communicate reply messages that confirm the linking messages were received.

While being separately controlled from the controlling vehicle, the controlling vehicle may stop communicating movement-control messages to the designated remote vehicle. More specifically, the controlling vehicle may continue to transmit movement-control messages to other remote vehicles, if any exist, but not to the designated remote vehicle. Alternatively, the controlling vehicle may continue to communicate movement-control messages. For any messages directed to the designated remote vehicle, the remote vehicle may receive the messages, at 2518, from the controlling vehicle. At 2520, the designated remote vehicle may choose to ignore movement-control messages from the controlling vehicle. For example, the remote vehicle may receive the movement-control messages but decline to follow the commands in the movement-control messages. Alternatively, the remote vehicle may ignore the movement-control messages, at 2520, by choosing not to receive such messages (e.g., by declining to monitor a frequency or channel that the movement-control messages are communicated through).

For messages that are received from the controlling vehicle, the designated remote vehicle may determine whether to respond to the message and/or act upon the message at 2522. As described herein, the message may be a linking message to confirm that the one or more communication links are still enabled. Thus, the one or more processors of the designated remote vehicle may determine whether the message is a linking message. If the message is a linking message, the one or more processors may communicate a confirmation receipt message, at 2524, to the controlling vehicle.

Under some circumstances, messages between the controlling vehicle and the remote vehicle in the second mode of operation may only include non-movement-control types of messages, such as the linking messages described above, commands to unlink, requests to the operator, or informative notifications or announcements. Commands to unlink cause the one or more communications links to disconnect or break. Requests to the operator may ask or advise the individual operating the remote vehicle to be at designated location along the route by, for example, a designated time. Informative notifications or announcements may include information regarding track conditions, speed limits for an upcoming segment of the track, or statuses on arriving or departing vehicle systems. In some embodiments, however, a controlling vehicle may cease all communication with the designated remote vehicle until a resume message is received.

At 2526, the one or more processors of the designated remote vehicle can determine whether a message is a resume message or another message, such as a command to unlink. If the message is a command to unlink, the one or more processors may close, at 2528, the one or more communication links. For example, the one or more processors may erase the active registry and close any communication channels or frequencies assigned to the controlling vehicle.

In particular embodiments, the one or more processors of the designated remote vehicle initially communicate the resume message to the controlling vehicle. For embodiments in which the designated remote vehicle initially communicates the resume message, the designated remote vehicle may begin a listening mode and/or begin transition to the first mode of operation while awaiting confirmation from the controlling vehicle. For example, while awaiting confirmation from the controlling vehicle, the one or more processors of the designated remote vehicles may cause one or more operations or actions for preparing the designated remote vehicle for operating in the first mode of operation.

If the message is a resume command or request, the one or more processors can confirm receipt of the resume message, at 2530, and begin the process of changing back to the first mode of operation at 2532. The process of changing back to the first mode of operation may be similar to the process for changing to the second mode of operation, but in reverse. For example, changing back to the first mode of operation may include preparing the sub-systems for returning to be remotely controlled by the controlling vehicle.

When transitioning back to the first mode of operation, the one or more processors can control the brake component of the designated remote vehicle to change from the second state back to the first state. For example, the brake component may be controlled during one or more brake tests to confirm the braking sub-system is sufficiently operational. The one or more brake pipe tests may verify that the brake pipe is unrestricted between the controlling vehicle and the remote vehicles (brake pipe continuity) and that the flow sensors on the remote vehicles are operable. The one or more brake pipe tests may also be used to identify where the remote vehicles are located in the vehicle system. During the one or more brake pipe tests, the one or more processors of the designated remote vehicle may control a brake component. For example, the one or more processors of the designated remote vehicle may cause a brake valve to cut-in or cut-out. The one or more processors of the designated remote vehicle may also cause a brake valve to cut-in or cut-out during a leakage test. The one or more processors of the controlling vehicle may also control movement of a brake component during one or more tests. For example, the one or more processors of the controlling vehicle may control movement of a brake component to make an automatic brake reduction or to charge a brake pipe.

Optionally, at least one of a brake pipe test, a continuity test, and a leakage test is performed prior to the status of the designated remote vehicle changing from a suspended status to a remote status. Upon the braking system passing the one or more tests, the one or more processors of the controlling vehicle and/or the one or more processors of the designated remote vehicle may confirm that the designated remote vehicle is operating according to the first mode of operation. When back to the first mode of operation, the controlling vehicle may resume communicating movement-control messages to the designated remote vehicle and other remote vehicles, if any.

Alternatively or in addition to the above, changing back to the first mode of operation may include preparing the operator and/or other crew members for returning to remote control by the controlling vehicle. For example, the one or more processors may at least one of: (a) display a message to the operator and/or the crew members via an onboard user interface or other displays, (b) announce via an onboard audio system, or (c) alert the operator and/or crew members via an onboard visual system (e.g., illuminated lights) that the designated remote vehicle is moving from the suspended status to a remote status. Alternatively or in addition to the above, changing back to the first mode of operation may also include notifying a remote entity (e.g., monitoring facility) that the designated remote vehicle will be controlled by the controlling vehicle.

Figure 26:
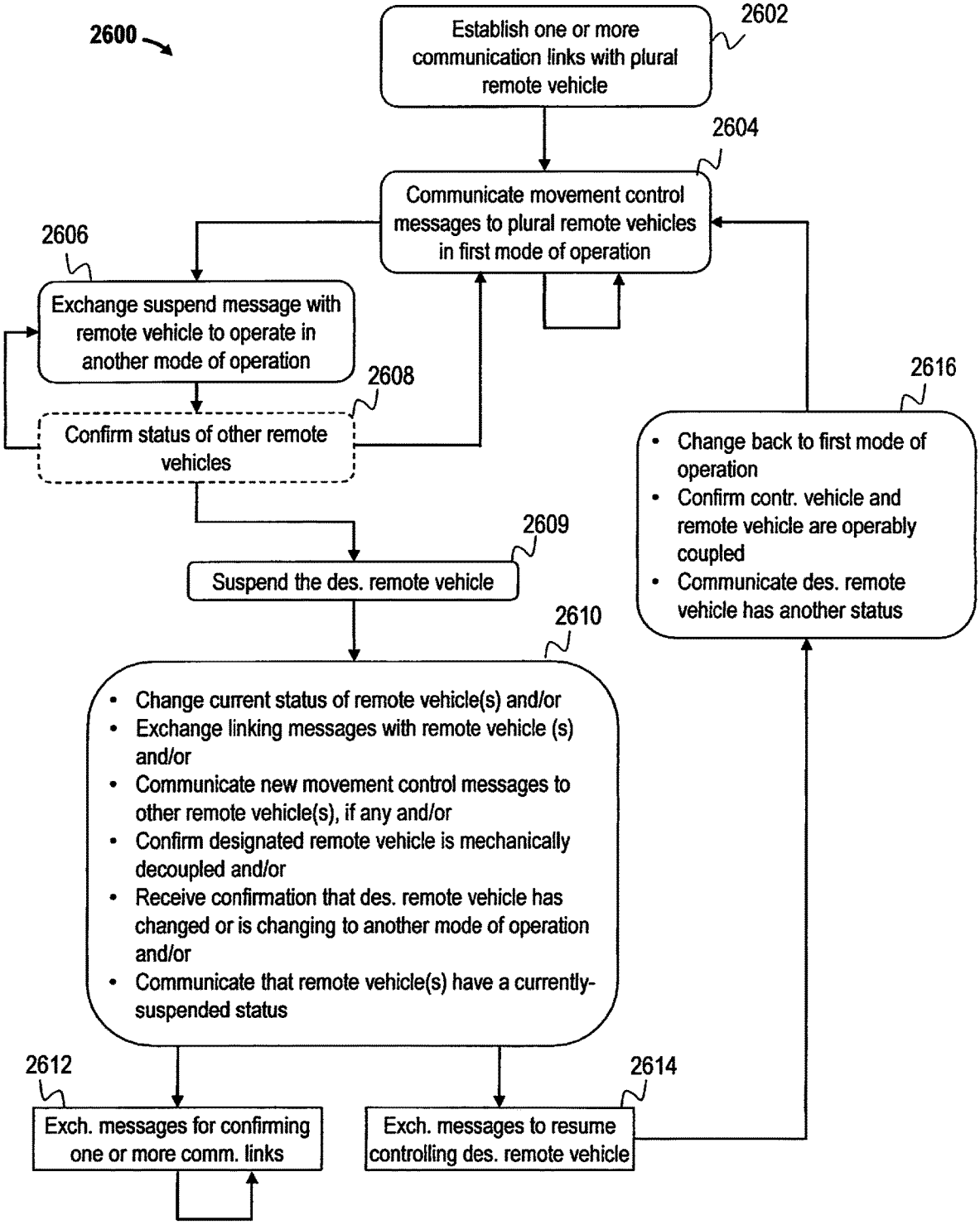
FIG. 26 illustrates a flowchart of a method in accordance with one embodiment that enables a controlling vehicle to permit a remote vehicle to operate independently from the control of the controlling vehicle.

FIG. 26 illustrates a flowchart of a method for enabling a remote vehicle to be separately controlled from a controlling vehicle and, subsequently, permitting the controlling vehicle to resume control of the remote vehicle. FIG. 26 describes a method 2600 from the perspective of a system configured to be disposed onboard the controlling vehicle. The method 2600 may be performed entirely autonomously or partially autonomously in which, for example, one or more inputs are provided by an operator of the controlling vehicle, by an operator of another vehicle, or by a remote entity, such as a monitoring facility.

The steps and operations described with respect to the method 2600 may be similar to those described with respect to the method 2500 (FIG. 25). At 2602, as described herein, the one or more processors of the controlling vehicle may establish one or more communication links with plural remote vehicles. At 2604, the one or more processors of the controlling vehicle communicate movement-control messages to the plural remote vehicles. The plural remote vehicles may be operating according to a first mode of operation.

At 2606, the one or more processors of the controlling vehicle may exchange at least one suspend message with a designated remote vehicle. In particular embodiments, the suspend message may be communicated from the controlling vehicle to the designated remote vehicle. The designated remote vehicle may confirm receipt of the suspend message by communicating a confirmation message. In other embodiments, the suspend message is first communicated by the designated remote vehicle followed by a confirmation message communicated by the controlling vehicle. Alternatively, one and only one suspend message is communicated from the controlling vehicle to the designated remote vehicle, or one and only one suspend message is communicated from the designated remote vehicle to the controlling vehicle.

At 2608, the controlling vehicle may determine a status of any trailing remote vehicles. The trailing remote vehicles are those remote vehicles that are decoupled from the controlling vehicle with the designated remote vehicle and are moved away from the controlling vehicle by the designated remote vehicle. If one or more trailing remote vehicles have a status that indicate the trailing remote vehicle(s) is currently controlled by the controlling vehicle, the one or more processors of the controlling vehicle may command the trailing remote vehicle(s) to transition to a different status. More specifically, the one or more processors of the controlling vehicle can command the trailing remote vehicle(s) to change to a second mode of operation (or another mode of operation) in which the trailing remote vehicle(s) will not be remotely controlled by the controlling vehicle. For example, the other mode of operation may enable the trailing remote vehicle(s) to be separately controlled from the controlling vehicle, may enable the designated remote vehicle to remotely control the trailing remote vehicle(s), or may command the trailing remote vehicle(s) to have an idle setting.

In some embodiments, the other mode of operation may be in a mode in which a throttle of the remote vehicle is set to idle. Alternatively or in addition to the above, the other mode of operation may allow the designated remote vehicle to pull the remote vehicle. For example, the remote vehicles may be set in neutral. Alternatively, the other mode of operation may include one or more brakes (e.g., independent brakes) being set to a designated pressure (e.g., at least 75% of maximum pressure) and/or an emergency brake application may be enabled.

After it is confirmed that the trailing remote vehicle(s) have a sufficient mode of operation for suspending the designated remote vehicle, the designated remote vehicle may be suspended at 2609.

At 2610, one or more actions may be taken that confirm the designated remote vehicle has been suspended. For example, the one or more processors of the controlling vehicle may change a current status of the designated remote vehicle and any trailing remote vehicle(s) from a remote status to a suspended status. The current status may be stored (e.g., in memory) onboard the controlling vehicle. Alternatively or in addition to the above, the one or more processors may maintain the one or more communication links as described above. Alternatively or in addition to the above, the one or more processors of the controlling vehicle may exchange linking messages with the designated remote vehicle or, optionally, any trailing remote vehicle(s). Alternatively or in addition to one or more of the above, the one or more processors of the controlling vehicle communicate new movement control messages to other remote vehicle(s), if any, that are still operating in the first mode of operation.

Alternatively or in addition to one or more of the above, the one or more processors of the controlling vehicle can confirm that the designated remote vehicle is mechanically decoupled. Alternatively or in addition to one or more of the above, the one or more processors of the controlling vehicle receive confirmation that the designated remote vehicle has changed to the second mode of operation or is changing to the second mode of operation.

In some embodiments, the one or more processors of the controlling vehicle can communicate, also at 2610, that the designated remote vehicle has a currently-suspended status. Optionally, the one or more processors of the controlling vehicle can also communicate that the other remote vehicle(s) have a currently-suspended status. For example, the one or more processors may at least one of: (a) display a message to the operator and/or the crew members via an onboard user interface or other displays, (b) announce via an onboard audio system, (c) alert the operator and/or crew members via an onboard visual system (e.g., illuminated lights) that the designated remote vehicle is moving from the remote status to a suspended status, or (d) notify a remote entity (e.g., monitoring facility) that the designated remote vehicle has a suspended status and/or other remote vehicles have a suspended status.

At 2612, the one or more processors of the controlling vehicle can exchange messages for confirming that the one or more communication links are maintained. At 2616, the one or more processors of the controlling vehicle can exchange a resume message with the designated remote vehicle. For example, the designated remote vehicle may initially communicate a resume message followed by a message from the controlling vehicle that confirms receipt of the resume message. Alternatively, the controlling vehicle may initially communicate the resume message followed by a message from the designated remote vehicle that confirms receipt of the resume message. Yet in other embodiments, the controlling vehicle may communicate a resume command to the designated remote vehicle instructing the designated remote vehicle to resume.

After confirming that the controlling vehicle and the designated remote vehicle are to resume the prior communications and control arrangement, the process of changing back to the first mode of operation may begin. Changing back to the first mode of operation may include preparing the sub-systems for being remotely controlled by the controlling vehicle. The process of changing back to the first mode of operation may be similar to the process for changing to the second mode of operation. Optionally, however, the steps may be performed in a reverse order.

At 2616, the one or more processors of the controlling vehicle may confirm that the other remote vehicles, if any, are configured for changing to the first mode of operation in which the controlling vehicle may control operation of the remote vehicles. Likewise, at 2616, the one or more processors of the controlling vehicle may confirm that the designated remote vehicle is configured for changing to the first mode of operation in which the controlling vehicle may control operation of the remote vehicles.

When transitioning back to the first mode of operation, the one or more processors can control the brake component of the designated remote vehicle to change from the second state back to the first state. For example, the brake component may be controlled during one or more brake tests to confirm the braking sub-system is sufficiently operational. The one or more brake pipe tests may verify that the brake pipe is unrestricted between the controlling vehicle and the remote vehicles (brake pipe continuity) and that the flow sensors on the remote vehicles are operable. The one or more brake pipe tests may also be used to identify where the remote vehicles are located in the vehicle system. During the one or more brake pipe tests, the one or more processors of the controlling vehicle may control a brake component. For example, the one or more processors of the controlling vehicle may cause a brake valve to cut-in or cut-out. The one or more processors of the controlling vehicle may also cause a brake valve to cut-in or cut-out during a leakage test. The one or more processors of the controlling vehicle may also control movement of a brake component during one or more tests.

Optionally, at least one of a brake pipe test, a continuity test, and a leakage test is performed prior to the one or more processors of the controlling vehicle changing the current status of the designated remote vehicle from a suspended status to a remote status. Upon the braking system passing the one or more tests, the one or more processors of the controlling vehicle and/or the one or more processors of the designated remote vehicle may confirm that the designated remote vehicle is operating according to the first mode of operation. When back to the first mode of operation, the controlling vehicle may resume communicating movement-control messages to the designated remote vehicle and other remote vehicles, if any.

Alternatively or in addition to the above, changing back to the first mode of operation may include preparing the operator and/or other crew members for returning to remote control by the controlling vehicle. For example, the one or more processors may at least one of: (a) display a message to the operator and/or the crew members via an onboard user interface or other displays, (b) announce via an onboard audio system, or (c) alert the operator and/or crew members via an onboard visual system (e.g., illuminated lights) that the designated remote vehicle is moving from the suspended status to a remote status. Alternatively or in addition to the above, changing back to the first mode of operation may also include notifying a remote entity (e.g., monitoring facility) that the designated remote vehicle will be controlled by the controlling vehicle.

Compared to assembling a vehicle system in a designated communications arrangement (e.g., distributed power arrangement), embodiments may enable re-assembling the vehicle system in a shorter time period. Moreover, the vehicle system is not required to have the same makeup when the vehicle system is re-assembled. Instead, the vehicle system may have one or more vehicles added or one or more vehicles removed. For example, the controlling vehicle may be replaced by a replacement controlling vehicle as described herein. Moreover, the order of the vehicles, prior to the designated remote vehicle being suspended, may have different positions with respect to one another.

Embodiments may enable re-linking the controlling vehicle and the designated remote vehicle in a shorter period of time compared to establishing one or more communication links between the controlling vehicle and the designated remote vehicle "from scratch," as if the controlling vehicle and the designated remote vehicle were not previously part of a vehicle system in which the controlling vehicle controlled operation of the designated remote vehicle among other possible remote vehicles. For example, the controlling vehicle and the designated remote vehicle may each store data regarding the other vehicle. The stored data enables re-establishing communications more quickly among the vehicles of the vehicle system, including other remote vehicles of the vehicle system. Under at least some circumstances, one or more steps can be avoided (e.g., manually entering identification information of the controlling vehicle at one or more of the remote vehicles, then manually accepting the remote vehicles at the controlling vehicle, then executing tests).

Moreover, embodiments may avoid configuring one or more of the remote vehicles such as when a vehicle system is initially assembled. For example, the user interface, the braking system, and the reverser may be required to have certain settings when a vehicle system is initially assembled. At least one or more of these settings may not be required in some embodiments and, therefore, the time and energy spent to manually change the settings can be avoided. Moreover, other operations can be avoided should issues arise as each remote vehicle is setup for the vehicle system.

The following sections describe an example of one embodiment of the system in the context of distributed power train (rail vehicle consist) operations, where a controlling locomotive in the train remotely controls plural remote locomotives in the train. Aspects of this embodiment are also applicable to other types of rail vehicle consists and vehicles generally. Here, the system is configured for a remote locomotive to be suspended (from remote control and for independent movement, while the communication link is maintained) in the following manner.

First, the controlling vehicle operator commands the remote vehicle to be suspended to a "setout" mode. In the setout mode the remote vehicle can be decoupled from the rest of the train/consist, and is automatically controlled (via its emergency brake or otherwise) to remain stopped/braked. Then, the controlling vehicle operator selects a "suspend" function/operation on the user interface of the controlling vehicle (e.g., "suspend" distributed power remote via a distributed power "Remote Session" menu of a computer interface of the one or more processors). The system may be configured for this to result in generation and transmission, from the controlling vehicle to the remote vehicle, the suspend command/message, which the remote vehicle can acknowledge. The controlling vehicle will retain the "suspended" remote as a linked remote vehicle, but will no longer attempt to transmit messages to the suspended remote. The controlling vehicle may be configured so that its distributed power-related user interface (e.g., operations screen) will indicate that the remote vehicle is a suspended remote in setout mode, and/or that there is communications loss with the remote vehicle.

In some cases, the controlling vehicle may determine a status of any trailing remote vehicles. If the trailing remote vehicles are not in a setout mode, the controlling vehicle may command each of the trailing remote vehicles that are not in the setup mode to change to the setup mode.

The user interface of the remote vehicle may be similarly configured, e.g., to indicate on a user interface that it is in a suspended state. Subsequently, an operator on the remote vehicle ends remote control operation via the user interface, for transitioning to conventional (independent) operation. As such, the designated remote vehicle may not be operated independently from the controlling vehicle. The controlling vehicle continues to remotely control other remote vehicles in the remaining consist.

To resume remote control operations of the suspended remote vehicle, an operator on the remote vehicle selects a "resume" function/operation on the user interface of the remote vehicle. The remote vehicle automatically transitions back to the setout mode, waiting for the resume command/message from the controlling vehicle. An operator on the controlling vehicle then selects a "resume" function/operation (e.g., resume distributed power remote) on the user/operator interface of the controlling vehicle. This results in transmission of the resume message from the controlling vehicle to the remote vehicle, which the remote vehicle acknowledges. (That is, the system may be configured so that the controlling vehicle must receive an acknowledgement to resume remote control.) Normal remote control communications resume (e.g., the controlling vehicle may be configured to transition back to potentially communicating movement-control messages addressed to the remote vehicle), and the user interface of the controlling vehicle may indicate the remote vehicle as being in the setout mode.

Next, to fully resume normal remote control (e.g., distributed power) operations, the operator on the controlling vehicle selects a command or function to transition the remote vehicle from the setout mode to a normal mode of operation. The operator on the controlling vehicle recovers the brake pipe by releasing/charging the automatic air brake of the consist. (This recognizes that in this example, the remote vehicle is re-mechanically coupled to the consist of the controlling vehicle before transitioning back to remote control operation, including re-connecting the brake pipe of the remote vehicle to the brake pipe of the controlling vehicle consist.) The remote vehicle verifies brake pipe continuity, satisfies a throttle lockout condition, and command the brake valve to "cut-in." Subsequently, the remote vehicle will again follow movement-control commands/messages (e.g., traction, dynamic braking) received from the controlling vehicle.

Suspend/resume vehicle interlocks may include one or more of the following: controlling vehicle and remote vehicle(s) in an emergency state; controlling and remote vehicles are not moving; controlling vehicle reverser is centered and throttle at idle; controlling vehicle independent brake is applied on full; remote vehicle to be suspended is commanded to setout mode; and/or remote vehicle to be resumed must be in setout mode.

One example of using a "suspended" remote vehicle for temporary independent operation is the following: (i) a distributed power consist (having a controlling vehicle and one or more remote vehicles) is established in or near a switching or other yard; (ii) there is a need to use one of the remote vehicles to temporarily assist with switching/moving other vehicles in the yard; (iii) a selected remote vehicle is suspended as set forth above, including decoupling it from the consist; (iv) the suspended remote is used for switching/moving other vehicles; and (v) the suspended remote is later recoupled to the consist and distributed power operations are resumed as set forth above, without having to re-link the suspended remote, from a control perspective, in the same manner as when the vehicles in the consist were originally linked. Another example is if a consist breaks apart while the front portion is on a downhill grade (and cannot back up to reconnect) and the remaining, rearward portion is on the flat. Here, distributed power operation of a remote vehicle in the remaining part of the consist is suspended, the remote vehicle is manually controlled to reattach the consist, and then distributed power operation is resumed, as set forth above.

The above description is illustrative and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A system comprising:

one or more processors configured to be operably disposed onboard a designated remote vehicle of a vehicle system that includes a controlling vehicle; and a communication device configured to be operably disposed onboard the designated remote vehicle;

wherein the one or more processors are configured to establish one or more communication links, the one or more processors configured to control movement of the designated remote vehicle in a first mode of operation and responsive to movement-control messages received from the controlling vehicle over the one or more communication links; and wherein the one or more processors are further configured, responsive to receipt of a suspend message from the controlling vehicle, to change the designated remote vehicle from the first mode of operation to a second mode of operation where movement of the designated remote vehicle is separately controlled from the controlling vehicle while maintaining the one or more communication links.

2. The system of claim 1, wherein the one or more processors are further configured, while in the second mode of operation or during transition from the first mode of operation to the second mode of operation, to control a brake component of the designated remote vehicle from a first state where movement of the designated remote vehicle is slowed, stopped, or prevented by the brake component to a second state where the movement of the designated remote vehicle is not slowed, stopped, or prevented by the brake component.

3. The system of claim 2, wherein the brake component comprises a pipe of an air brake system, and wherein the designated remote vehicle is configured to operate in the second mode of operation while mechanically decoupled from the controlling vehicle or a consist that includes the controlling vehicle.

4. The system of claim 1, wherein the one or more processors are configured, in the second mode of operation, to ignore the movement-control messages generated by the controlling vehicle for the controlling vehicle to remotely control at least one other remote vehicle of the vehicle system.

5. The system of claim 1, wherein the one or more processors are configured, in the second mode of operation, to control movement of the designated remote vehicle responsive to control signals received from a user interface of the designated remote vehicle, wherein the user interface is configured to generate the control signals responsive to operator manipulation of the user interface onboard the designated remote vehicle.

6. The system of claim 1, wherein the one or more processors are further configured, responsive to exchange of at least one designated resume message between the controlling vehicle and the designated remote vehicle over the one or more communication links, to change operation of the designated remote vehicle back to the first mode of operation.

7. The system of claim 6, wherein the one or more processors are configured to control the designated remote vehicle back to the first mode of operation responsive to receipt of both a signal indicative of operator selection of a resume function of a user interface onboard the designated remote vehicle and the designated resume message from the controlling vehicle.

8. The system of claim 7, wherein the one or more processors are further configured, while in the second mode of operation or while transitioning from the first mode of operation to the second mode of operation, to control a brake component of the designated remote vehicle from a first state where movement of the designated remote vehicle is slowed, stopped, or prevented by the brake component to a second state where the movement of the designated remote vehicle is not slowed, stopped, or prevented by the brake component, and wherein the one or more processors are configured, responsive to receipt of the signal indicative of operator selection of the resume function, to control the brake component to the first state; and wherein the one or more processors are configured, responsive to both subsequent receipt of the designated resume message from the controlling vehicle and occurrence of one or more designated operating conditions of the controlling vehicle or the designated remote vehicle, to control the designated remote vehicle back to the first mode of operation, wherein subsequent control of the designated remote vehicle in the first mode of operation includes controlling the designated remote vehicle in response to the movement-control messages from the controlling vehicle.

9. A system comprising:

one or more processors configured to be operably disposed onboard a controlling vehicle of a vehicle system that includes one or more remote vehicles; and a communication device configured to be operably disposed onboard the controlling vehicle and coupled to the one or more processors;

wherein the one or more processors are configured to establish one or more communication links with the one or more remote vehicles and communicate, through the one or more communication links, movement-control messages to control movement of the one or more remote vehicles that are operating in a first mode of operation;

wherein the one or more processors are configured to communicate a suspend message to a designated remote vehicle of the one or more remote vehicles that commands the designated remote vehicle to change from the first mode of operation to a second mode of operation;

subsequent to communicating the suspend message, the one or more processors are further configured to at least one of:

change a stored current status of the designated remote vehicle from a currently remote status to a currently-suspended status, wherein the currently remote status is indicative of the designated remote vehicle being in the first mode of operation and the currently-suspended status is indicative of the designated remote vehicle being in the second mode of operation;

exchange linking messages between the designated remote vehicle and the controlling vehicle through the one or more communication links to confirm the one or more communication links exists;

communicate new movement-control messages to at least one other remote vehicle in the first mode of operation but not communicate the new movement-control messages to the designated remote vehicle; or confirm the designated remote vehicle is mechanically decoupled from the controlling vehicle or a consist that includes the controlling vehicle.

10. The system of claim 9, wherein the one or more processors are further configured to at least one of:

receive confirmation that the designated remote vehicle has changed from the first mode of operation to the second mode of operation;

generate an announcement that the designated remote vehicle has a currently-suspended status;

communicate that the designated remote vehicle has a currently-suspended status to a remote monitoring facility; or communicate a message to the at least one other remote vehicle that at least one of: communicates the designated remote vehicle has a currently-suspended status or commands the at least one remote vehicle to change a current status to another status.

11. The system of claim 9, wherein, while the designated remote vehicle is in the second mode of operation, the one or more processors are further configured to communicate one or more of the linking messages to the designated remote vehicle and receive one or more return messages from the designated remote vehicle that confirms receipt of at least one of the one or more linking messages.

12. The system of claim 9, wherein the one or more processors are further configured to exchange at least one resume message between the controlling vehicle and the designated remote vehicle over the one or more communication links, the at least one resume message including an instruction that the designated remote vehicle is to return to the first mode of operation.

13. The system of claim 12, wherein, subsequent to exchange of the at least one resume message but prior to changing operation of the designated remote vehicle back to the first mode of operation, the one or more processors are further configured to at least one of:

receive confirmation that the designated remote vehicle is configured to be remotely controlled by the controlling vehicle;

change the current status of the designated remote vehicle to another status;

generate an announcement that the designated remote vehicle has the other status; or communicate that the designated remote vehicle has the other status to a remote monitoring facility.

14. The system of claim 12, wherein, subsequent to exchange of the at least one resume message but prior to changing operation of the designated remote vehicle back to the first mode of operation, the one or more processors are further configured to confirm that the designated remote vehicle and the controlling vehicle are operably coupled such that the designated remote vehicle is at least one of mechanically coupled to the controlling vehicle, pneumatically coupled to the controlling vehicle, or configured to be remotely controlled by the controlling vehicle.

15. The system of claim 14, wherein the one or more processors are configured to confirm that the designated remote vehicle and the controlling vehicle are operably coupled by determining that an air brake system passed a test that confirms the air brake system is operational.

16. The system of claim 12, wherein, subsequent to exchange of the at least one resume message, the one or more processors are further configured to communicate movement-control messages to control movement of the designated remote vehicle in the first mode of operation.

17. A method comprising:

for a vehicle system that includes a controlling vehicle and plural remote vehicles, establishing one or more communication links between the controlling vehicle and a designated remote vehicle of the plural remote vehicles of a vehicle system;

controlling movement of the designated remote vehicle in a first mode of operation, wherein controlling movement of the designated remote vehicle in the first mode of operation includes controlling movement of the designated remote vehicle based on movement-control messages received from the controlling vehicle at the designated remote vehicle;

responsive to receiving, at the designated remote vehicle, a suspend message, changing the designated remote vehicle from the first mode of operation to a second mode of operation; and controlling movement of the designated remote vehicle in the second mode of operation, wherein movement of the designated remote vehicle in the second mode of operation is separately controlled from the controlling vehicle while maintaining the one or more communication links.

18. The method of claim 17, wherein the method further comprises, at the designated remote vehicle in the second mode of operation, ignoring the movement-control messages generated by the controlling vehicle for the controlling vehicle to remotely control at least one other remote vehicle of the plural remote vehicles.

19. The method of claim 17, wherein the method further comprises, responsive to exchange of at least one designated resume message between the controlling vehicle and the designated remote vehicle over the one or more communication links, changing operation of the designated remote vehicle back to the first mode of operation.

20. The method of claim 17, wherein the method further comprises:

receiving movement-control messages from a remote monitoring facility or a device that is not disposed onboard the controlling vehicle or the designated remote vehicle and controlling the designated remote vehicle responsive to the movement-control signals.

* * * * *